US008177457B2

(12) United States Patent
Boudreaux, Jr.

(10) Patent No.: US 8,177,457 B2
(45) Date of Patent: May 15, 2012

(54) PIPELINE PROTECTION AND LEVEE MODULE SYSTEM

(76) Inventor: James C Boudreaux, Jr., Schreiver, LA (US)

( * ) Notice: Subject to any disclaimer, the term of this patent is extended or adjusted under 35 U.S.C. 154(b) by 254 days.

(21) Appl. No.: 12/629,748

(22) Filed: Dec. 2, 2009

(65) Prior Publication Data

US 2010/0074687 A1 Mar. 25, 2010

Related U.S. Application Data

(63) Continuation-in-part of application No. 11/603,365, filed on Nov. 21, 2006, now Pat. No. 7,651,298.

(60) Provisional application No. 60/739,475, filed on Nov. 22, 2005, provisional application No. 60/813,885, filed on Jun. 12, 2006.

(51) Int. Cl.
*E02B 7/00* (2006.01)

(52) U.S. Cl. ..... 405/114; 405/111; 405/116; 405/157

(58) Field of Classification Search ..... 405/15, 405/21, 30, 31, 33, 34, 35, 107, 111, 114, 405/115, 116, 255, 284, 285, 286, 157
See application file for complete search history.

(56) References Cited

U.S. PATENT DOCUMENTS

| | | | | |
|---|---|---|---|---|
| 274,449 | A | 3/1883 | Lee | |
| 390,175 | A | 9/1888 | Lee | |
| 945,859 | A | 1/1910 | Neuberger | |
| 1,552,077 | A | 9/1925 | Palanti | |
| 3,319,328 | A * | 5/1967 | Finger et al. | 405/216 |
| 3,441,140 | A | 4/1969 | Thurber | |
| 3,448,585 | A * | 6/1969 | Vogelsang | 405/255 |
| 3,503,589 | A * | 3/1970 | Moore | 405/284 |
| 3,645,100 | A | 2/1972 | La Monica | |
| 4,189,252 | A | 2/1980 | Inman | |
| 4,192,628 | A | 3/1980 | Gorman | |
| 4,245,931 | A * | 1/1981 | Watts, Jr. | 405/255 |
| 4,341,050 | A | 7/1982 | Long | |
| 4,386,872 | A * | 6/1983 | Smith | 405/13 |
| 4,431,337 | A | 2/1984 | Iwasa | |
| 5,017,042 | A | 5/1991 | Minor | |
| 5,599,136 | A | 2/1997 | Wilke | |
| 6,443,652 | B1 | 9/2002 | Houck | |
| 6,491,473 | B2 * | 12/2002 | Veazey | 405/16 |
| 6,558,075 | B2 | 5/2003 | Benedict | |

(Continued)

FOREIGN PATENT DOCUMENTS

| | | |
|---|---|---|
| EP | 1193348 | 4/2002 |
| EP | 1418276 | 5/2004 |
| EP | 1508643 | 2/2005 |

(Continued)

*Primary Examiner* — Frederick L Lagman
(74) *Attorney, Agent, or Firm* — Connie R. Masters

(57) ABSTRACT

A levee and barrier module for fluid control and containment is provided including an outer module shell and a module-to-module connection system to attach adjacent outer shells. The outer module shell is formed by opposing side walls and two opposing end walls and is configured to enclose or support filler material. The outer module shell defines a top aperture and a bottom aperture. The bottom aperture allows filler material communication with the earth below the module. The top aperture allows filler material to be added to the module, as well as visual observation of, and maintenance of, the amount of contained filler material. A presented application is directed to protecting pipelines and to allowing pipeline integration or association with levees.

11 Claims, 38 Drawing Sheets

U.S. PATENT DOCUMENTS

| | | | |
|---|---|---|---|
| 6,735,913 | B2 | 5/2004 | Sanders |
| 6,872,032 | B2 | 3/2005 | Boys |
| 2004/0156680 | A1 | 8/2004 | Gibbs |
| 2005/0053429 | A1 | 3/2005 | Davidsaver |
| 2006/0000179 | A1 | 1/2006 | Albert |

FOREIGN PATENT DOCUMENTS

| | | |
|---|---|---|
| WO | WO8103190 | 11/1981 |
| WO | WO9903659 | 1/1999 |
| WO | WO9911868 | 3/1999 |
| WO | WO02068770 | 9/2002 |

* cited by examiner

FIG. 45
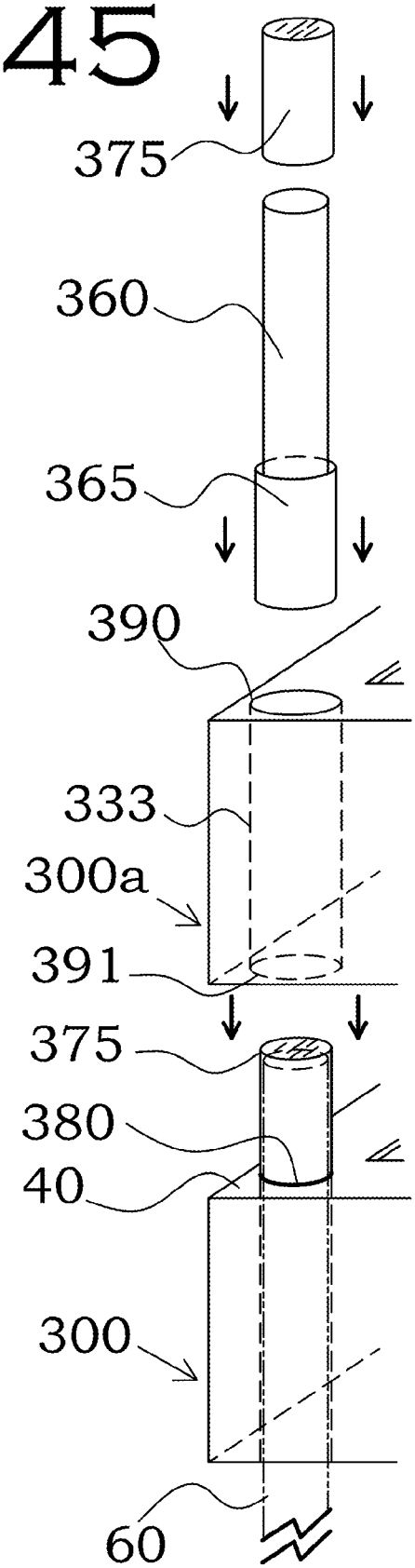
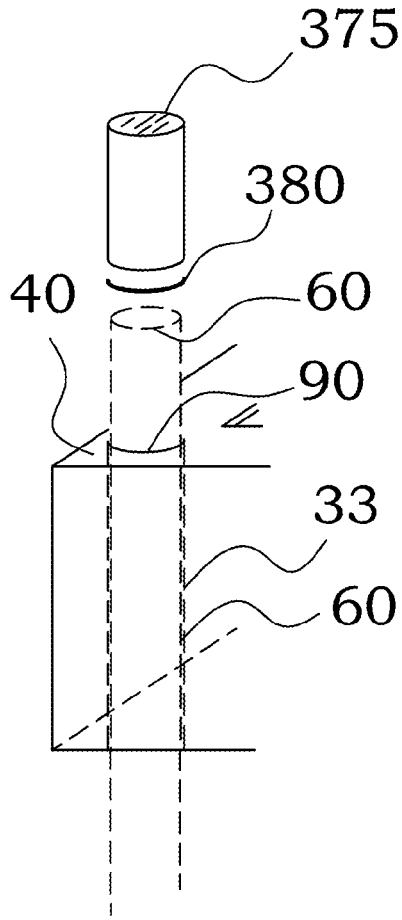
FIG. 44

PIPELINE PROTECTION AND LEVEE MODULE SYSTEM

CROSS-REFERENCE TO RELATED APPLICATIONS

This application is a Continuation-in-Part of U.S. patent application Ser. No. 11/603,365, which was filed Nov. 21, 2006 and issued Jan. 26, 2010 as U.S. Pat. No. 7,651,298, which claims the benefit of U.S. Provisional Application No. 60/739,475, filed Nov. 22, 2005, and U.S. Provisional Patent Application No. 60/813,885, filed Jun. 12, 2006; all cited prior applications are incorporated by reference in this application.

FIELD OF THE INVENTION

This invention relates generally to modular units for construction of levee and barriers, with a particular application to pipeline protection.

DESCRIPTION OF THE PRIOR ART

Floods can have a devastating effect, both in economic loses and in lives disrupted or lost. Numerous attempts have been made to solve the water containment and control problem, yet each solution is deficient in some area.

The most common solution for water control problems involves the use of earthen embankments or levees made of soil. While earthen levees are economical to install, the motion of the water causes rapid deterioration, as the levee has no structure or armor to protect it. Also, particularly in some soils, subsidence reduces the height of the levee over time. Because of subsidence and because of damage due to water and wave action, the initial financial investment vanishes as the earthen levee deteriorates over a period of a few years. Also, as there is no structure beneath the soil, during floods the soil beneath the foundation of the levee may weaken or even form a liquefied zone, undermining the stability of the levee. Additionally, because the earthen levee is generally triangular in cross section, the levee must be quite wide at the bottom to have enough stable soil at the top to withstand water motion. Furthermore, an earthen levee cannot be easily built while in a flood, emergency, or repair situation. For example, if a levee along a river is inspected and found to be substandard, an earthen levee cannot be built in the water of the river around the defective portion to allow full access to both sides for repair of the substandard section. It would be advantageous to have a water control or levee system that was sturdier and more long lasting, that preserved more of the initial financial investment, that provided more structure or anchoring to combat the weakening of the foundation of the levee, that did not require such a large base compared to the height, and that could be constructed while in a flooding or repair situation.

When the earthen levee height is limited by weak natural soils or reduced by subsidence, additional height can be gained by driving corrugated steel sheet piles into the levee crest to form a floodwall. This method does provide more structure, as the sheet piles can be driven deeper vertically for more stability. However, several problems remain. If the supporting earthen levee with the floodwall subside, it is not easy to raise the height. The soil beneath the foundation of the levee may still weaken, destabilizing the levee. Because the floodwall is typically built with the sheet piles driven into earthen embankments, the floodwall is still wide at the bottom, which is especially troublesome when space is limited as in a city or near structures. Nor can the floodwall be easily constructed to a partial height to provide some protection, and then, as finances allow, be finished to a full height, which would be beneficial.

Additionally, during levee construction pipelines crossing the levee area are often encountered. These pipelines present particular problems and complications, not only at the time of levee construction, but also at later times when maintenance or servicing of the pipeline may be required. Further, at times pipelines require protection or shielding, such as when a pipeline must cross under a road or when a pipeline running from an underground offshore location emerges onto the land.

Accordingly, there is an established need for an effective, sturdy, long-lasting levee and barrier system and module that provides more structure or anchoring to combat the weakening of the foundation of the levee, that preserves more of the initial financial investment after subsidence, that reduces the required base size, that can be readily constructed while in a flooding or repair situation, that is configured to allow more height to be quickly and easily added to the levee should the need arise, that can be constructed to a partial height to provide partial protection until finances allow completion to a full height, and that can be applied to the particular problems and specific requirements of pipeline protection.

SUMMARY OF THE INVENTION

The present invention is directed to a levee and barrier module and system that is capable of providing fluid control and containment and that is capable of providing pipeline protection and pipeline integration into levees. The levee and barrier module includes an outer module shell and a module-to-module connection system to connect adjacent outer shells. The outer module shell, being in the general shape of a prism or prism with attached cylindrical section or sections, comprises two opposing end walls and at least two opposing side walls, and is configured to enclose or support filler material. The two opposing end walls are configured with end apertures. The outer module shell defines a top aperture in the plane of the top edges of the side walls and end walls and defines a bottom aperture in the plane of the bottom edges of the side walls and end walls. When modules are placed end to end in a levee system the end apertures allow filler material communication horizontally between horizontally adjacent modules. When modules are stacked vertically in a levee system the bottom aperture allows filler material communication with vertically adjacent modules and the earth below the modules. The top aperture allows filler material to be added to the module, as well as allowing visual observation of the amount of contained filler material.

The module optionally includes one or more guide plates. The guide plate may optionally have one or more guide plate apertures formed therein to allow insertion of a rod shaped anchor such as a piling or stake for the purpose of anchoring the outer shell with enclosed filler material to the ground.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 44 is an exploded detail view taken from circle 44 of FIG. 43;

FIG. 45 is an exploded detail view of the area of FIG. 44, depicting the addition of an additional module;

Like reference numerals refer to like parts throughout the several views of the drawings.

DETAILED DESCRIPTION OF THE PREFERRED EMBODIMENTS

Figure 1:
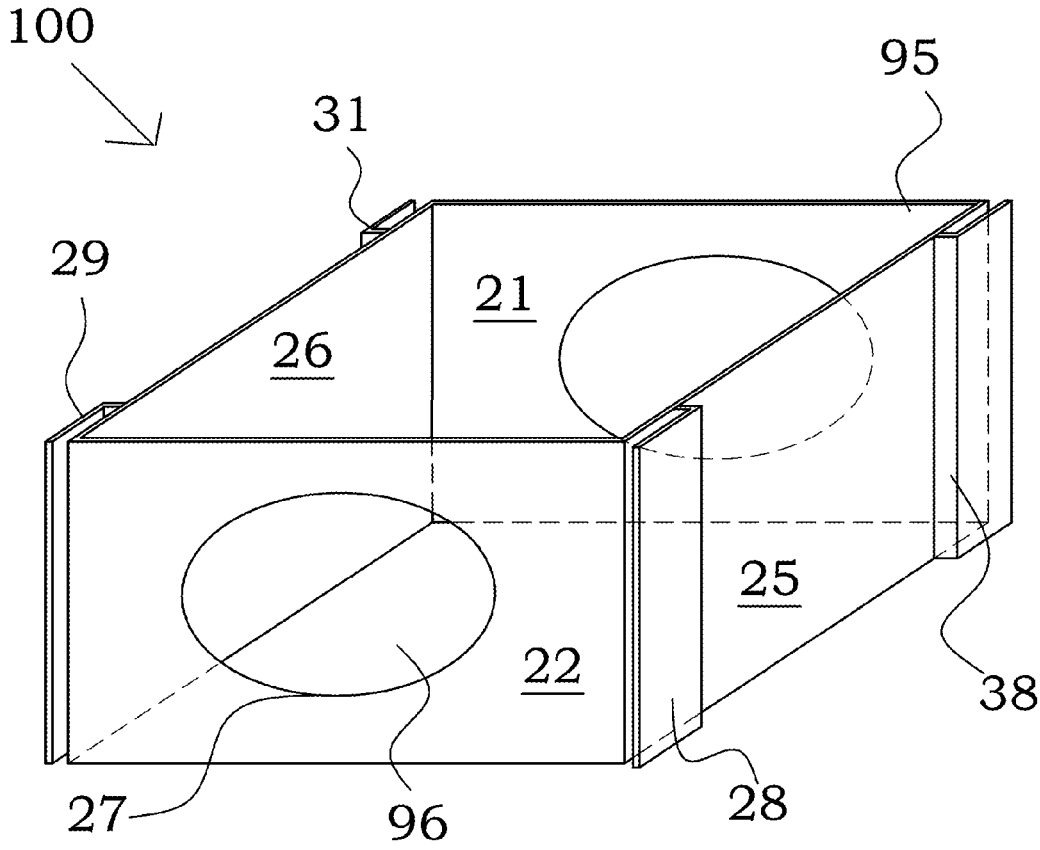
FIG. 1 is a perspective view showing the first embodiment of the levee and barrier module and system of the present invention.

Shown throughout the figures, the present invention is directed toward a levee and barrier module and system that is capable of providing fluid control and containment and that is capable of providing pipeline protection and pipeline integration into levees. The modules may be used individually, but are adapted to fit together for construction of barriers and flood levee systems, being designed for installation in a wide variety of locations. They are configured for use in, for example, any of the following: in flood-prone areas; as bulkheads along waterways; in marshes; along shorelines; in the open sea; in protected waters such as lakes, rivers, bays, and bayous; in areas having existing pipelines; or in areas of new pipeline construction, While the modules can be shipped in panels and assembled on site, the modules are designed to be prefabricated. Prefabrication provides economy and ease of construction, as well as ease of in situ assembly of the levee or barrier structure formed by the modules in the field, so they can be quickly deployed into use and dismantled as required for reuse or for repair and maintenance.

In overview, thirteen embodiments of the levee and barrier modules are provided having the same basic unit of the system, a module, but substantially differentiated by the type of module-to-module connection systems for joining the outer shells of the modules and differentiated by the general shape of the outer shell. The basic unit of the system, the module, will generally be referenced as numeral n00, where n represents the number of the embodiment, or when the reference is to any or all of the embodiments, the designation "n00" will be used.

The first four exemplary embodiments vary in the module-to-module connection system. The first embodiment (FIG. 1 to FIG. 5), shown generally as reference number 100, utilizes an exterior fastening mechanism 30 and an interior fastening mechanism 35 for a module-to-module connection system. The second embodiment (FIG. 6 to FIG. 9), shown generally as reference number 200, is connected by means of lateral projection 43, lateral projection 44, lower projection 45, and lower projection 42. The third embodiment (FIG. 10 to FIG. 11), shown generally as reference number 300, is configured with complementary end flanges to connect adjacent modules. The fourth embodiment (FIG. 12 to FIG. 13), shown generally as reference number 400, incorporates complementary end flanges with removable side partitions to provide for a collapsible module for easier transport and storage. Also provided are a variety of features (FIG. 14-FIG. 21) that can be applied to any of the embodiments of the levee and barrier modules n00. In addition, a variety of applications of the system, including applications for pipeline protection and for pipeline incorporation into levees, are provided, in which any of the fourteen embodiments are suitable for use.

The next nine exemplary embodiments vary in the general shape of the module n00. The basic unit of the levee and barrier module system, common to all embodiments, is the module n00 that may be of any desired form and dimension in the general shape of a prism or prism with attached cylindrical section or sections. The module n00 comprises at least two opposing substantially vertical side walls 25, 26 and two opposing substantially vertical end walls 21, 22, forming the module n00 outer shell. The opposing end walls 21, 22, which extend perpendicularly to the longitudinal axis of the levee or barrier when multiple modules n00 are utilized in a typical configuration, have an end aperture 27 of any desired shape or size. The side walls 25, 26, extending parallel to the longitudinal axis of the levee or barrier, are solidly formed with no aperture. The outer shell defines an opening in the top of module n00, a top aperture 95, in the plane of the top edges of side walls 25, 26 and end walls 21, 22, as well as defining an opening in the bottom of the module, a bottom aperture 96, in the plane of the bottom edges of side walls 25, 26 and end walls 21, 22. For example, in FIG. 1, top aperture 95 is formed by the top edges of side walls 25, 26 and end walls 21, 22; bottom aperture 96 is formed by the bottom edges of side walls 25, 26 and end walls 21, 22. Therefore, the module n00 has an aperture at the top, at the bottom, and at both end walls, but has solid side walls 25, 26.

The module n00 is designed to be placed in location on the ground or earth, either underwater or above water. The module n00 is preferably configured to enclose or support filler material 109 (FIG. 15, 19, 34), which is introduced into the module n00 through top aperture 95. The filler material 109 can be any material available at the placement site or any material that is brought to the placement site for the purpose of filling the module n00, such as mud, cement, sand, rocks, gravel, crushed rock, debris, plastic, rubble, or other like material. However, in some applications the module n00 may not contain filler material 109, but may be simply utilized as constructed. Not only is the area defined by the outer shell of the module n00 filled as the filler material 109 is added through the top aperture 95, but also any irregularities in the ground below the module n00 are filled by the downward movement of the filler material 109 through the bottom aperture 96. Thus the ground is leveled, and a solid shoe or base 99 (FIG. 19) is formed.

Figure 2:
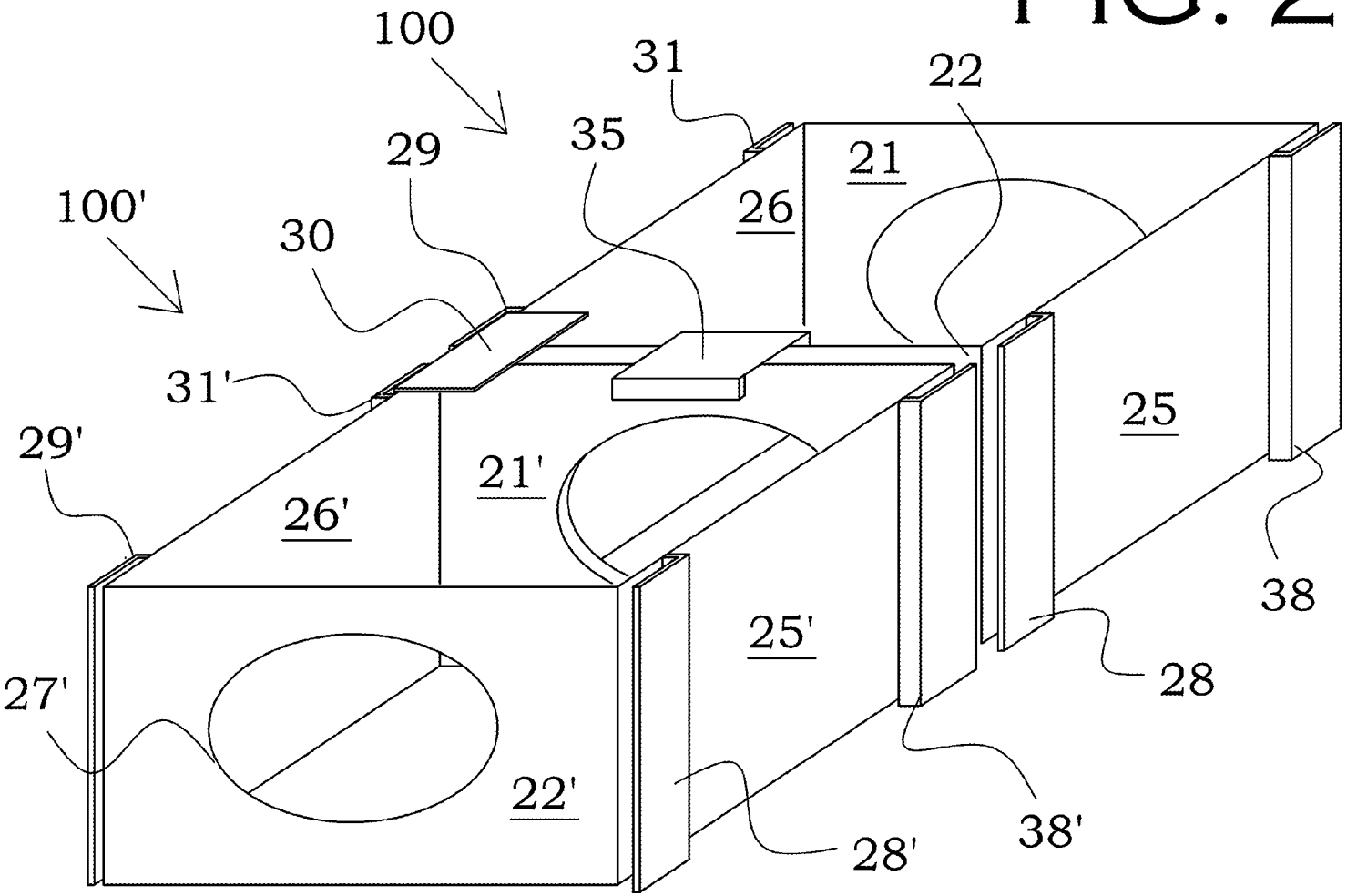
FIG. 2 is a perspective view showing 2 modules and a module-to-module connection system of the first embodiment of the levee and barrier module and system of the present invention.
Figure 19:
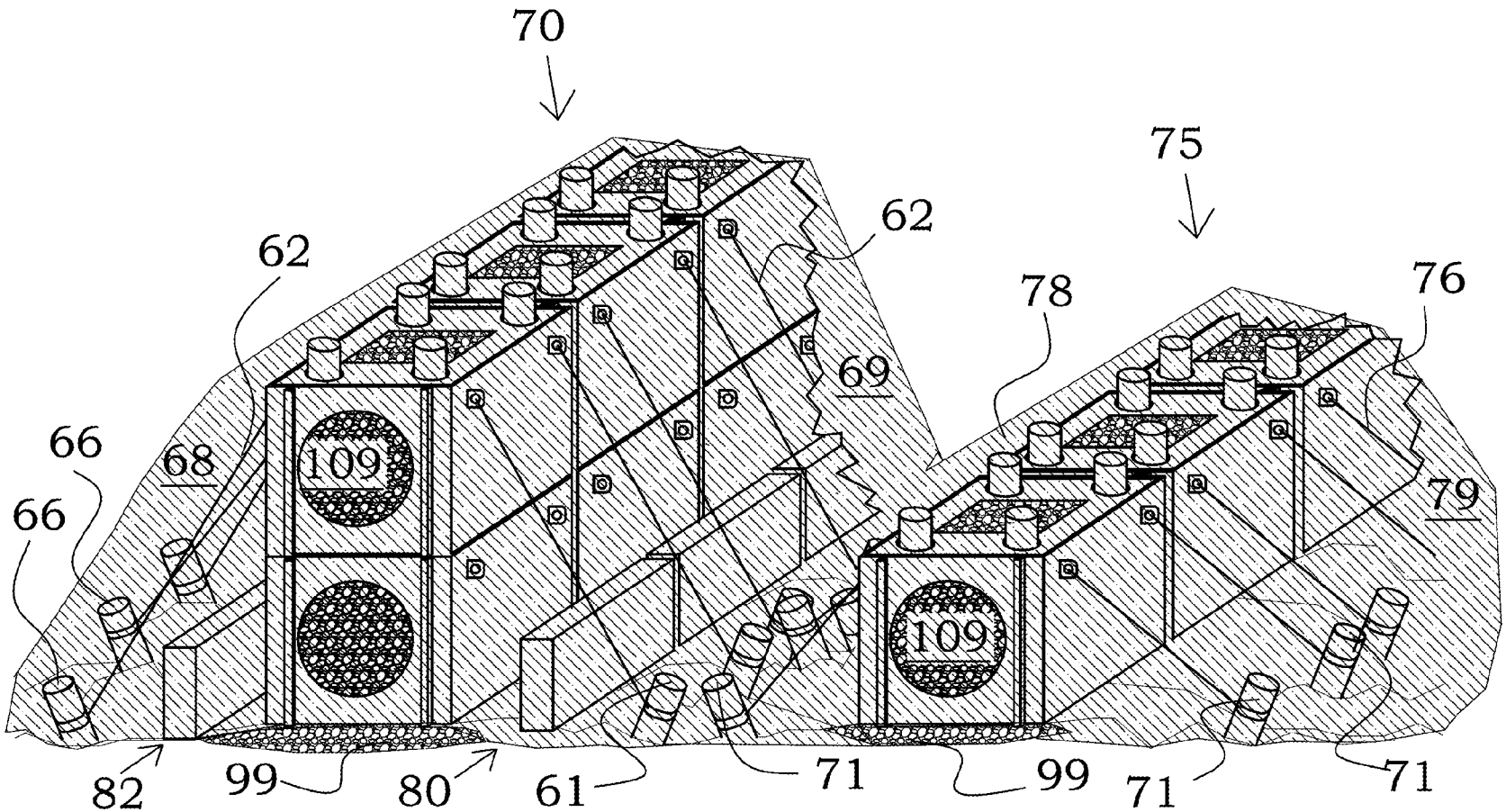
FIG. 19 is a perspective view showing a multiple module levee and barrier module system application that can be constructed with any of the embodiments of the levee and barrier module and system, which is illustrated with the barrier module of the third embodiment.

Additionally, when modules n00 are abutted together and placed end to end in a levee structure as in, for example, FIG. 2 and FIG. 19, the contiguous end apertures 27 of adjacent modules n00 form an elongated opening that is continuous through adjacent modules n00, thereby permitting a longitudinal flow of the filler material 109. When the modules n00 are placed end-to-end, side walls 25, 26 serve as forward and rearward walls of the barrier or levee system. For ease of fabrication, it may be seen that each module n00 has its side walls 25, 26 and end walls 21, 22 formed from a limited number of types of sections.

The modules n00 are illustrated as being constructed of steel plate, but can be constructed of aluminum, aluminum plate, plastic, resins, cement, concrete, pre-stressed concrete, reinforced concrete, wood, other building material, or of a combination of materials, some of which would require additional reinforcement. The side walls 25, 26 and the end walls 21, 22 are demonstrated as welded together to form the outer shell, but any fastening method could be used, including welding, mechanical attachment means, adhesive attachment means, or the like. Alternatively, the module n00 can be molded or otherwise formed in one piece in manufacture. The invention may be applied to small levees or water barriers (such as used in farming, in irrigation, in flood-prone areas, in land protective bulkheads, etc.) or to large levees or water barriers (such as where protection from hurricanes, flooding, tidal surge, tsunamis, erosion on riverbanks, etc. is needed). The module material, size, and module-to-module connection system can be chosen for the specific application. In larger levees an advantage of the present invention is that after the filler material 109 fills the module n00, one or more vehicles could drive on top of the levee for ease of maintenance, repair, and inspection.

Referring now to the first exemplary embodiment of the present invention illustrated in FIG. 1 to FIG. 5, the barrier module 100 comprises an outer shell is configured as a rectangular prism and a module-to-module fastening system. The module-to-module fastening system comprises an exterior fastening mechanism 30, an interior fastening mechanism 35, external fastening mechanism holders 29, 31, and external fastening mechanism holders 28, 38. The module-to-module fastening system may be formed of any suitable material to correspond with the material of the module 100.

External fastening mechanism holders 29 and 31 are attached to or formed integrally with the exterior surface of side wall 26. External fastening mechanism holders 28 and 38 are attached to or formed integrally with the exterior surface of side wall 25.

Figure 3:
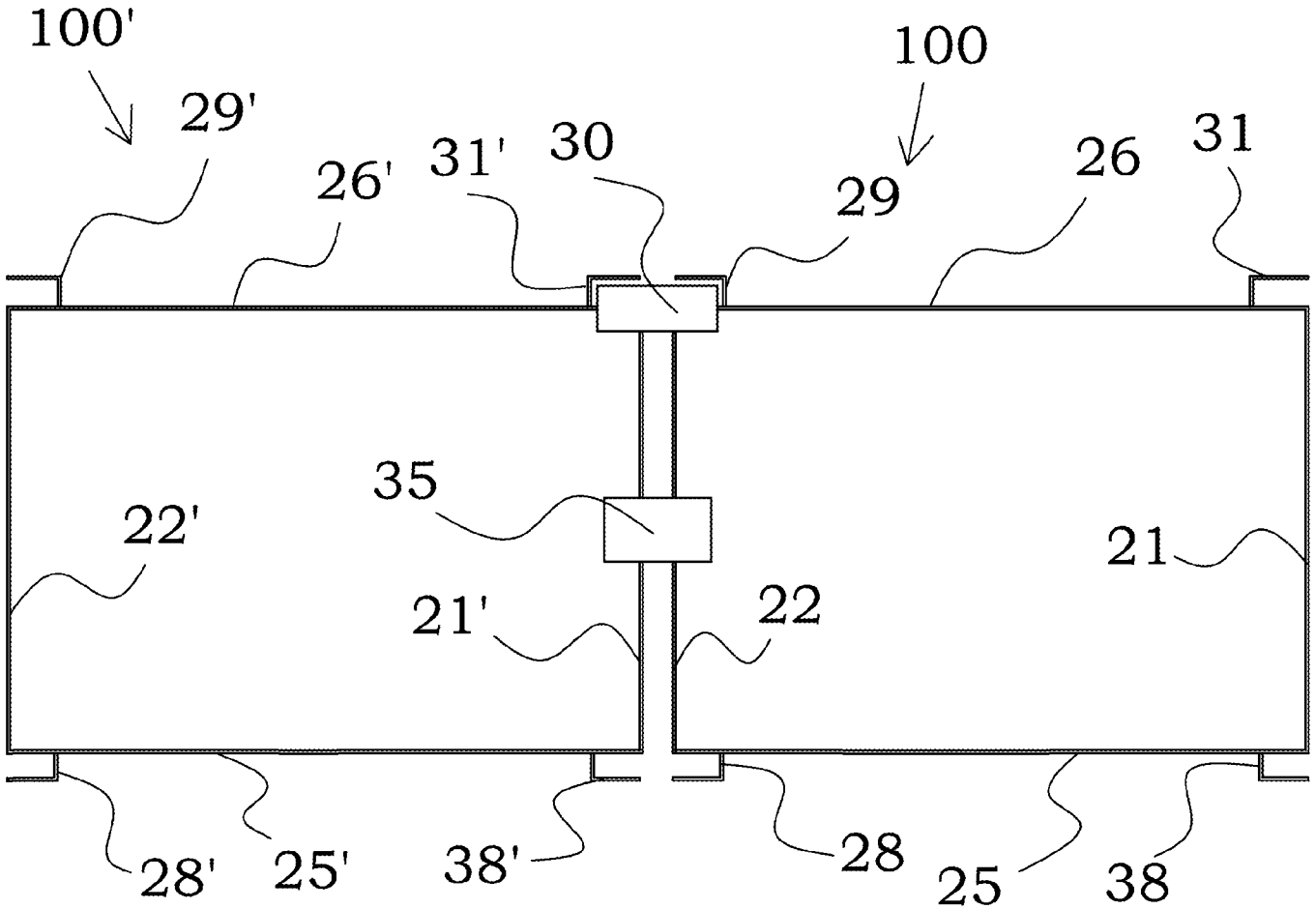
FIG. 3 is a top view showing 2 modules and the module-to-module connection system of the first embodiment of the levee and barrier module and system of the present invention.

Referring to FIG. 2 and FIG. 3, adjacent modules abutted together can be connected, while allowing some flexibility in the connection, by the exterior fastening mechanism 30 and the interior fastening mechanism 35. The adjacent modules can be tightly abutted or merely arranged end-to-end with a few inches between the adjacent end walls 21' and 22. Exterior fastening mechanism 30 is an L-shaped locking plate that is configured to slidingly engage within the external fastening mechanism holders of adjacent modules. For example, exterior fastening mechanism 30 slides into a channel defined by external fastening mechanism holder 29 and external fastening mechanism holder 31' on adjacent modules 100 and 100', respectively. Exterior fastening mechanism holder 29 and 31' is configured in an L-shape to form the channel into which the L-shaped locking plate of exterior fastening mechanism 30 fits.

Figure 4:
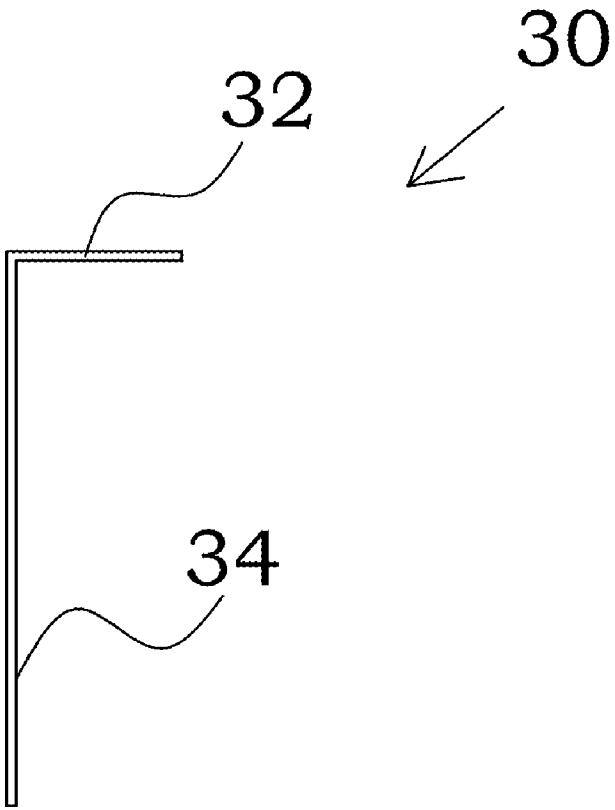
FIG. 4 is a side view showing an exterior fastening mechanism of the first preferred embodiment of the levee and barrier module and system of the present invention.

As shown in more detail in FIG. 4, exterior fastening mechanism 30 has a horizontal member 32 and vertical member 34. To connect adjacent modules 100 and 100' vertical member 34 is inserted into the channel defined by external fastening mechanism holder 29 and external fastening mechanism holder 31' to the distance permitted by horizontal member 32. In a similar manner, a second exterior fastening mechanism 30 can be used on the opposing side of the module; for example, exterior fastening mechanism 30 can be slid into the slot defined by external fastening mechanism holder 28 and external fastening mechanism holder 38'. (In FIG. 2 and FIG. 3 the second exterior fastening mechanism 30, which would typically be installed is omitted for clarity of illustration.)

Figure 5:
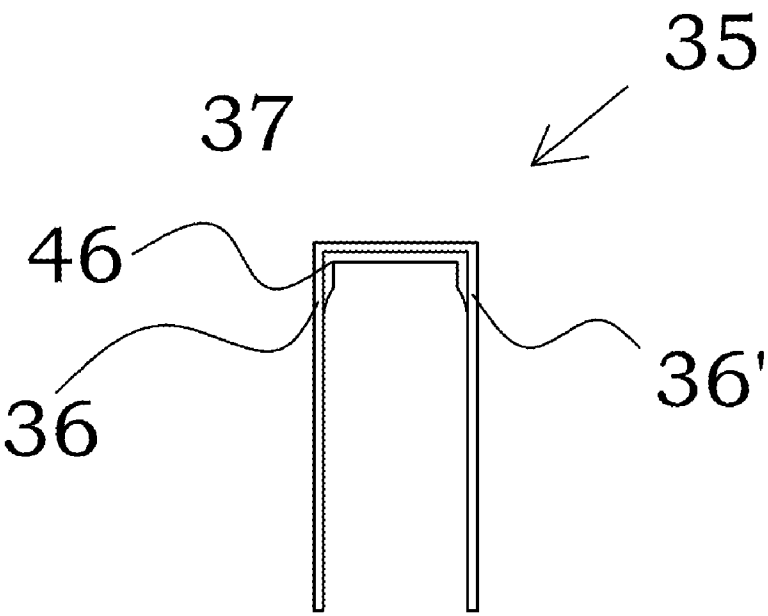
FIG. 5 is a side view showing an interior fastening mechanism of the first preferred embodiment of the levee and barrier module and system of the present invention.

Shown in side view in FIG. 5, the U-shaped interior fastening mechanism 35 is a flat horizontal plate 37 with legs 36, 36' extending at substantially a right angle. The legs 36, 36' slide down over the end walls 22 and 21' of adjacent modules 100 and 100'. Preferably, U-shaped interior fastening mechanism 35 is reinforced for strength, with an interior support 46. Exterior fastening mechanism 30 and interior fastening mechanism 35 can be used in construction either above or below the level of the water, but is more particularly for use in above water construction.

Figure 6:
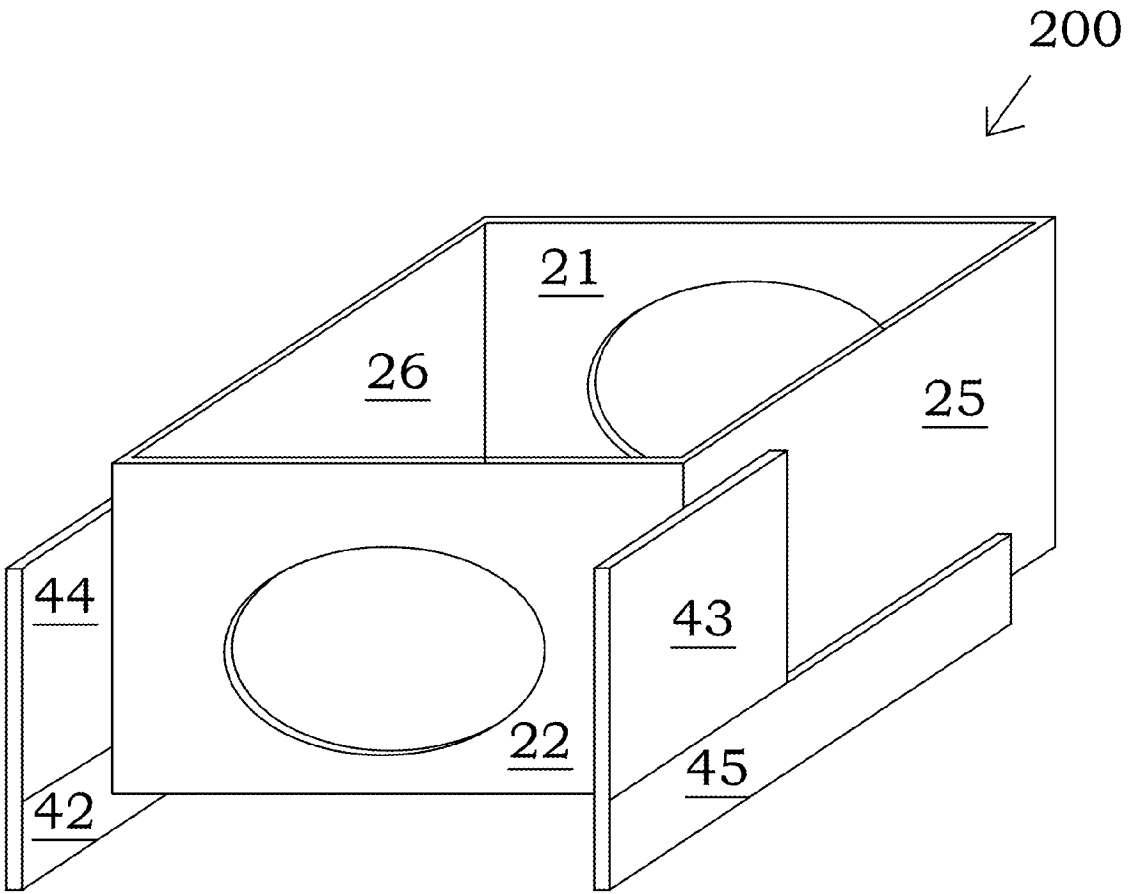
FIG. 6 is a perspective view showing a module and a module-to-module connection system of the second embodiment of the levee and barrier module and system of the present invention.
Figure 7:
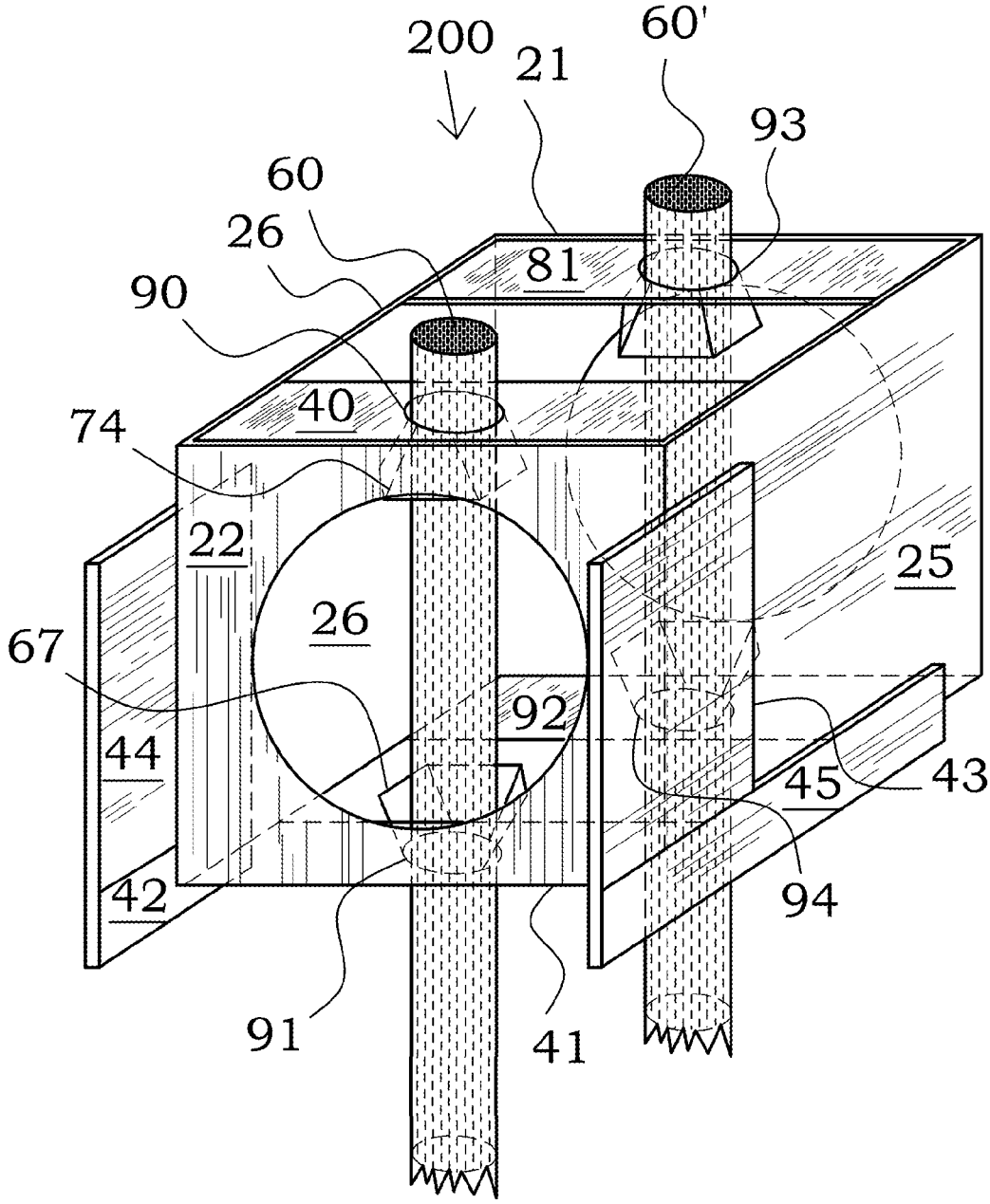
FIG. 7 is a perspective view showing additional features that can be applied to any of the embodiments of the levee and barrier module and system of the present invention, which are illustrated as applied to the second embodiment.
Figure 8:
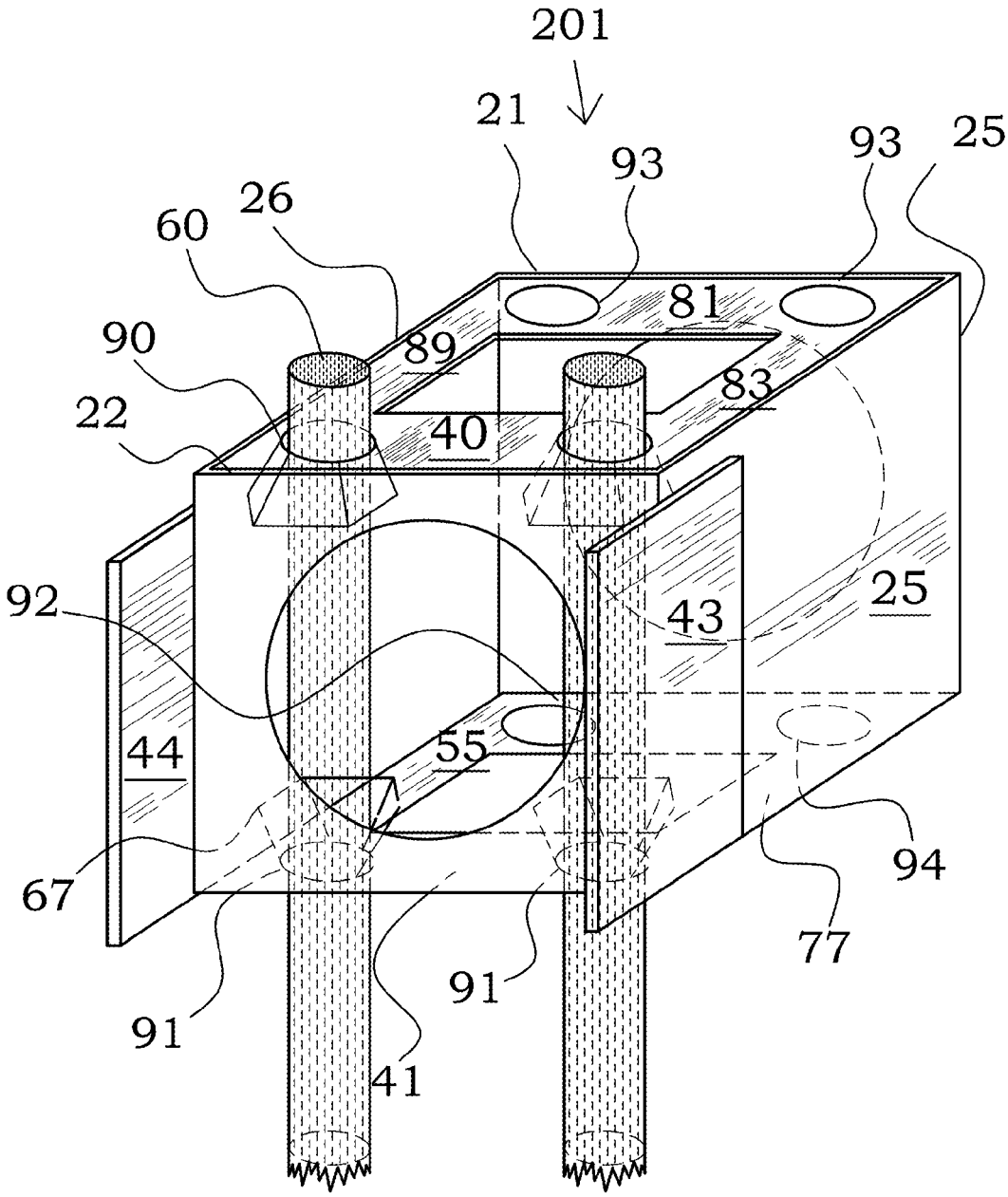
FIG. 8 is a perspective view showing additional features that can be applied to any of the embodiments of the levee and barrier module and system of the present invention, which are illustrated as applied to the second embodiment.

Referring now to FIG. 6, FIG. 7, and FIG. 8, a levee and barrier module, shown generally as reference number 200, is illustrated in accordance with the second exemplary embodiment of the present invention. The levee and barrier module 200 of the second embodiment comprises the outer shell formed of side walls 25, 26 and end walls 21, 22, with a second module-to-module connecting system used to connect horizontally and vertically adjacent levee and barrier modules 200. Module 200 is useful for construction of a levee or barrier system either above or below the level of the water.

This second connecting system includes a substantially vertical lateral projection 43, a substantially vertical lateral projection 44, a substantially vertical lower projection 45, and a substantially vertical lower projection 42. Lower projection 45 is a panel somewhat shorter in length than side wall 25 and can be attached to—or integrally formed with—the lower edge of side wall 25, extending somewhat beyond the corner of end wall 22 and side wall 25 and extending somewhat beyond the lower edge of side wall 25. Lower projection 42 is a panel somewhat shorter in length than side wall 26 and can be attached to—or integrally formed with—the lower edge of side wall 26, extending somewhat beyond the corner of end wall 22 and side wall 26 and extending somewhat beyond the lower edge of side wall 26. Lower projection 45 and lower projection 42 are shorter than the length of side wall 25, 26 to allow for the overlap of the projections of an horizontally adjacent module. Lateral projection 43 is a panel that can be attached to—or integrally formed with—the lateral edge of side wall 25, extending somewhat beyond the corner of end wall 22 and side wall 25. Lateral projection 44 is a panel that can be attached to—or integrally formed with—the lateral edge of side wall 26, extending somewhat beyond the corner of end wall 22 and side wall 26. Lateral projection 43 and lateral projection 44 are somewhat shorter than end wall 22 to allow for the overlap of the lower lateral projections of a vertically adjacent module.

Although demonstrated here as 3 separate pieces for clarity of discussion, for economy in production side wall 25 plus lower projection 45 plus lateral projection 43 are preferably made in one piece instead of combining separate pieces. Or, for example, if the construction material permits, side wall 26 plus lower projection 42 plus lateral projection 44 can be molded or formed as one integral piece. Projections 42, 43, 44, 45 function to allow a connection between modules, while maintaining a degree of flexibility in the connection.

FIG. 7 and FIG. 8 also illustrate an optional feature, one or more inwardly extending top guide plates (40, 81, 83, 89) and bottom guide plates (41, 92, 77, 55), that can be used with any of the embodiments of the present invention, but are shown as applied to the module 200 of the second embodiment. Top guide plates and bottom guide plates may comprise a solid panel, or optionally, top guide plates and bottom guide plates may have aligned conduits through which rod-type anchors such as pilings 60 and 60' may be driven or installed for additional anchoring.

A top end guide plate 40 is disposed in the plane of the upper edge of the outer shell, extending along end wall 22 between side wall 25 and side wall 26. Top end guide plate 40 may be attached to end wall 22, a portion of side wall 25, and a portion of side wall 26, or alternatively, to only end wall 22, or alternatively, to only a portion of side wall 25 and a portion of side wall 26. In a similar manner, top end guide plate 81 is disposed in the plane of the upper edge of the outer shell, extending along end wall 21 between side wall 25 and side wall 26. Top end guide plate 81 may be attached to end wall 21, a portion of side wall 25, and a portion of side wall 26, or alternatively, to only end wall 22, or alternatively, to only a portion of side wall 25 and a portion of side wall 26.

Opposing lower end guide plates 41 and 92 are disposed in the plane of the bottom edge of the outer shell forming a partial floor, extending. Lower end guide plate 41 extends horizontally along the lower edge of end wall 22 between side wall 25 and side wall 26. Lower end guide plate 92 extends horizontally along the lower edge of end wall 21 between side wall 25 and side wall 26. Lower end guide plate 41 may be attached at either a portion of the side walls 25, 26 or at the end wall 22, or at both a portion of the side walls 25, 26 and at the end wall 22. Similarly, Lower end guide plate 92 may be attached at either a portion of the side walls 25, 26 or at the end wall 21, or at both a portion of the side walls 25, 26 and at the end wall 21.

FIG. 8 also illustrates the use of additional guide plates—upper side guide plates 83 and 89 plus lower side guide plates 55 and 77. Upper side guide plates 83 and 89 are formed of panels or plates that extend horizontally from top end guide plate 81 to top end guide plate 40 along the edges of the exterior side walls of the outer shell. Lower side guide plates 55, 77 are formed of panels or plates that extend horizontally from lower end guide plate 41 to lower end guide plate 92 along the edges of the exterior side walls 25, 26 of the outer shell. Upper side guide plates 83, 89 and lower side guide plates 55, 77 provide strength and stability to the module. Upper side guide plates 83, 89 and lower side guide plates 55, 77 may be attached to the adjacent side walls 25, 26, or alternatively to the adjacent side walls 25, 26 and to lower end guide plates 41, 92, or alternatively to only the lower end guide plates 41, 92.

Furthermore, lower side guide plates 55, 77 plus lower end guide plates 41, 92 provide more surface area on the bottom of the module, thereby providing more containment for the filler material 109 and spreading the weight of the module. The dimensions of the lower guide plates can be chosen as desired to conform to the needs of the particular location and conditions where the module is to be placed. A wider lower guide plate will provide a greater outer shell surface area contacting the ground so that the downward movement of the module n00 can be adjusted based on the soil conditions.

The end guide plates 40, 41, 81, 92 can be formed of a solid plate (not shown), or, optionally, configured with at least one opening or conduit. FIG. 7 illustrates one conduit per end guide plate, and FIG. 8 illustrates two conduits per end guide plate, but more conduits can be utilized if desired for a particular application. The conduits are adapted to receive a rod-shaped anchor, referred to as piling 60. Piling 60 may be a displacement pile, non-displacement pile, cylinder pile, solid pile, piling, drilled shaft, stake, pipe, pole, or other type of post that is generally tapered or pointed at the lower end. The bottom of piling 60 penetrates the soil below the outer shell of the module n00 to a substantial depth, for the purpose of anchoring the module n00. Upper end guide plates 40, 81 can be configured with at least one opening or upper conduit 90, 93, respectively, adapted to receive piling 60. In a similar manner, bottom end guide plates 41, 92 can be configured with at least one opening or lower conduit 91, 94 respectively, adapted to receive piling 60. The upper conduits 90, 93 of top end guide plate 40 are in substantially vertical alignment with the lower conduits 91, 94 of bottom end guide plate 41, 92.

In a similar manner, top end guide plate 81 and bottom end guide plate 92 can be configured with at least one conduit 93, 94, respectively, an opening adapted to receive piling 60. FIG. 7 illustrates top end guide plates 40, 81 and bottom end guide plates 41, 92 each configured with a single pair of vertically aligned top and bottom conduits—90 aligned with 91 and 93 aligned with 94. FIG. 8 illustrates an optional configuration with top end guide plates 40, 81 and bottom end guide plates 41, 92 each configured with a double pair of vertically aligned top and bottom conduits (90, 91, 93, 94).

Optionally, one or more lower inner piling guides 67 or upper inner piling guides 74 can be included to guide the piling 60 through the conduits 90, 91, 93, or 94. The piling guides 67, 74 are generally in the shape of frustum, a truncated cone or truncated pyramid, made of a material corresponding to the material of the module n00 and attached at the conduits 90, 91, 93, or 94, as illustrated. The method of installation planned for the module n00 may be used to determine whether lower inner piling guides 67 or upper inner piling guides 74 will be required, the lower inner piling guide 67 facilitating the installation of a piling 60 from the top of module n00 or upper inner piling guide 74 facilitating the installation of a piling 60 from the bottom of module n00.

To install the modules n00 supported by pilings 60 at a desired underwater location, pilings 60 for one or more modules can be driven, hammered, or drilled to a suitable depth, which is generally the depth where friction and end bearing develop the required load-bearing capacity and depends on the soil and piling composition. The module n00 is lowered over the piling 60, with the piling 60 entering the module n00 by way of, for example, the conduit 91 of bottom end guide plate 41. As the module n00 is lowered farther, piling 60 enters and passes through the upper inner piling guide 74 and through conduit 90 of top end guide plate 40 to exit out the top of the module (The amount of piling 60 extending upward can be trimmed later, if required.) Conduit 93 can then serve as a template through which piling 60' (FIG. 7) can be driven to further secure the module.

Alternatively, the module can be placed in position and can be used as a template for the initial driving of the pilings 60, 60'. In this case, one of the pilings 60, 60' is driven through conduit 90 in top end guide plate 40 and on through the module to the vertically aligned conduit 91 in bottom end guide plate 41 and then the other piling 60, 60' is driven through conduit 93 in top end guide plate 81 and on through the module to the vertically aligned conduit 94 in bottom end guide plate 92. More than one conduit may be present in the guide plates, and additional guide plates may be present in the module, if needed for the particular application, as demonstrated in FIG. 8. When all the pilings 60, 60' have been driven to the required design penetration, the top of pilings 60, 60' can be trimmed, if desired (not show). For example it might be desirable to achieve a level top for the modules n00 for driving a vehicle on top of the levee. Optionally, after installation, piling 60, 60' can be welded to top end guide plates 40, 81. Adjacent modules n00, if desired, are installed in a similar way.

FIG. 8 also illustrates a module 201 configured in a bottom layer-type configuration. Bottom layer module 201 is configured with only lateral projections 43, 44. The typical lower projections 42, 45 shown in FIG. 7 are not included, so the bottom layer module 201 will rest more securely on the ground or soil; thus functioning as a base to allow further modules n00 to be added vertically.

Figure 9:
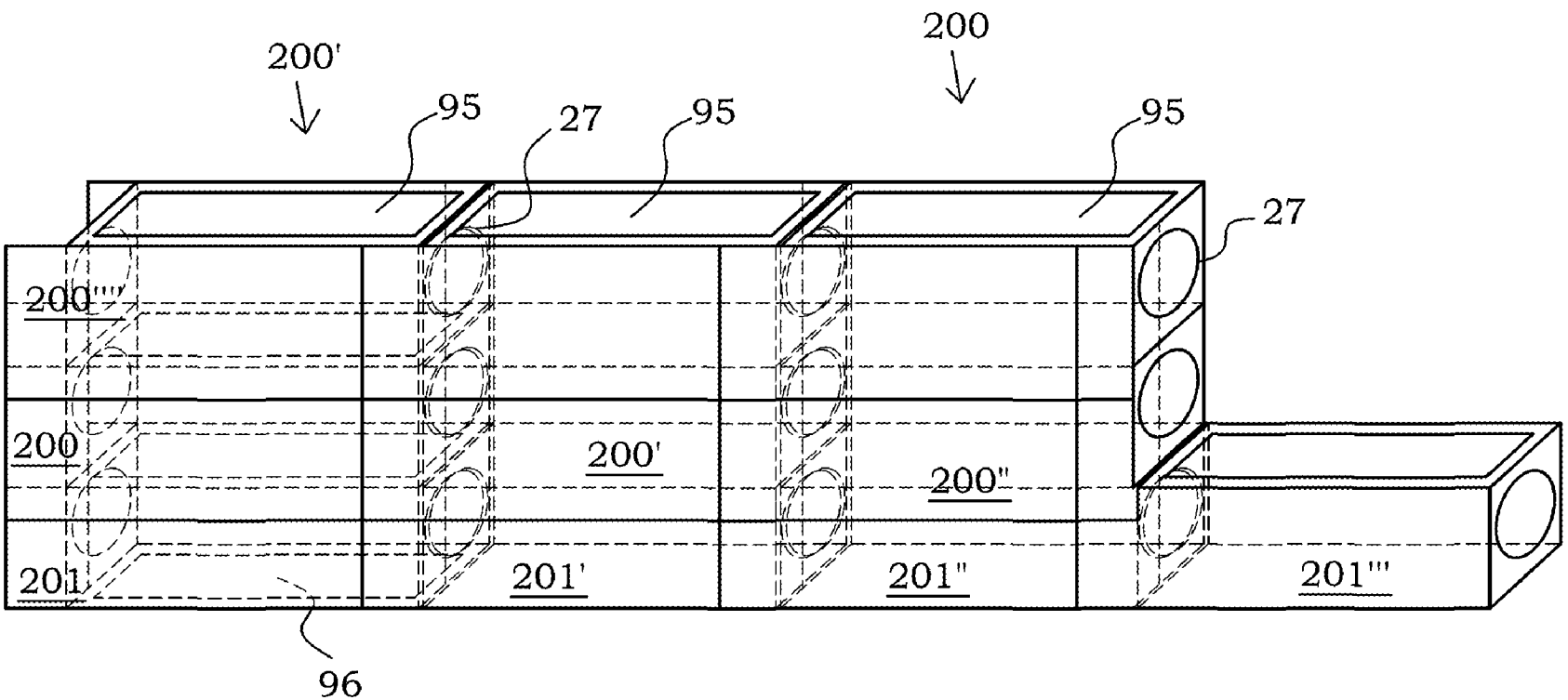
FIG. 9 is a perspective view showing a multiple module levee and barrier module system application that can be formed with any of the embodiments of the levee and barrier module and system of the present invention, which is illustrated with the second embodiment.

FIG. 9 demonstrates a system of application for the modules of the present invention, the ability to form a multiple adjacent levee and barrier module n00 system by adding modules both vertically and end-to-end horizontally until the desired height and length of the levee or barrier system is achieved.

As illustrated, a bottom layer module 201, having no lower projections 42, 45 is placed on the ground, above or below water, in the desired location for the start of a levee, barrier, or flood protection system. Additional bottom layer modules 201 are installed continuing to overlap the sides of each previous module 201, until the desired length of the levee is achieved, forming a layer of horizontally adjacent bottom layer modules 201. The second and all subsequent vertical rows then use the module 200 having lateral projections 43, 44 and lower projections 45, 42 as in FIG. 7. If desired the interior fastening mechanism 35 of the first embodiment can be additionally be used with the module-to-module connection system of the second embodiment (not shown). Thus the layer of horizontally adjacent modules with one or more layers of vertically adjacent modules form a levee of sufficient length and height.

Although this system of application of the present invention is illustrated with modules 200 of the second embodiment, all of the modules n00 of the embodiments of the present invention are capable of being connected similarly in multiple adjacent module n00 systems. After one or more modules n00 are placed in position on the ground or on a lower row, another module n00 can be positioned vertically over the previously placed module and lowered onto the previously placed module. Any of the connections systems of the four embodiments or parts of the module-to-module connection systems can serve to connect the newly placed module n00 to the previously placed module n00, or any combination of the module-to-module connection systems may be used.

After adding modules n00 until a designated length and height of the levee or barrier is achieved, filler material 109 (FIG. 19, FIG. 22) can be pumped, poured, dumped, airlifted, or otherwise placed into one or more of the top openings, top aperture 95, of the installed modules permitting a longitudinal flow of filler material 109 through the elongated tunnel formed through end apertures 27 of adjacent modules n00 as well as a downward flow of filler material 109 through bottom apertures 96. If modules n00 are installed in multiple vertical layers, this downward flow, aided by the weight of the filler material 109, can continue downward from an upper module n00 through any additional modules n00 below it. A portion of the filler material 109 can exit through bottom aperture 96 to seal any unevenness of the ground and to form a base for the module n00. If the levee or barrier is being constructed on uneven ground, the downward flow of filler material 109 will fill in any irregularities below the outer shell by forming a shoe or base 99, FIG. 19. Additionally, the downward flow of filler material 109 will continuously seal against seepage problems under the levee or barrier. By visual inspection of the top of the modules n00, the observed level of the filler material 109 gives an indication of the amount of filler material 109 involved in the downward flow. If the level of the filler material 109 in the top of the module n00 is observed to be dropping, more filler material 109 may be added.

Figure 21:
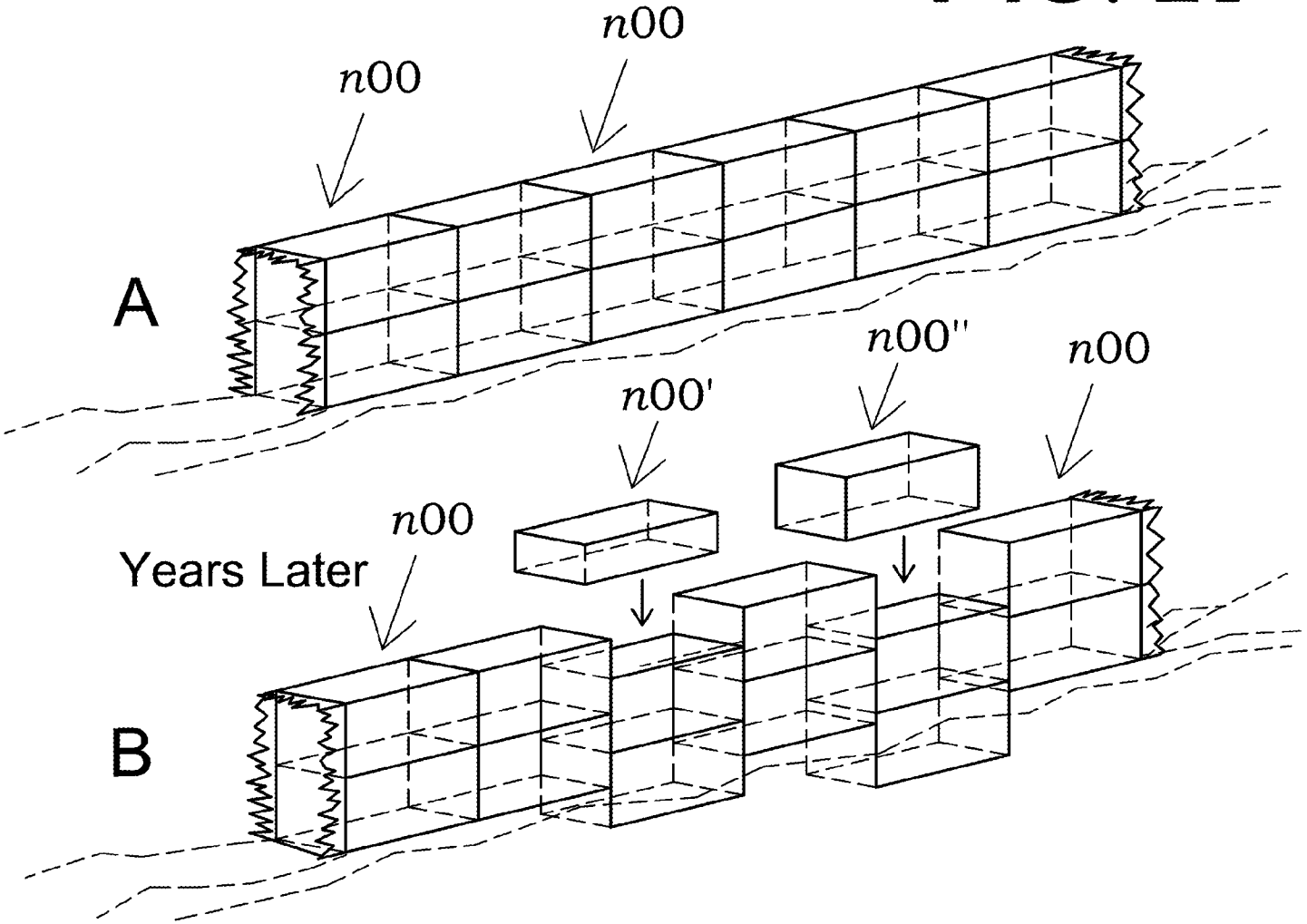
FIG. 21 is an elapsed time demonstration of an application of the multiple module levee and barrier module system that can be constructed with any of the embodiments of the levee and barrier module and system.

As illustrated in FIG. 21, depending on the soil characteristics below the modules, the outer shell of the module may settle, subside, or descend into the ground to a greater or lesser degree. If the outer shell of module n00 settles to a degree that the barrier or levee is not suitably high, another module n00 of the original size or of any desired size can be added above the module n00 that has descended into the ground, thus providing the height desired and optionally to level the top. Beneficially, the module n00 that has descended into the ground adds to the firmness of the foundation for the structure.

As time passes, there is a continual downward pressure of the filler material 109 that may cause it to exit the bottom of the module n00, adding to the shoe or base 99 (FIG. 19), at the foundation of the module n00. The opening in the top of the module n00, top aperture 95, allows for ease in adding filler material 109 if the level inside the module n00 becomes lower. Thus the present invention provides two types of possible interaction with the ground, filler material 109 can exit through bottom aperture 96 to seal any unevenness of the ground and to form a shoe or base 99 plus the outer shell of the module n00 may settle or descend into the ground to a greater or lesser degree.

Even before the levee, barrier, or flood protection system is completed, the installation of the modules n00 provides protection. For example, if the first horizontal row is installed, a limited amount of protection is obtained, even before the second vertical row is installed. A levee, barrier, or flood protection system can be partially constructed with a height that is lower than the final anticipated height, as finances allow. Then additional vertical rows can be installed at a later time, when more money is available or when there is a need to protect against a higher water level.

Additionally, the levee, barrier, or flood protection system, as constructed from modules n00 of the present invention, may be narrower than a traditional dirt levee, which is required to be wide at the bottom, thereby providing a benefit in locations where land is at a premium. Furthermore, whereas dirt levees are wider at the bottom and more narrow at the top and therefore are weakest at the top, the levee or barrier system, as constructed from modules n00 of the present invention, provides an improved degree of strength at the top of the levee, as the modules have a comparable width and strength at the top and at the bottom.

Figure 10:
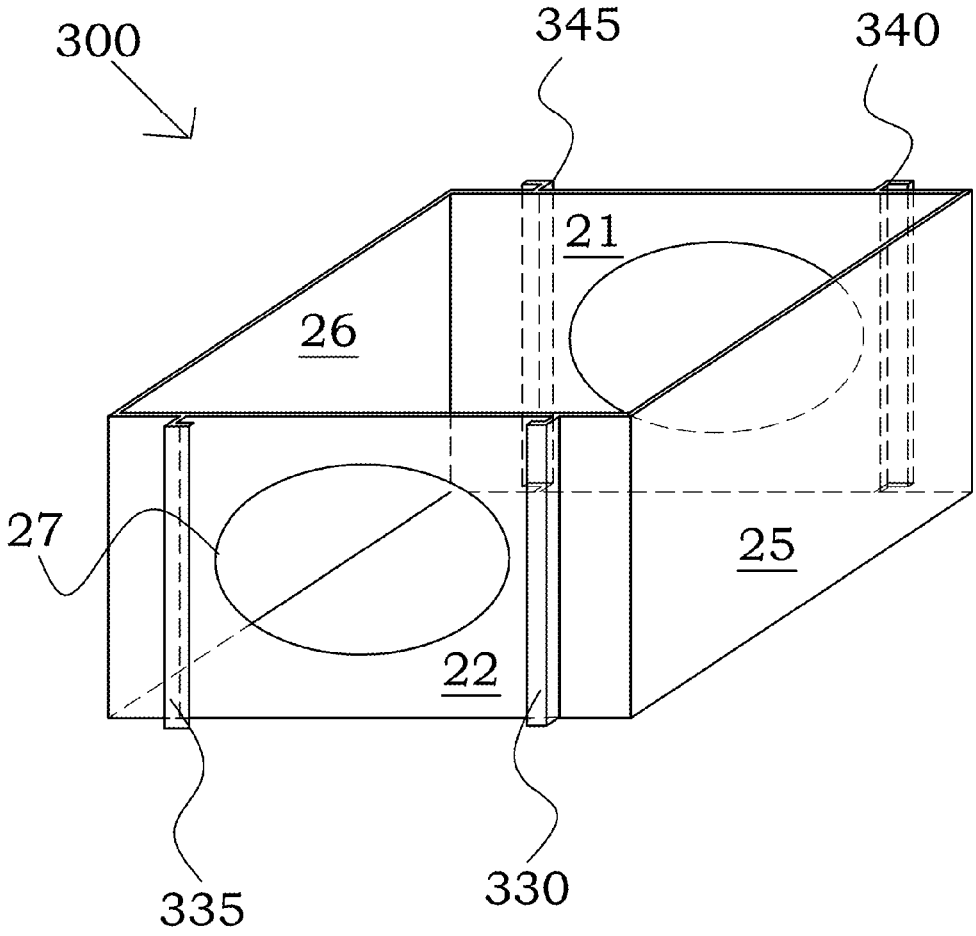
FIG. 10 is a perspective view showing a module and a module-to-module connection system of the third preferred embodiment of the levee and barrier module and system of the present invention.
Figure 11:
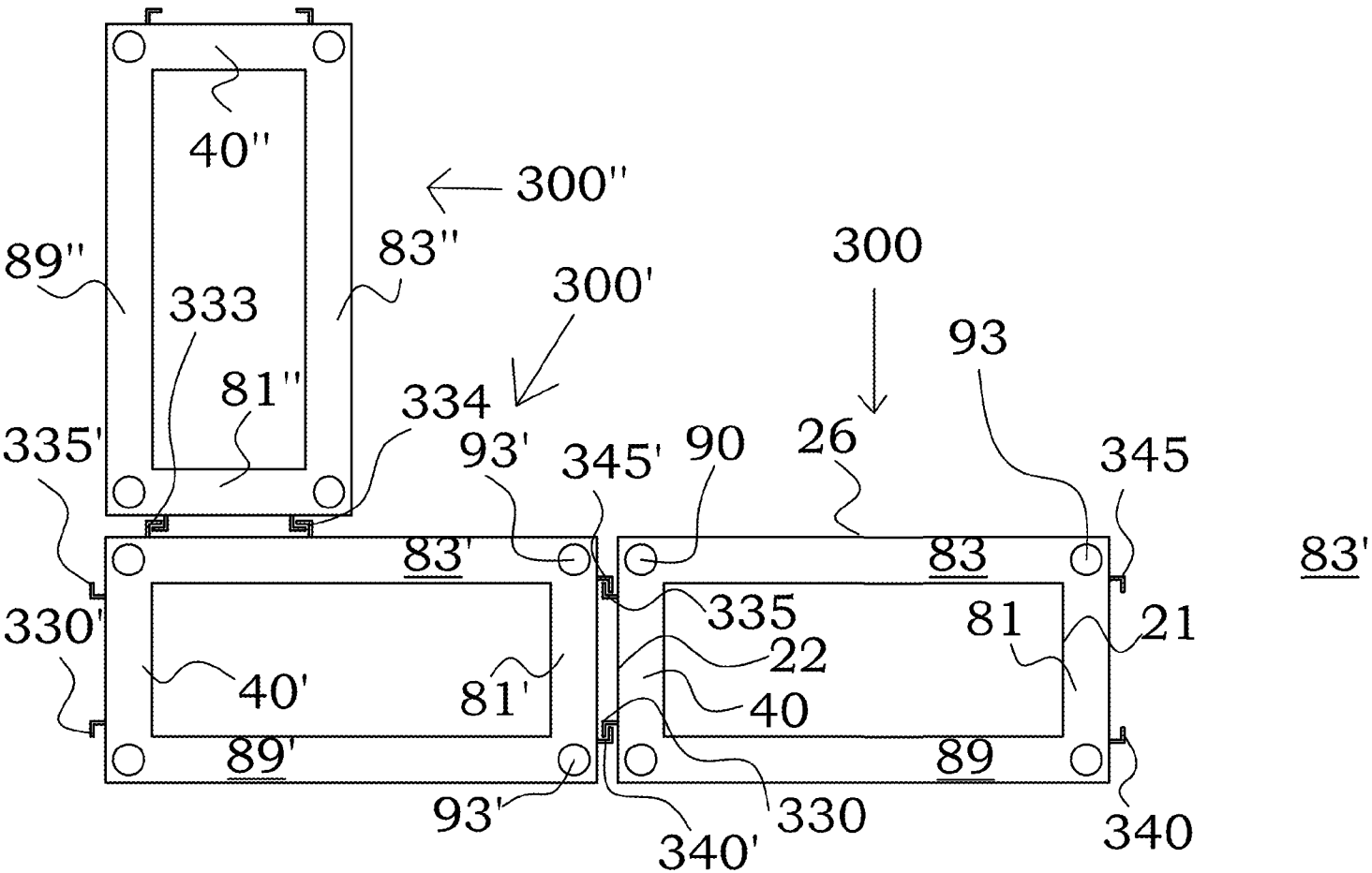
FIG. 11 is a top view showing the third preferred embodiment of the levee and barrier module and system of the present invention.

Referring now to FIG. 10 and FIG. 11, a levee and barrier module, shown generally as reference number 300, is illustrated in accordance with the third exemplary embodiment of the present invention. The levee and barrier module 300 includes the outer shell formed of side walls 25, 26 and end walls 21, 22, with the addition of complementary end flanges 330, 335, 340, 345. Substantially L-shaped complementary end flanges 330 and 335 are disposed on the exterior surface of end wall 22 and may be formed integrally with end wall 22 or may be attached by welding or other mechanical, adhesive, or further means. Complementary inward-facing end flanges 330 and 335 comprise two members to form the L shape, a substantially perpendicular member and a substantially parallel member, configured so that the parallel members are turned inward toward the center of the barrier module.

Similarly, substantially L-shaped complementary outward-facing end flanges 340 and 345 are disposed on the exterior surface of end wall 21 and may be formed integrally with end wall 22 or may be attached by mechanical, adhesive, or other means. Complementary outward-facing end flanges 340 and 345 comprise two members to form the L shape, a substantially perpendicular member and a substantially parallel member, configured so that the parallel members are turned outward away from the center of the barrier module, thus being complementary to the inward-facing end flanges 330 and 335. The complementary inward-facing end flanges 330 and 335 on the end of one module 300 interlock with complementary outward-facing end flanges 340' and 345' on the adjacent end of a contiguous module 300' (FIG. 11).

The top view of FIG. 11 illustrates not only the third module-to-module connection type, but also the additional feature of top end guide plates 40, 81 with conduits 90, 93 plus top side guide plates 83, 89 added to the basic module of the third embodiment of FIG. 10. The opposing bottom guide plates, not shown, are also provided.

FIG. 11 additionally illustrates the additional optional feature of a cornering module-to-module connection system. In constructing a levee, at times there is a need to construct a substantially 90-degree corner. Additional complementary flanges 334 and 333 can be installed on the side walls 25 or 26. Complementary flanges 334 and 333 can interconnect with flanges on a 90 degree offset module 300", to provide for a 90-degree angle corner.

Figure 12:
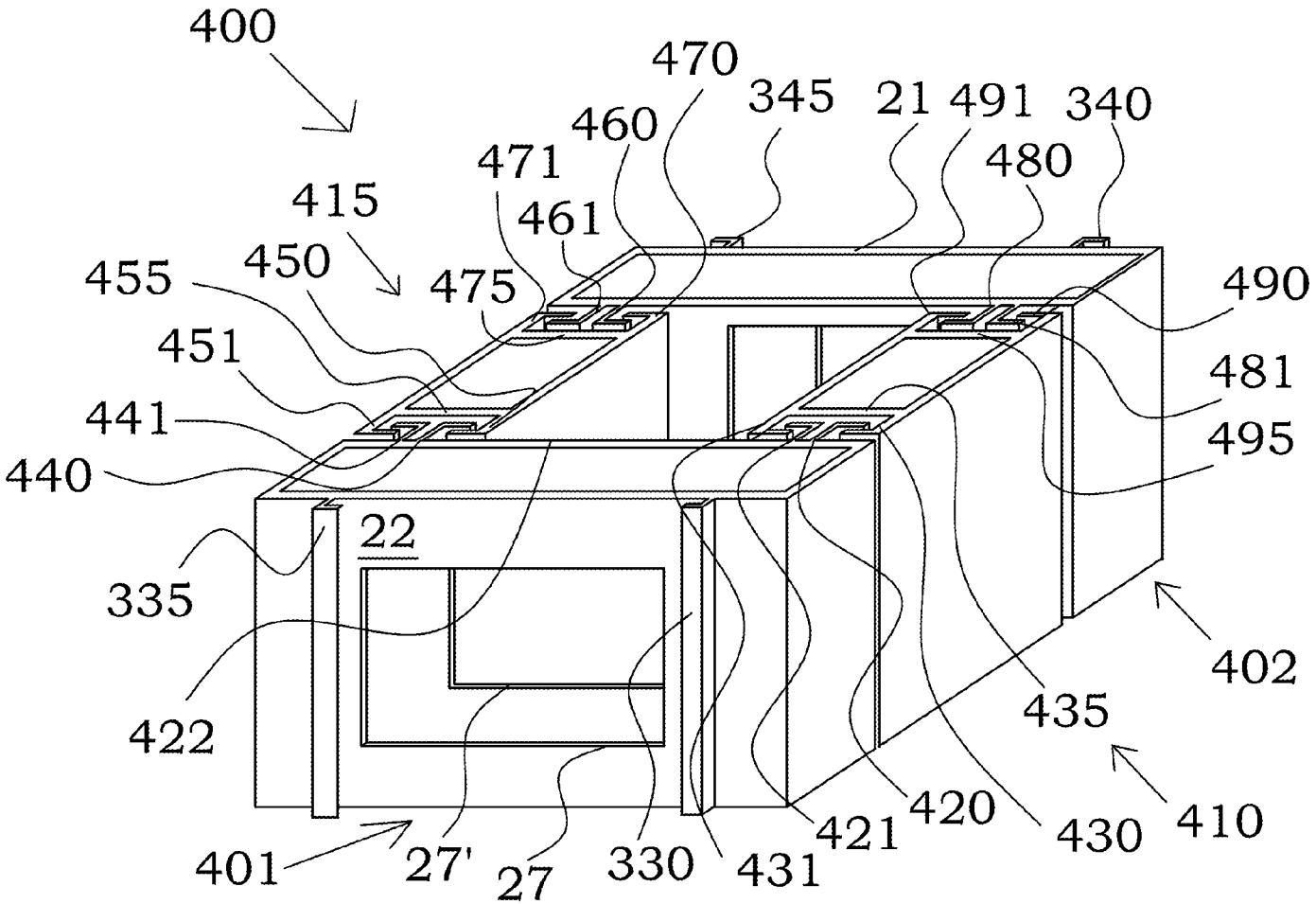
FIG. 12 is a perspective view showing the fourth embodiment of the levee and barrier module and system of the present invention.
Figure 13:
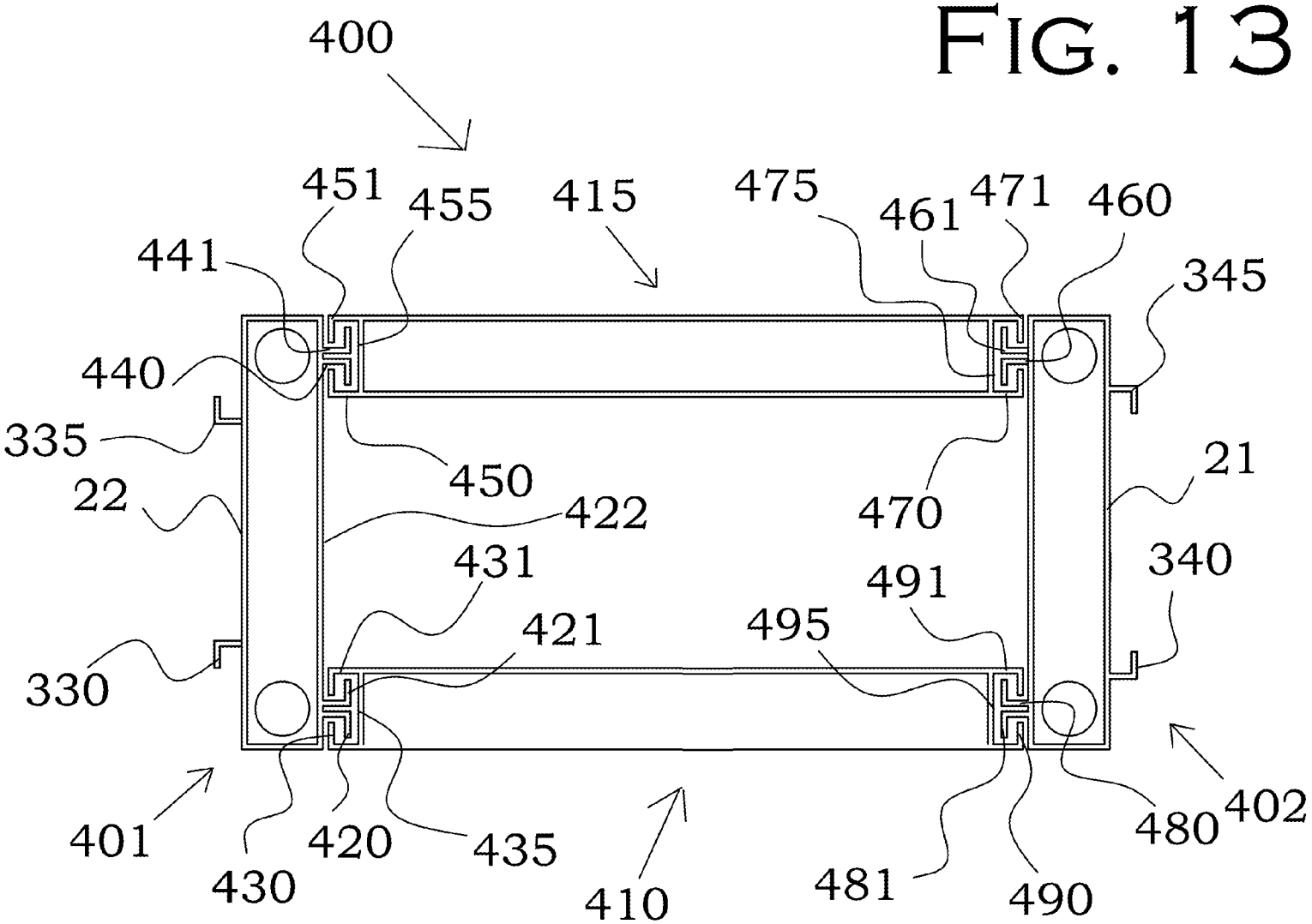
FIG. 13 is a top view showing the fourth embodiment of the levee and barrier module and system of the present invention.

Referring now to FIG. 12 and FIG. 13, a levee and barrier module, shown generally as reference number 400, is illustrated in accordance with the fourth embodiment of the present invention. The fourth embodiment provides a collapsible module 400 for more convenient storage and transport, as well as demonstrating that aperture 27 may take a variety of shapes. This embodiment is especially applicable to smaller modules such as might be used for bulkheads, flood prevention around homes, farm irrigation, temporary water control, and the like.

Collapsible module 400 includes 4 separate sections, an end section 401, an end section 402, side partition 410, and side partition 415. End section 401 has a box-like outer shell configured with exterior complementary end flanges 330 and 335 disposed on end wall 22, and configured with complementary inside end flanges 420, 421, 440, 441 disposed on interior end wall 422. In a similar manner, end section 402 has a box-like outer shell configured with exterior complementary end flanges 340 and 345 disposed on end wall 21, and configured with complementary inside end flanges 460, 461, 480, 481 disposed on interior end wall 422. Both outer shell of end section 401 and outer shell of end section 402 are configured with an aperture 27 to allow filler material communication horizontally between adjacent modules. Both aperture 27 and aperture 27' on the inner wall are rectangular shaped, but a variety of shapes is within the scope of the invention.

Side partition 410 has a box-like outer shell configured with complementary inside end flanges 430 and 431 disposed on interior side partition wall 435 and configured with complementary outward-facing inside end flanges 490 and 491 disposed on interior side partition wall 495. Side partition 415 has a box-like outer shell configured with complementary inside end flanges 450 and 451 disposed on interior side partition wall 455 and configured with complementary inside end flanges 470 and 471 disposed on interior side partition wall 475. The complementary inside end flanges 430, 431, 490, 491, 450, 451, 470, and 471 of side partitions 410 and 415 slidingly interconnect with complementary inside end flanges 420, 421, 440, 441, 460, 461, 480, and 481 of end sections 401 and 402, as shown in FIG. 12 and FIG. 13.

An additional system of application of the collapsible module of the fourth embodiment is the utilization of side partition 410 and side partition 415 to extend the levee and barrier module system over a pipeline. Partition 410 and side partition 415 can be configured to be somewhat reduced in height (not shown) to allow space for the pipeline to run under them. The reduction in height would be to a dimension determined by the pipeline structure that side partition 410 and side partition 415 will be passing over. Because side partition 410, and side partition 415 are smaller and lighter and move freely up and down, they would provide structure to the levee and barrier module system, but would not deform or damage the pipeline positioned under them. Additional support could be provided below the pipeline, as desired. Optionally, side partition 410 and side partition 415 can extend between two full size modules (such as the full size module illustrated in FIG. 11) instead of extending between the more reduced size end section 401 and end section 402, which is shown.

Figure 14:
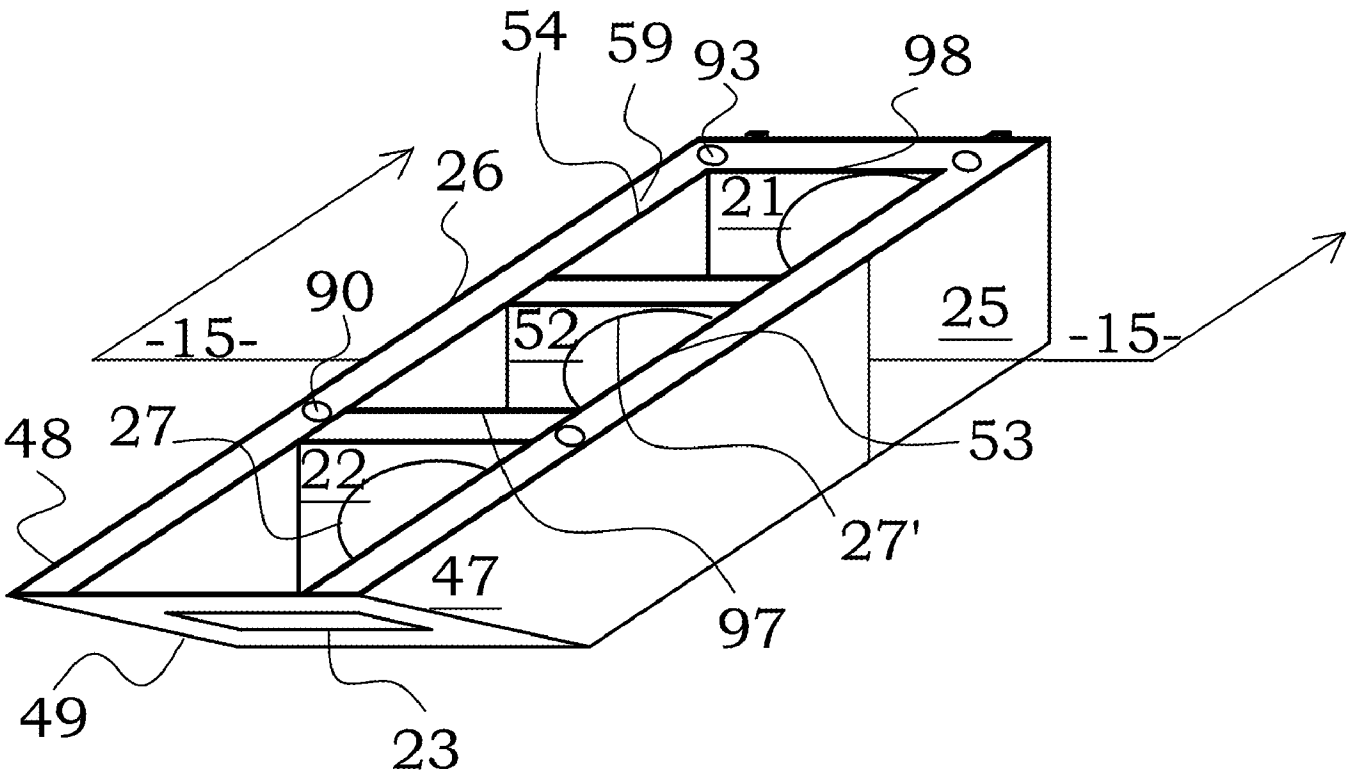
FIG. 14 is a perspective view showing additional features that can be applied to any of the embodiments of the levee and barrier module and system of the present invention.
Figure 15:
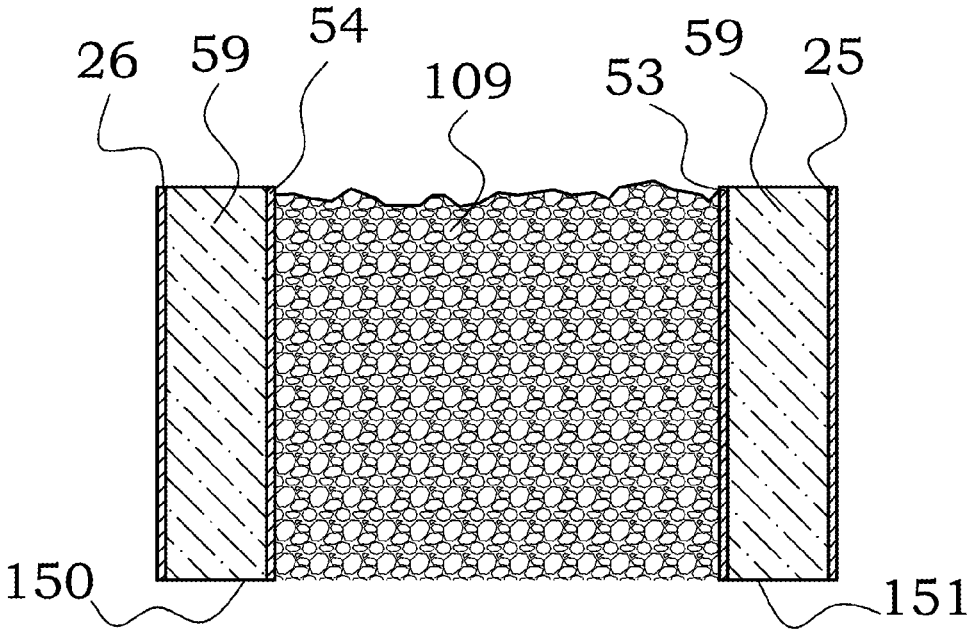
FIG. 15 is a cut-away side view taken along the line 15-15 of FIG. 14 showing additional features that can be applied to any of the embodiments of the levee and barrier module and system of the present invention.

Referring to FIG. 14, three optional features are shown, a wedge angle section, a cross member 52, and strengthened walls 25, 26, 21, 22. These features can be incorporated into any of the four embodiments of the present invention. A module incorporating a wedge angle section can be configured with or without conduits 90, 91, 93, and 94, and therefore, can be installed with or without pilings 60.

The wedge angle section is composed of two wedge angle sides 47, 48 and a wedge angle bottom 49. Wedge angle bottom 49 is attached to wedge angle side 47 and wedge angle side 48. Wedge angle bottom 49 may be a solid piece (not shown), or may have guide plates attached at the angle sides, forming an opening, wedge aperture 23, as illustrated. Wedge angle side 47 is a substantially vertical triangular projection being in the form of a right triangle with the base of the triangle attached to side wall 25 projecting out past the corner at side wall 25 and end wall 22. Wedge angle side 47 can be integrally formed with side wall 25 (as shown) or can be attached by mechanical, adhesive, or other means. Similarly, wedge angle side 48 is a substantially vertical triangular projection being in the form of a right triangle with the base of the triangle attached to side wall 26 projecting out past the corner at side wall 26 and end wall 22. Wedge angle side 48 can be integrally formed with side wall 26 (as shown) or can be attached by mechanical, adhesive, or other means. Although wedge angle side 47, 48 are illustrated as right triangles, they can optionally be of any desired shape to enable the invention to be used to conform to the shape of a transition area where the invention meets another type of levee construction, an embankment, to a previously installed dam or levee system, or other structures.

The strength of the module can be increased by adding a cross member 52 of similar size, design, and shape as end walls 21, 22. Cross member 52, for example, could be a steel plate welded in approximately the center of the module extending from approximately the midline of side wall 25 to approximately the midline of side wall 26. Cross member 52 has an aperture 27' of similar size and shape as the end aperture 27 of end walls 21, 22.

Side wall 25, side wall 26, end wall 21, and end wall 22 can be strengthened by constructing them with the addition of an interior wall 53, 54, 97, 98. Referring to the cutaway view of a strengthened wall in FIG. 15, for example, steel plate can be used to construct both side wall 26 and interior wall 54 which can be welded with a bottom planar piece 150 so that a space is defined between them. Steel plate can additionally be used to construct both side wall 25 and interior wall 53 which can be welded with a bottom planar piece 151 so that a space is defined between them. The spaces defined between side wall 26 and interior wall 54 and between side wall 25 and interior wall 53 can be optionally filled with a strengthening material 59 (for example, concrete, rocks, rubble, or other natural or synthetic material) for extra stability.

The addition of bottom planar pieces 150, 151 or of cross member 52 also serves to increase the surface area of the bottom of the module, thereby allowing for supplementary control of the amount of settling of the module by the adjustment of their dimensions during design of the module.

Figure 16:
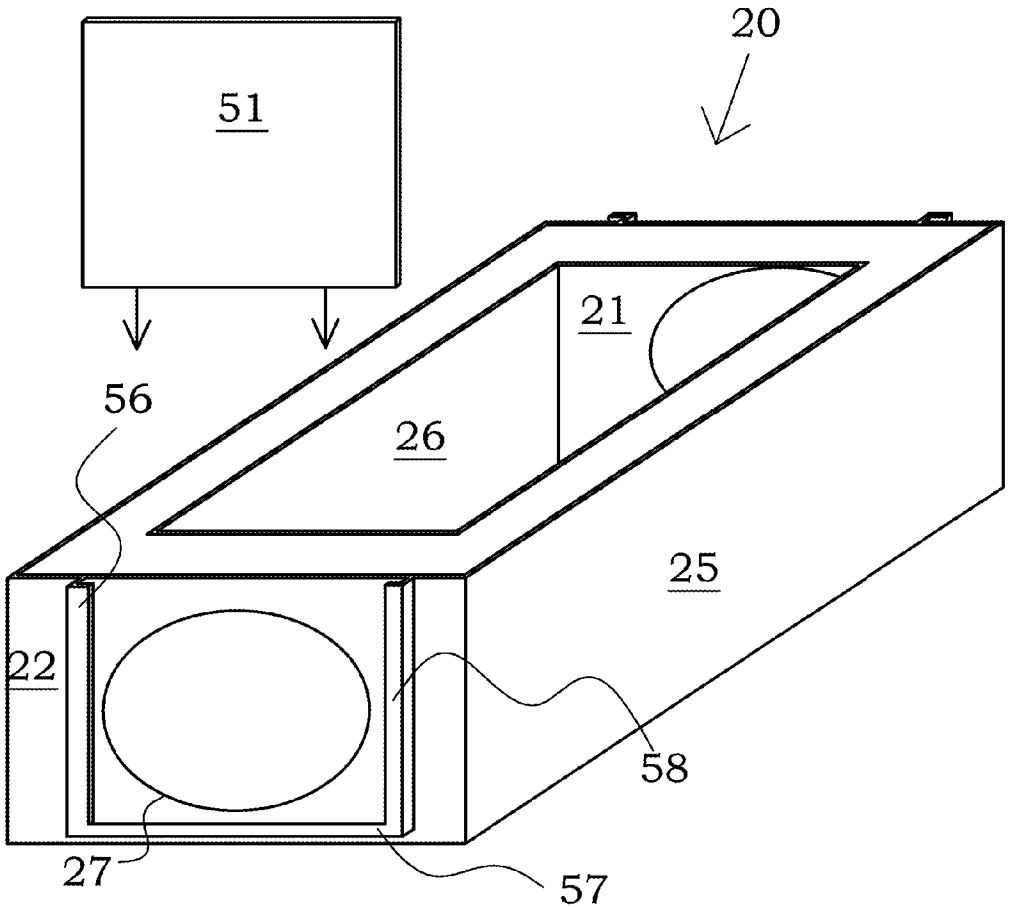
FIG. 16 is a perspective view showing additional features that can be applied to any of the embodiments of the levee and barrier module and system of the present invention.

Referring to FIG. 16, an optional feature is shown as a permanent or removable holding plate 51, which serves to cover or to cap the end aperture 27 in end wall 21, 22 thereby preventing filler material 109 from exiting end aperture 27, such as might be desired for maintenance, for repair, or for placement of the module near any transition area or other structure. L-shaped trough 56 and L-shaped trough 58 are attached vertically to end wall 22 between the end aperture 27 and the outside edges of end wall 22. L-shaped bottom trough 57 is welded horizontally to end wall 22 below aperture 27. L-shaped trough 56 and L-shaped trough 58 form a channel into which holding plate 51 can be inserted, with L-shaped bottom trough 57 preventing holding plate 51 from passing the bottom of end wall 22. A similar holding plate can be installed on any desired end wall. The same structure can also be installed inside the end wall thus having an inside holding plate for the same purpose of sealing the filler material 109 inside the module. The removable holding plate 51 can be used on modules with any combination of locking or connecting mechanisms of the embodiments of the present invention or on any of the shapes of modules provided.

Figure 17:
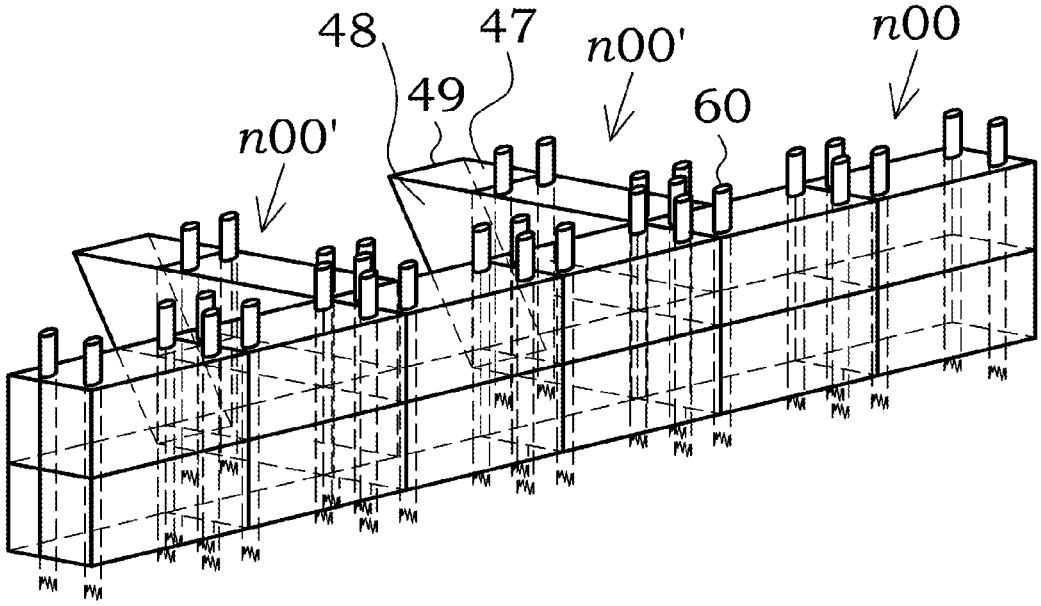
FIG. 17 is a perspective view showing a cofferdam-type application of the levee and barrier module and system of the present invention that can be constructed with any of the embodiments of the levee and barrier module and system.

FIG. 17 illustrates a cofferdam-type system of application of any of the modules n00 of the four embodiments of the present invention, whereby a breach in a levee can be repaired by the utilization of multiple modules n00 where two modules n00' incorporate wedge angle sides 47, 48 and wedge angle bottom 49 to conform to the shape of a previously installed breached levee or another location where water needs to be confined away from a structure. Pilings 60 are driven or installed, and then modules n00 are positioned on the pilings. One or more vertical rows of modules n00 can be used.

An additional system of application is to use modules n00, either individually or in short sections, around islands or shorelines to allow for both protection and land reclamation. The area of use would determine the spacing and pattern of the modules n00 installed, but, for example, they might be spaced in a baffle-type pattern to break up incoming surges and tides, as a breakwater, as jetties, or the like. Alternatively, modules n00 could be placed in two or more continuous or non-continuous rows or concentric rings around an island at a significant distance apart, such as one half to one mile apart, to provide protection from tidal surges and change the tidal placement of sand and debris, or to allow for importation of sand or soil to increase the level of the soil of the island.

Figure 18:
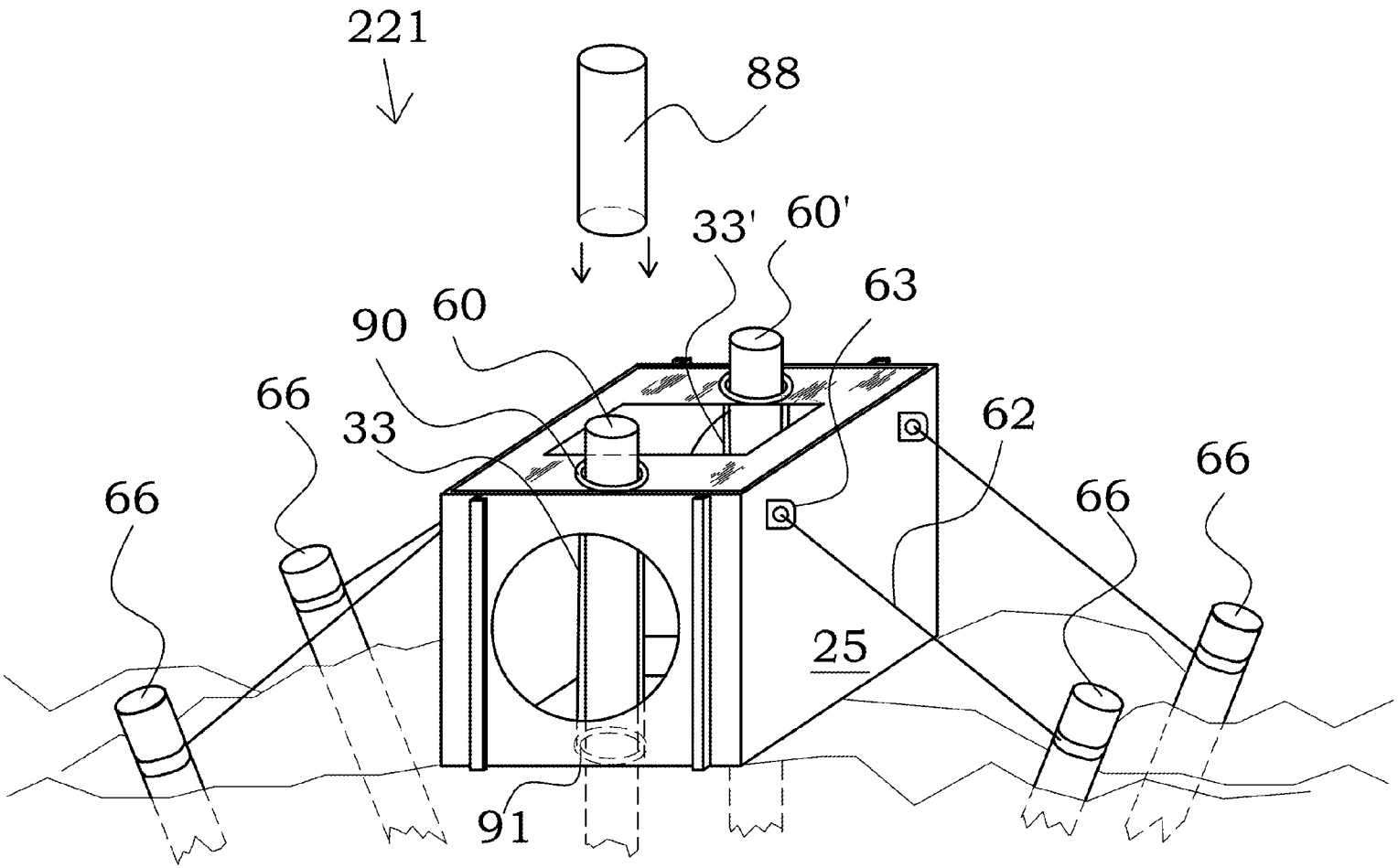
FIG. 18 is a perspective view showing additional features that can be applied to any of the embodiments of the levee and barrier module and system of the present invention, which are illustrated as applied to the third embodiment.

Referring to FIG. 18, three further features that may be applied to any of the embodiments of the invention are illustrated. One feature is a method of providing additional anchoring. A second optional feature is providing a sleeve to use with the invention. A third optional feature is an inner pipe sleeve to help guide stakes or pilings as they are driven or drilled into the ground below the levee and barrier modules n00.

Additional anchoring of modules n00 can be achieved by driving or drilling one or more rod-shaped anchors, illustrated as posts 66 (which can be, for example, pilings, displacement pilings, non-displacement pilings, cylinder pilings, solid pilings, pilings, drilled shafts, stakes, pipes, poles, or other type of post) into the ground and by attachment of the post 66 to the outer shell of the modules n00. Post 66 is driven or drilled to the depth required, which depends on the soil and post composition and dimensions. Post 66, having an end positioned penetrating the soil, is attached by wire, pipe, or cable 62 to the module of the present invention via a cable attachment mechanism, such as pad eye 63. Cable 62 extends outward and downward at an angle from pad eye 63 to post 66. Pad eye 63 is securely attached to the upper exterior surface of side wall 25. Pad eye 63 may also be used to facilitate lowering of the module into the water. Additional posts 66, connected in a similar fashion with similar cables to similar pad eyes, can be added as required.

Additionally, a sleeve 88 may be provided to extend piling 60, if needed. Sleeve 88 is configured and is sized appropriately to slide over the exposed top of piling 60, and can then be firmly attached, such as by welding or an adhesive, or left slidingly engaged. A second piling (not shown) can then be slid into the exposed top of sleeve 88, to extend the height of the anchoring piling 60, such as might be required to add height to a piling 60 or to vertically extend a previously constructed levee, such as when there is a need to add additional modules to achieve a greater height of protection.

Alternatively, sleeve 88 may be attached or welded to the top or to the bottom of a module without the use of a piling 60. This would enable the secure addition of a vertical module having guide plates configured to allow sleeve 88 to extend through the guide plates and into the interior of the vertically added module (not shown).

The third optional feature is an inner pipe sleeve 33, which is securely installed as a tube-like structure extending from the location of the upper conduit 90 in the guide plate to the lower conduit 91 in the guide plate. In a similar manner, other inner pipe sleeves 33' can be installed between other vertically aligned conduits. As the piling 60 or piling 60' enters the inner pipe sleeve from the top or from the bottom, the direction of piling 60 or piling 60' will be controlled, and piling 60 or piling 60' will be easily guided straight through the module, thereby facilitating installation of the levee and barrier modules.

FIG. 19 illustrates a multi-faceted levee and barrier system of the present invention that can be applied to any of the embodiments of the levee and barrier module n00 system of the present invention, but is shown with the module 300 of the third embodiment. A taller rearward levee 70 is formed of multiple modules, with modules vertically positioned above each other to achieve the necessary height and horizontally positioned end-to-end to achieve the necessary length. After installation, the modules n00 are filled with filler material 109.

The taller rearward levee 70 can be anchored by one or more posts 66 and associated cables 62, and can optionally be protected by a forward wedge 69 of fill material, such as mud, cement, sand, rocks, gravel, crushed rock, debris, plastic, rubble, or other like material. A rearward wedge 68 of similar fill material can be included, if desired. The fill material can be pumped, poured, dumped, airlifted, or otherwise placed at somewhat of an angle from the sides of the upper modules of the rearward levee 70 toward posts 66. The fill material can be of consistent composition or can be layered; for example, the levee may be armored by larger rocks positioned in a layer lower in wedges 68, 69 with smaller rock or dirt or other fill material in a higher layer. A levee or barrier module constructed as in any of the embodiments, functioning as a front wedge stabilizer 80, can optionally be placed forward of the rearward levee 70 and is preferably somewhat reduced in height as compared to the rearward levee 70. A module functioning as a back wedge stabilizer 82 can optionally be placed rearward of the rearward levee 70 and is preferably somewhat reduced in height as compared to the rearward levee 70.

A forward barrier 75 can optionally be added for additional protection. Forward barrier 75 is formed of multiple modules, horizontally positioned end-to-end to achieve the desired length of the forward barrier 75 and, if necessary but not shown, vertically positioned above each other to achieve the desired height. After installation, the modules n00 forming forward barrier 75 are filled with filler material 109. The height of forward barrier 75 can be somewhat reduced as compared to the rearward levee 70. The forward barrier 75 is anchored by multiple posts 71 and their associated cables 76, and can be armored or protected by a forward wedge 79 of fill material, such as mud, cement, sand, rocks, gravel, crushed rock, debris, plastic, rubble, or other like material. A rearward wedge 78 of similar fill material can be included, if desired. The fill material can be of layered or consistent composition.

Figure 20:
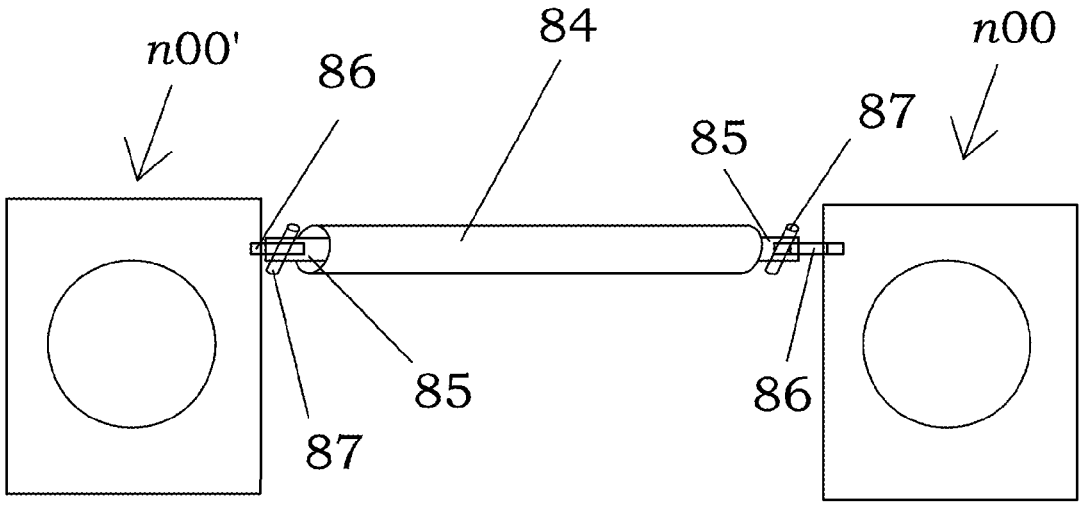
FIG. 20 is a perspective view showing additional features that can be applied to any of the embodiments of the levee and barrier module and system of the present invention.

FIG. 20 shows an optional stabilizer brace 84 for connecting two modules, when one module n00 is in a forward levee (such as in forward barrier 75 of FIG. 19) and one module n00 is in a rearward levee (such as in rearward levee 70 of FIG. 19). Stabilizer brace 84 is installed perpendicular to the longitudinal axis of the levee systems, thus two levee systems are anchored and stabilized together, providing greater strength. This stabilizer brace 84 can be constructed of a cylinder pile, solid pile, pipe, pole, post, timber, plastic, reinforced concrete, pre-stressed concrete, steel beam or other building material. Each end of stabilizer brace 84 is formed into a brace fitting 85 that attaches to a module fitting 86. An example of possible brace fittings 85 and module fittings 86 is shown, with a pin 87 connecting brace fitting 85 and module fitting 86, but other connections as are known in the art would be equivalent.

Another application system of the modules n00 of the present invention is shown in FIG. 21. Row A shows the modules n00 immediately after installation. Row B shows the same modules n00 after some time has passed. Some sinking may occur, as illustrated in Row B, but the modules n00 that sink add to the stability of the base, and new modules n00' and modules n00" can be added to bring the levee top back to the desired level. As illustrated, a variety of heights of modules n00' and modules n00" are provided. The required height of the of modules n00' and modules n00" to be provided is determined by measuring the amount of any downward movement of any module n00.

The modules of the following nine exemplary embodiments demonstrate variations in the outer shell design of side walls 25, 26 and of end walls 21, 22. Also demonstrated is the ability to use more than one type of module n00 in series, to create a particular aesthetic look, to avoid a particular human or physical structure, or to obtain another desirable functional result. These modules are configured and operate in a similar manner to the flood levee and barrier modules of embodiments one to four, with the variations in the outer shell shape particularly described below.

These modules are illustrated using the connectors of the third embodiment to join adjacent modules, but any of the connectors of the first four embodiments are within the scope of the invention. As in the first four embodiments, these modules comprise opposing substantially vertical end walls 21, 22 each having an end aperture 27 to allow, when modules are abutted together and placed end to end, the contiguous end apertures 27 of adjacent modules to form an elongated tunnel that is continuous through adjacent modules, thereby permitting a longitudinal flow of the filler material 109.

The modules of the following nine exemplary embodiments comprise side walls 25, 26, n25, n26, n25', and n26' (where n represents the embodiment number), functioning similarly to the side walls 25, 26 of the first four embodiments, which serve as a forward or rearward walls of the barrier or levee system, extending longitudinally in the direction of the length of the levee or barrier.

The provided variations in the modules of the following nine embodiments may increase the strength and stability of the modules, as well as serving to provide turbulence and to break up and to lower the energy of the fluid flow, as in, for instance, a storm surge. The irregular module side walls cause an increase in vortices and swirling which decreases the energy of the fluid. Additionally, in some flood levee and barrier sites, especially in more populated areas, there may be a desire for a more aesthetically appealing public-facing side wall, which these variations in the outer shell design of side walls 25, 26 and of end walls 21, 22 can fulfill.

In any of the following nine exemplary embodiments, additional longitudinal bracing walls designated n50, n51, n52 (where n represents the embodiment number) extending from end wall 21 to end wall 22, may be included if the module size and the location of the levee or barrier warrants its inclusion. Longitudinal bracing walls n50, n51, n52 run parallel to the longitudinal axis of a levee. Bracing walls n50, n51, n52 are configured similarly to the side walls 25 and 26.

Furthermore, in any of the following nine embodiments, additional perpendicular bracing walls designated n 60, n61, n62 (where n represents the embodiment number) extending from the side wall 25 area to the side wall 26 area, may be included if the module size and the location of the levee or barrier warrants its inclusion. Perpendicular bracing walls n50, n51, n52 run perpendicular to the longitudinal axis of a levee. Bracing walls n60, n61, n62 are configured similarly to end walls 21, 22 with an aperture 27 to permit a longitudinal flow of the filler material 109. A variety of illustrative additional configurations of bracing walls n50, n51, n52, n60, n61, n62 are provided.

Figure 22:
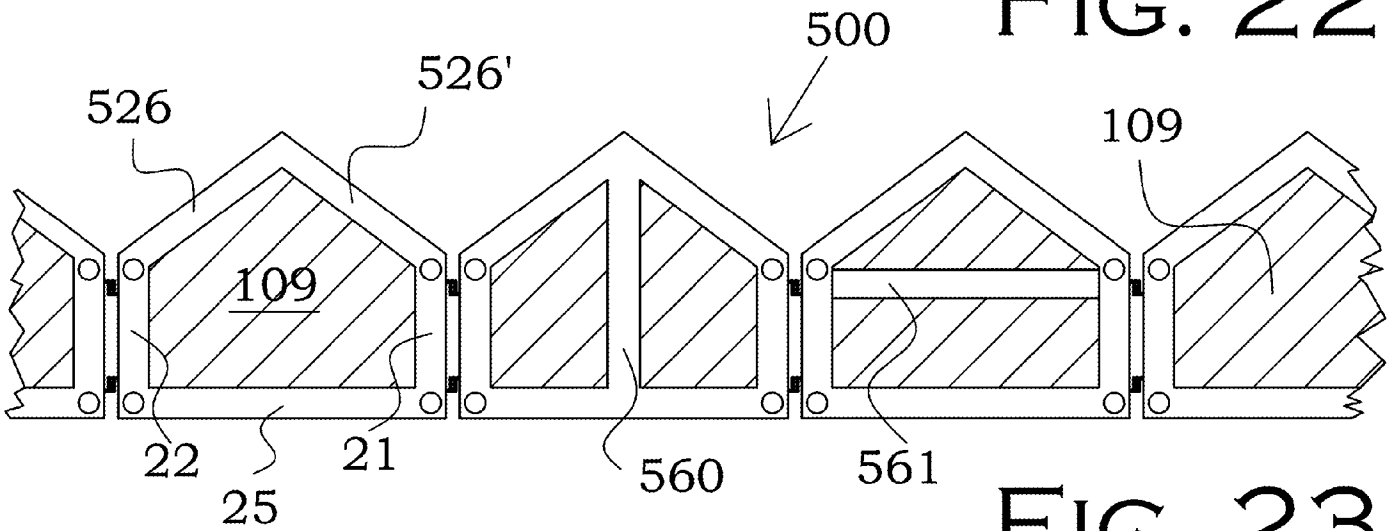
FIG. 22 is a top view showing a fifth embodiment of the present invention.

FIG. 22 illustrates a top view of a fifth exemplary embodiment of the flood levee and barrier module of the present invention, wherein the module of this embodiment is generally referred to by the reference numeral 500. The module 500 varies from modules of the other embodiments of the flood levee and barrier protection in the angled sectional side walls 526 and 526'. The side walls 526 and 526' form an interior angle greater than 90 degrees with end walls 22 and 21, respectively, as illustrated. Additional perpendicular bracing walls 560 may optionally be included if desired.

Figure 23:
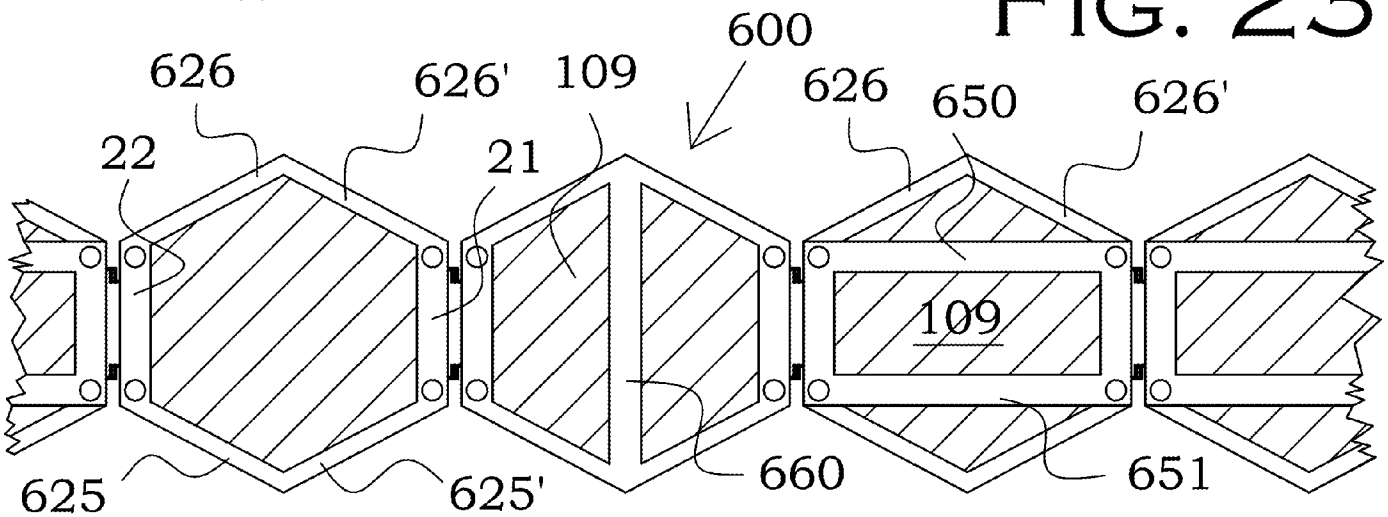
FIG. 23 is a top view showing a sixth embodiment of the present invention.

FIG. 23 illustrates a top view of a sixth exemplary embodiment of the flood levee and barrier module of the present invention, wherein the module of this embodiment is generally referred to by the reference numeral 600. The module 600 varies from modules of the other embodiments of the flood levee and barrier protection in the angled sectional side walls 625, 625', 626, and 626'. The side walls 625, 625', 626, and 626' form an interior angle greater than 90 degrees with end walls 22 and 21, as illustrated. Additional bracing walls 650, 651, and 660 may optionally be included if desired.

Figure 24:
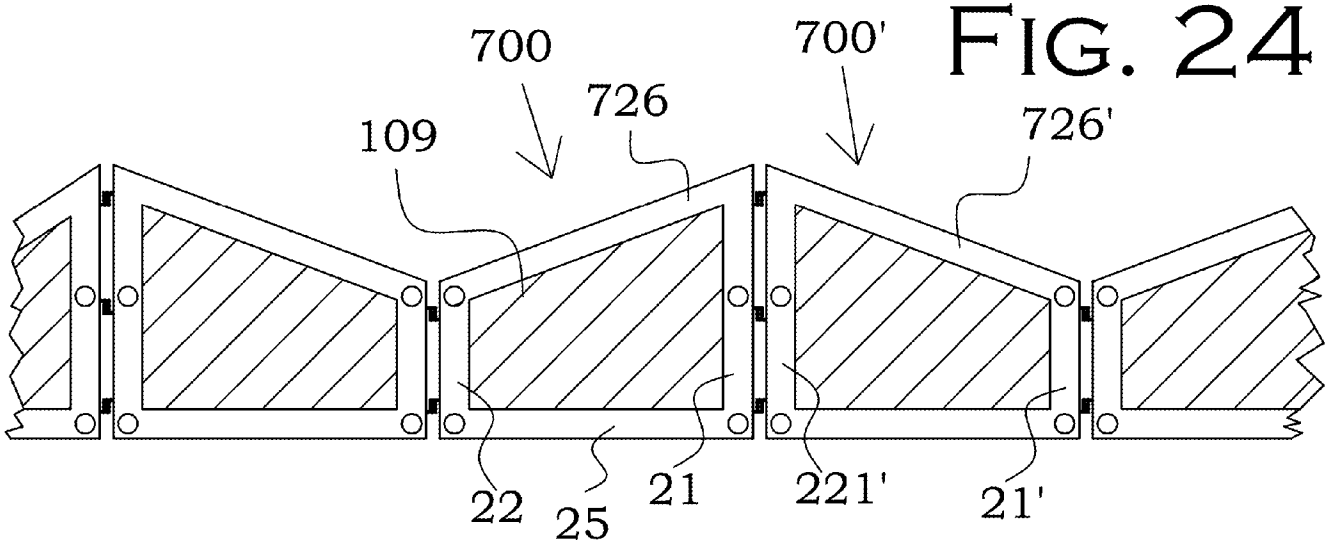
FIG. 24 is a top view showing a seventh embodiment of the present invention.

FIG. 24 illustrates a top view of a seventh exemplary embodiment of the flood levee and barrier module of the present invention, wherein the module of this embodiment is generally referred to by the reference numeral 700. The module 700 varies from modules of the other embodiments of the flood levee and barrier protection in the angle of side wall 726. Two types of similar modules are provided. In the first type, module 700, the side wall 726, instead of forming a 90-degree angle with end walls 21, 22 as in the first four embodiments, forms an interior angle greater than 90 degrees with end wall 22 and an angle less than 90 degrees with end wall 21, as illustrated. In the second type, module 700', the side wall 726', forms an angle less than 90 degrees with end wall 22' and an interior angle greater than 90 degrees with end wall 21', as illustrated. Additional bracing walls 750 may optionally be included if desired.

Figure 25:
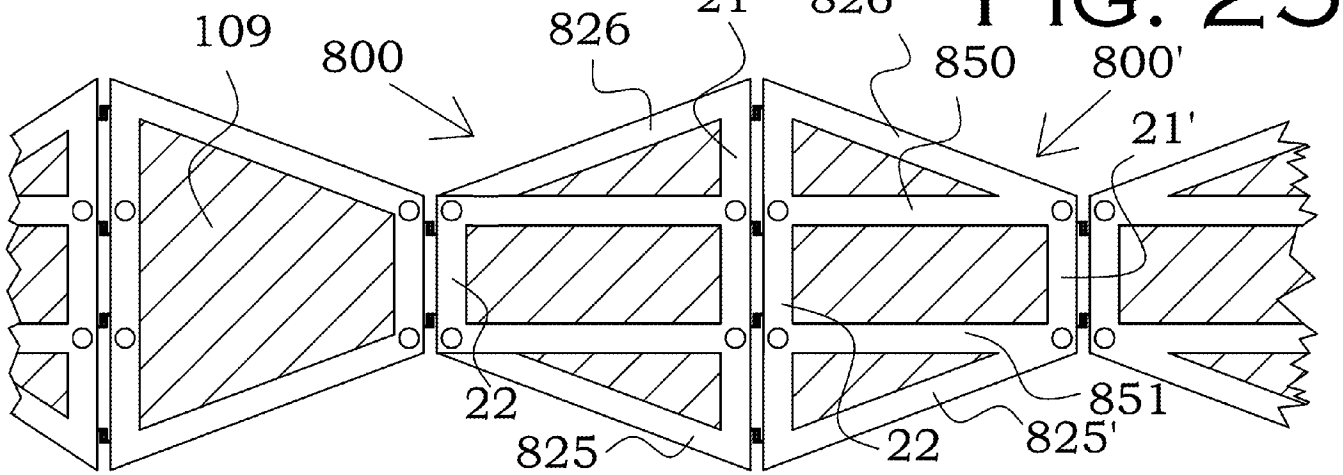
FIG. 25 is a top view showing a eighth embodiment of the present invention.

FIG. 25 illustrates a top view of a eighth exemplary embodiment of the flood levee and barrier module of the present invention, wherein the module of this embodiment is generally referred to by the reference numeral 800. The module 800 varies from modules of the other embodiments of the flood levee and barrier protection in the angle of side walls 826, 826', 825, and 825'. Two types of similar modules are provided. In the first type, module 800, the side wall 826 forms an interior angle greater than 90 degrees with end wall 22 and an angle less than 90 degrees with end wall 21, as illustrated. Also, the side wall 825 forms an interior angle greater than 90 degrees with end wall 22 and an angle less than 90 degrees with end wall 21, as illustrated. In the second type, module 800', the side wall 826', instead of forming a 90-degree angle with end wall 21', forms an angle less than 90 degrees with end wall 22' and an interior angle greater than 90 degrees with end wall 21', as illustrated. Also, the side wall 825' forms an angle less than 90 degrees with end wall 22' and an interior angle greater than 90 degrees with end wall 21', as illustrated. Additional bracing walls 850, 851 may optionally be included if desired.

Figure 26:
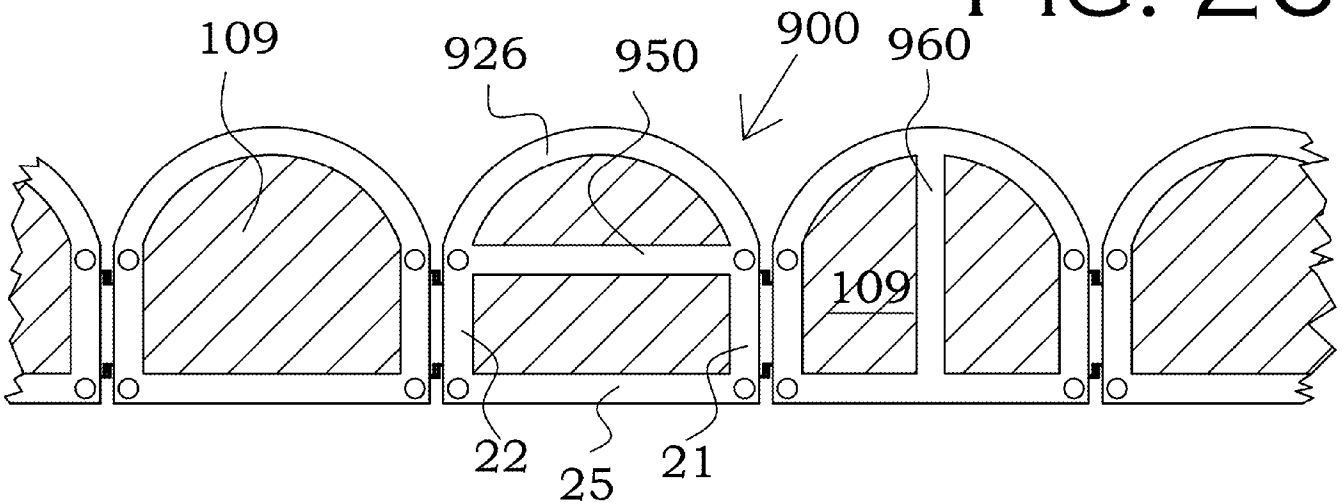
FIG. 26 is a top view showing a ninth embodiment of the present invention.

FIG. 26 illustrates a top view of a ninth exemplary embodiment of the flood levee and barrier module of the present invention, wherein the module of this embodiment is generally referred to by the reference numeral 900. The module 900 varies from modules of the other embodiments of the flood levee and barrier protection in the variation of side wall 926, which demonstrates a curvilinear variation in the shape of the barrier module. Arc-shaped side wall 926 may be more or less sharply curved, as desired. Additional bracing walls, such as 950 and/or 960 may be included if the module size and the location of application warrants inclusion.

Figure 27:
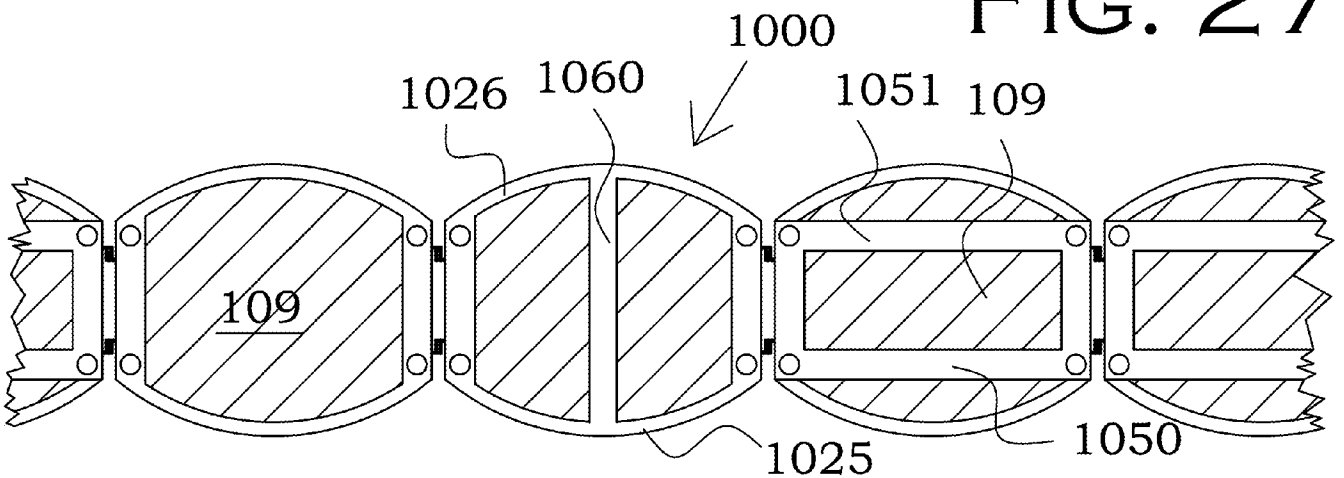
FIG. 27 is a top view showing a tenth embodiment of the present invention.

FIG. 27 illustrates a top view of a tenth exemplary embodiment of the flood levee and barrier module of the present invention, wherein the module of this embodiment is generally referred to by the reference numeral 1000. The module 1000 varies from modules of the other embodiments of the flood levee and barrier protection in the variation of side wall 1026 and side wall 1025, which demonstrate a curvilinear variation in shape of the module. Arc-shaped side wall 1026 and side wall 1025 may be more or less sharply curved, as desired. Additional bracing walls, such as 1050, 1051, and/or 1060 may be included if the module size and the location of application warrants inclusion.

Figure 28:
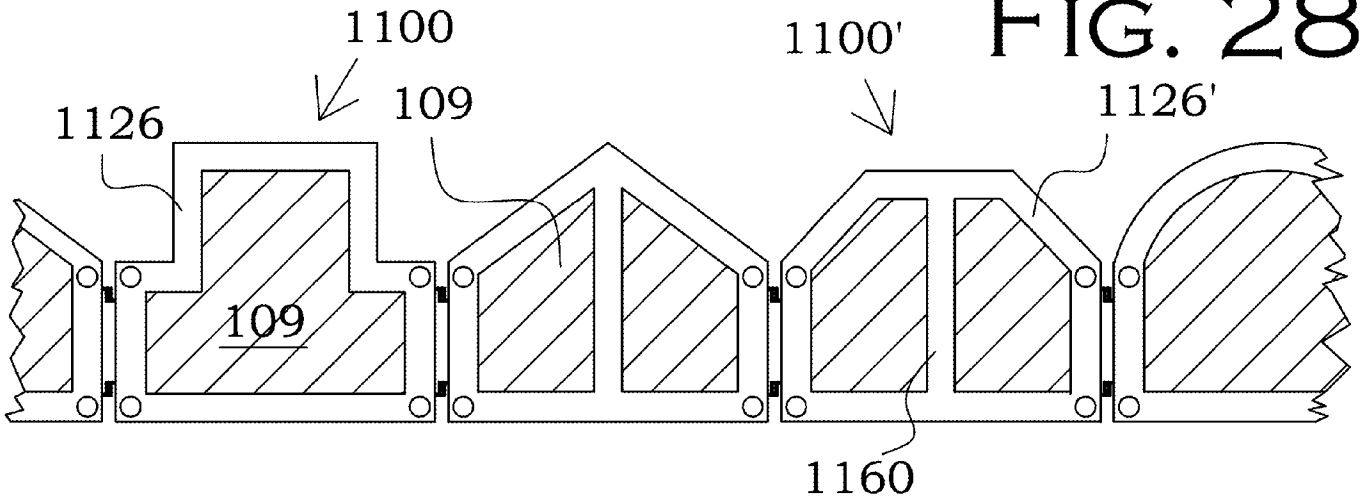
FIG. 28 is a top view showing a eleventh embodiment of the present invention.

FIG. 28 illustrates a top view of a eleventh exemplary embodiment of the flood levee and barrier module of the present invention, wherein the module of this embodiment is generally referred to by the reference numeral 1100. The module 1100 varies from modules of the other embodiments of the flood levee and barrier protection in the variation of multi-angled side walls 1126 and 1126', each of which comprise at least three segments. In module 1100, side wall 1126 comprises 5 segments, while in module 1100' side wall 1126' comprises 3 segments. The particular angles of the segments of side wall 1126 can vary as needed for the location of application of the barrier and levee system. Additional bracing walls, such as 1160 may optionally be included.

Figure 29:
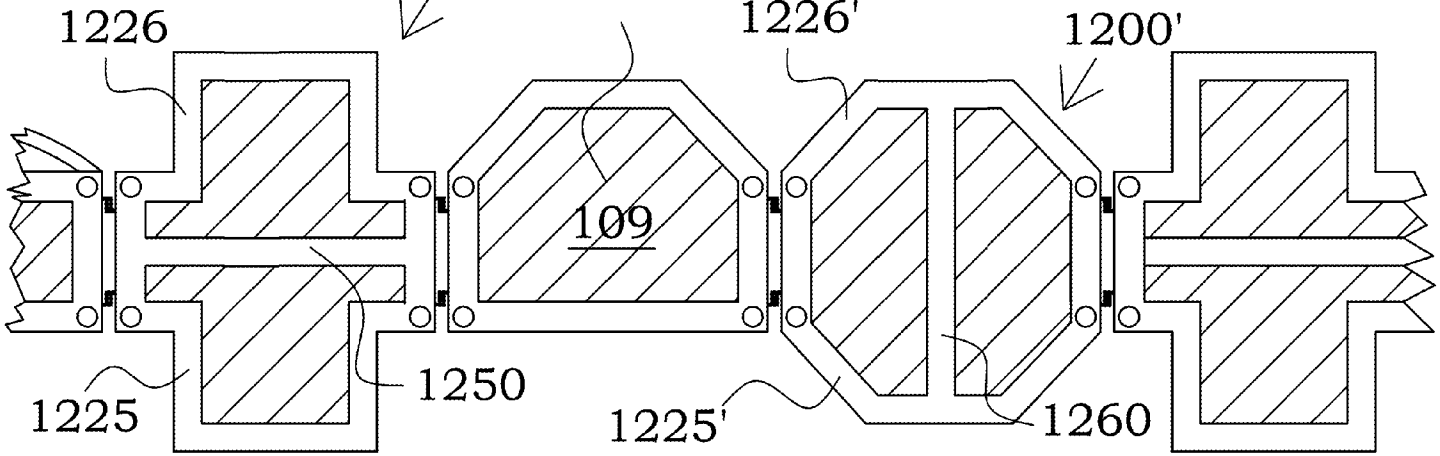
FIG. 29 is a top view showing a twelfth embodiment of the present invention.

FIG. 29 illustrates a top view of a twelfth exemplary embodiment of the flood levee and barrier module of the present invention, wherein the module of this embodiment is generally referred to by the reference numeral 1200. The module 1200 varies from modules of the other embodiments of the flood levee and barrier protection in the variation of multi-angled side walls 1226 and 1225, each of which comprise at least three segments. In module 1200, side wall 1226 and 1225 each comprise 5 segments, while in module 1200' side wall 1226' and 1225' each comprise 3 segments. The particular angles of the segments of side wall 1226, 1226' can vary as needed for the location of application of the barrier and levee system. Additional bracing walls, such as 1250 and 1260 may optionally be included. Other additional configurations of bracing walls can be provided.

FIG. 28 and FIG. 29 also illustrate the provision to use multiple module shapes in series for a variation in the levee module composition to achieve the functional or aesthetic requirements of the application of the flood levee and barrier module of the present invention.

Figure 30:
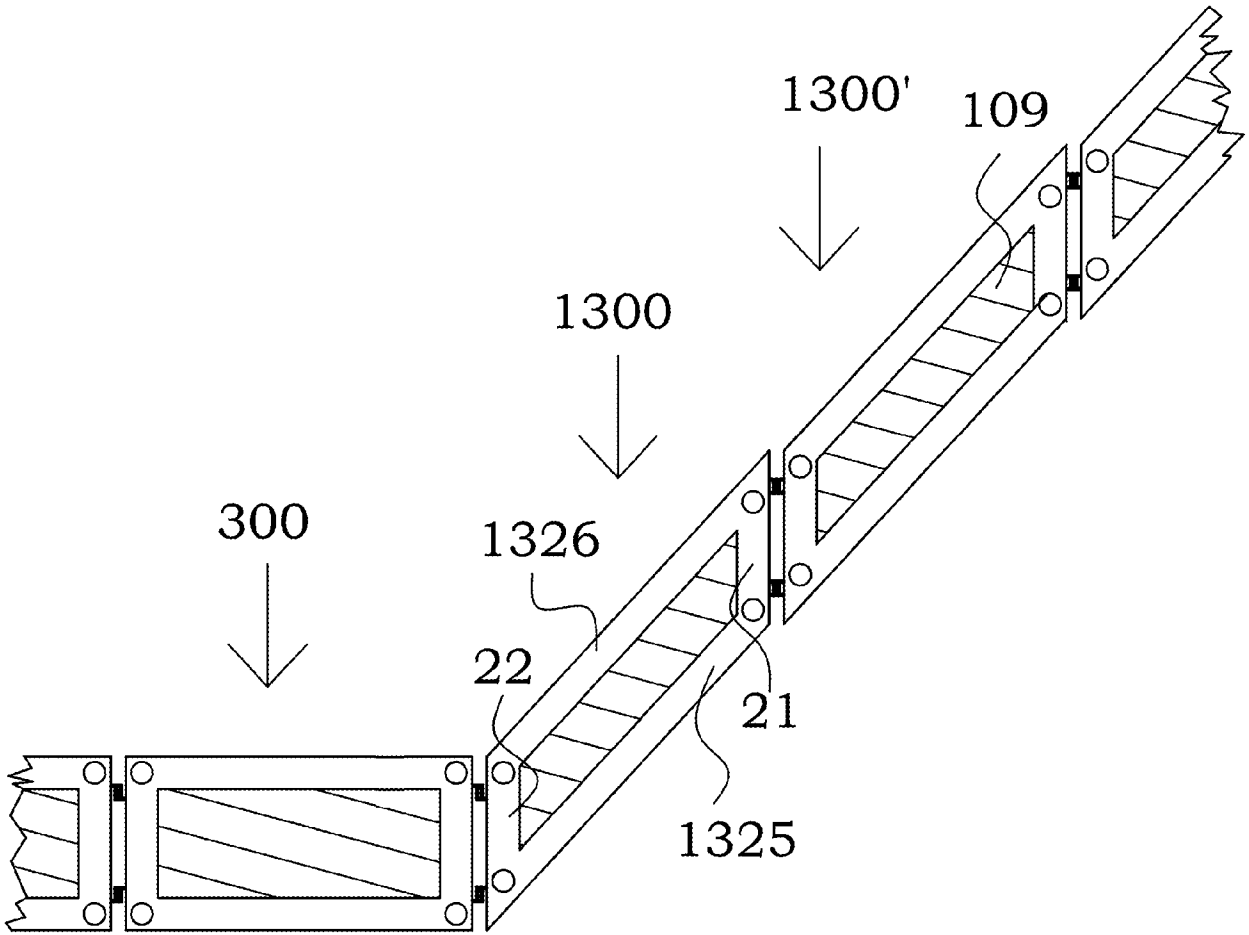
FIG. 30 is a top view showing a thirteenth embodiment of the present invention.

FIG. 30 illustrates a top view of a thirteenth exemplary embodiment of the flood levee and barrier module of the present invention, wherein the module of this embodiment is generally referred to by the reference numeral 1300. The module 1300 varies from modules of the other embodiments of the flood levee and barrier protection in the variation of angled side walls 1326 and 1325. The side wall 1326 forms an interior angle greater than 90 degrees with end wall 22 and an angle less than 90 degrees with end wall 21, as illustrated. Also, the side wall 1325 forms an angle less than 90 degrees with end wall 22 and an interior angle greater than 90 degrees with end wall 21, as illustrated. This thirteenth embodiment would be advantageous when the direction of the levee or barrier needed to change. For example, if the levee must be constructed around a deeper area of water or around a geological or human structure, the levee may require a straight segment of modules 300 to adjoin an angled segment of modules 1300.

Figure 31:
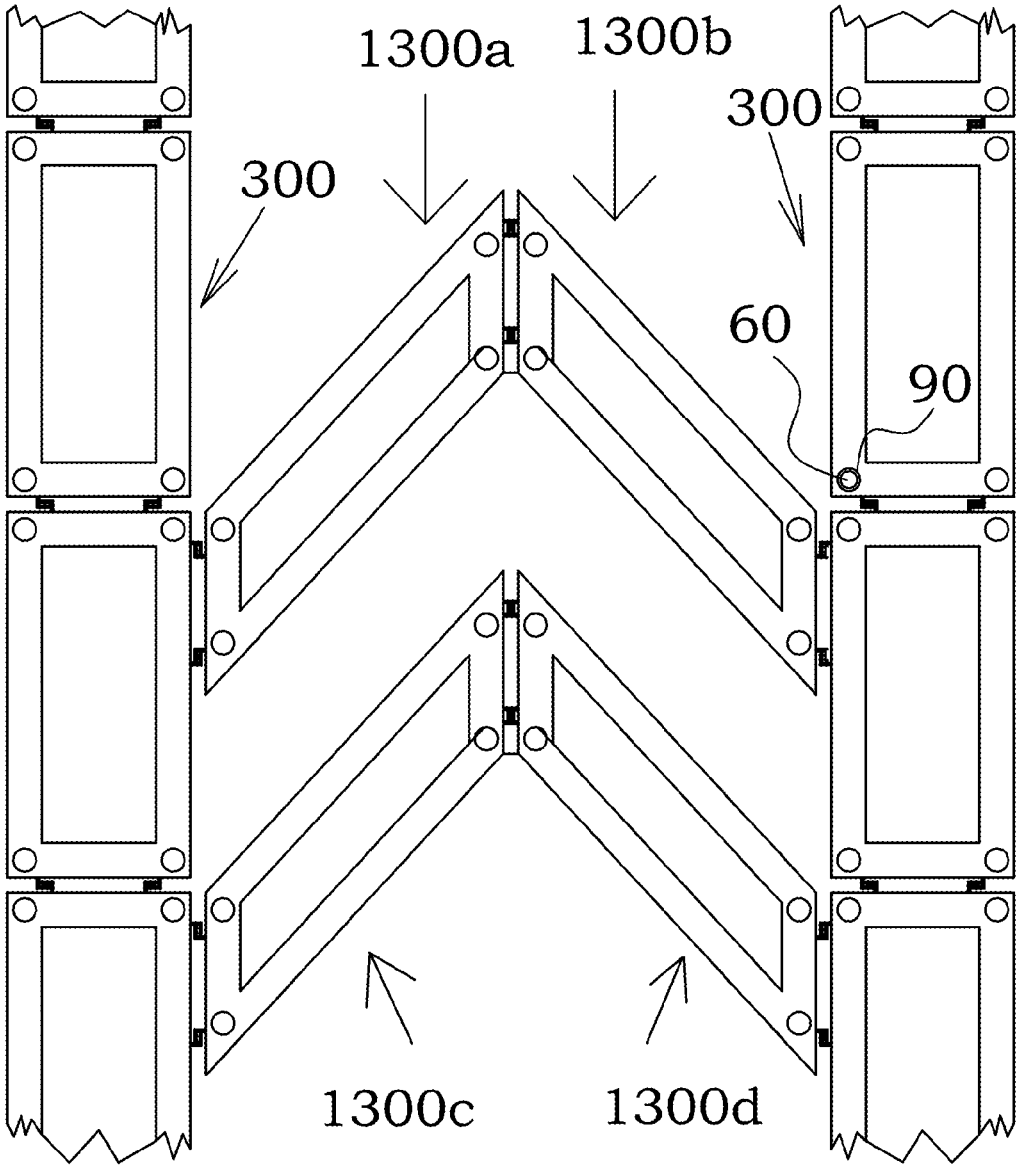
FIG. 31 is a top view showing a lock application of the thirteenth embodiment of the present invention.
Figure 32:
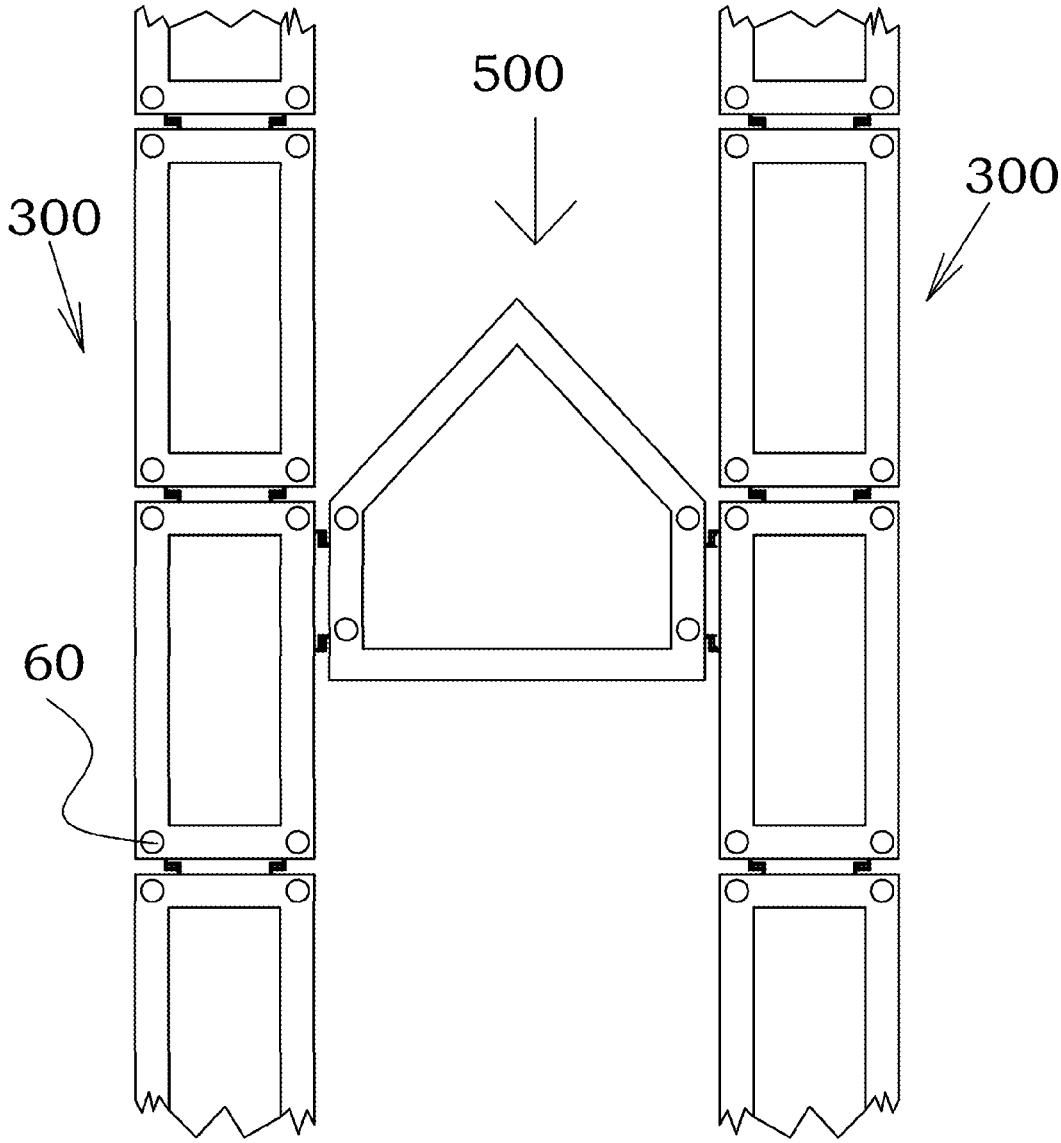
FIG. 32 is a top view showing a lock application of the fifth embodiment of the present invention.
Figure 33:
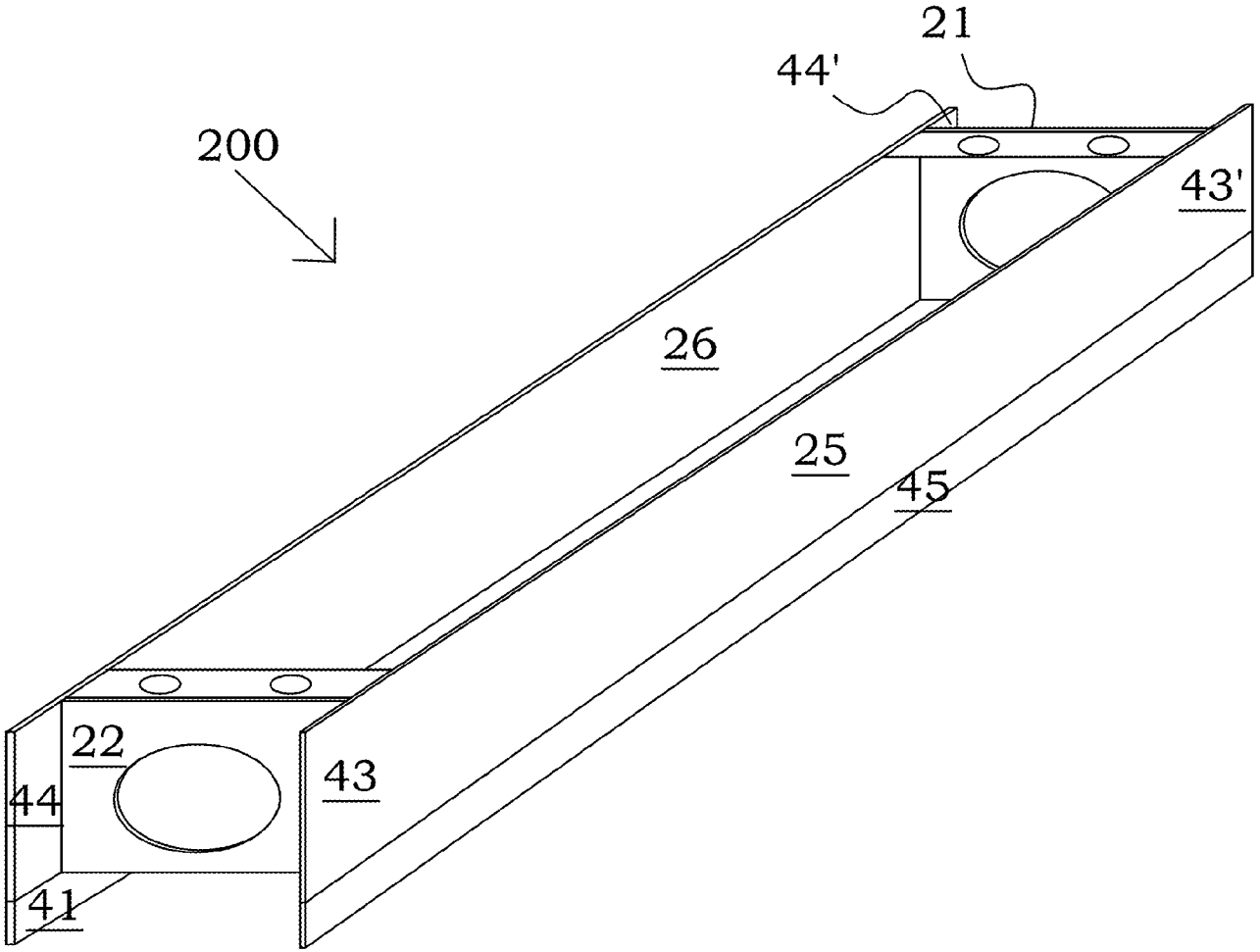
FIG. 33 is a perspective view showing a lock application of the second embodiment of the present invention.

FIG. 31, FIG. 32, and FIG. 33 illustrate a lock system application of the flood levee and barrier module of the present invention. The lock system application generally comprises at least one module installed on each side of a body of water (such as a stream, river, canal, or bayou) and at least one moveable module extending across the body of water to restrict water flow. Alternatively, the moveable module may attach to a pre-existing structure.

To use the modules in a lock system, pilings 60 of a sufficient height are installed to a proper depth in the desired location on the sides of the body of water. Then one or more modules 300 are positioned over the pilings 60 and lowered onto the pilings 60. Alternatively, the modules 300 may be placed in location first and the pilings 60 driven through the conduit 90.

Referring to FIG. 31, a first exemplary lock system application with a movable module section is demonstrated by use of module 1300 of the thirteenth exemplary embodiment of the flood levee and barrier module of the present invention, although the modules n00 of any of the embodiments of the invention can be used to form the movable module section of the lock. To install the first lock system, side wall modules 300 are installed on pilings 60 on each side of a body of water (if no pre-existing structure to which to attach the moveable module exists).

Preferably then an angled submerged module 1300 (not shown, but generally shaped as modules 1300*a*, 1300*b*, 1300*c*, and 1300*d*) is submerged directly under the location where each of the lock modules 1300*a*, 1300*b*, 1300*c*, and 1300*d* will be positioned. Submerged module 1300 is submerged into the water and is positioned so that only a small amount of submerged module 1300 extends above the surface of the bottom of the body of water. This allows boats and water traffic to pass over the submerged modules 1300. These submerged modules 1300 provide a secure base or footing for lock modules 1300*a*, 1300*b*, 1300*c*, and 1300*d* to rest upon when used as a lock. In some soil conditions, more than one base module may need to be stacked vertically under the waterline to achieve the desired few feet extending above the soil line.

Lock submerged modules 1300*a*, 1300*b*, 1300*c*, and 1300*d* are stored on the sides of the body of water, or on top of modules 300 until the time of use. At the time of use, lock submerged modules 1300*a*, 1300*b*, 1300*c*, and 1300*d* are engaged with connection devices 330, 335, 340, 345 (shown in detail in FIG. 11) and placed on the submerged modules. This may be done with a crane, boom, helicopter, barge, truck, or other mechanical device (not shown).

The locking system of FIG. 31 can be used with only two angled modules (the set 1300*a* and 1300*b*) or, in the alternative, with two or more sets of modules (the set 1300*a* and 1300*b* plus the set 1300*c* and 1300*d*), as illustrated. The locking system of FIG. 31 can be used with or without pilings 60 to anchor modules 1300*a*, 1300*b*, 1300*c*, and 1300*d*.

FIG. 32 illustrates a second lock system utilizing the modules of the flood levee and barrier protection system of the present invention. The second lock system, similar to the first lock system, is demonstrated by utilizing module 500 of the fifth exemplary embodiment as the movable lock section. Side wall modules 300 are installed on pilings 60 on each side of a body of water with module 500 stored on the sides of the body of water, or on top of the side wall modules 300 until the time of use. At the time of use, module 500 is lifted by crane or otherwise placed between side wall modules 300, engaging side wall modules 300 by a connection devices 330, 335, 340, 345 (FIG. 11), thereby preventing water movement through the canal, waterway or other body of water.

Optionally, a base module (not shown) similar to module 500 can be submerged directly under the location where module 500 will be positioned. This base module is submerged into the water and is placed so that only a small amount of module 500 extends above the surface of the bottom of the body of water. This allows boats and water traffic to pass over the submerged modules, while providing a secure base for module 500 to rest upon when in use as a lock.

FIG. 33 illustrates a third lock system utilizing the modules of the flood levee and barrier protection system. The third lock system is demonstrated by utilizing a moveable lock module 200 of the second exemplary embodiment of the present invention as the movable lock section. Lock side wall modules (not shown) are installed on pilings 60 on each side of a body of water. Or, alternatively, the moveable lock module 200 can attach to a pre-existing structure on the sides of the body of water, which has a complementary connection system installed (not shown). Moveable lock module 200 is stored on the sides of the body of water, or on top of the side wall modules 200 until the time of use. At the time of use, module 200 is lifted by crane or otherwise placed between side wall modules 200, engaging side wall modules 300 by a connection devices 330, 335, 340, 345 (FIG. 11), thereby preventing water movement through the canal, waterway or other body of water. If the distance between the banks of the body of water is greater, two or more horizontally abutting moveable lock modules 200 may be required.

Optionally, a base module, not shown but similar to module 200 can be submerged directly under the location where module 200 will be positioned, similarly to the other lock systems. The locking system of FIG. 33 can be used with or without pilings 60 to anchor module 200, but preferably pilings 60 are installed.

If the distance between the banks of the body of water is greater, two or more horizontally abutting base modules may be required. Module 200 will be stored on the banks of the canal or body of water, or directly on the lock side modules or other structure until needed. At the time of use, module 200 will stretch between the banks of the canal or waterway engaging its lateral projections with the lock side modules and installed on pilings 60 (which have previously been placed in location), by using, for example, a crane, boom, helicopter, barge, truck, or other vehicle. If the distance between the banks is greater than the length of module 200, it can abut a previously installed structure, or it can abut other installed modules of this invention. This can be done permanently, semi-permanently, or only temporarily, for example, to close off a canal that is no longer needed. It can be moved into position when a need is projected, such as for a predicted tidal surge, flood, or hurricane, or it can be moved into position during an emergency when a need is imminent or immediate. Additional modules 200 can be added if more height is necessary. The height of the pilings 60 (if used) is designed to be adequate to allow the necessary number of vertical modules 200. This module 200 can either be utilized to contain filler material 109, or optionally, to be left empty.

FIG. 34 to FIG. 41 illustrate an optional feature of the levee and barrier modules, levee wash protection armor 120, that can be applied to any of the modules n00 of the embodiments of the current invention or to existing levees, but is shown as applied to the third embodiment, module 300. The levee wash protection armor 120 comprises a substantially horizontal planar engagement cap 123 and a planar wedge cover 121. The engagement cap 123 and the planar wedge cover 121 are preferably constructed of steel plate, but can alternatively be constructed of aluminum, aluminum plate, plastic, resins, cement, concrete, pre-stressed concrete, reinforced concrete, wood, other building material, or of a combination of materials, some of which would require additional reinforcement.

Figure 39:
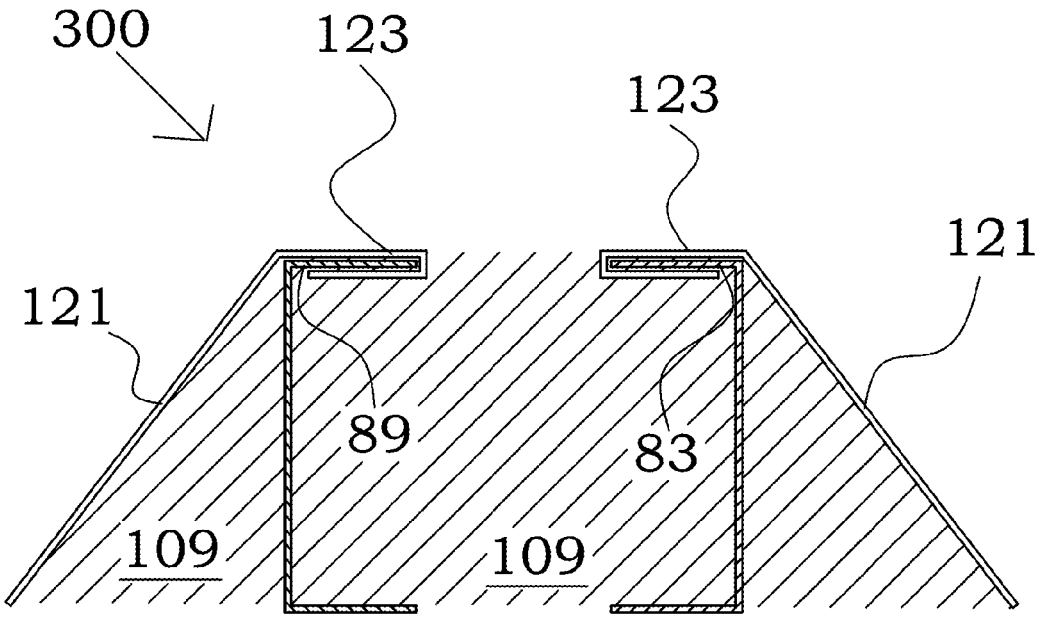
FIG. 39 is a cross-sectional view taken along line 39-39 in FIG. 38, showing the optional levee wash protection armor feature of the current invention that can be applied to any of the other embodiments of the current invention.

Engagement cap 123 is configured with an attachment means to attach the levee wash protection armor 120 to module 300. This attachment means can be conduits 124, 125 configured for the insertion of pilings 60 (which are driven into the ground and extend upward through module 300). Alternatively, as in FIG. 38 and FIG. 39, the attachment means can be a J-shaped channel 126 (FIG. 39). J-shaped channel 126 is a structural member of the engagement cap of the levee wash protection armor, configured to attach over the top guide plates 89, 83 (FIG. 39).

Figure 34:
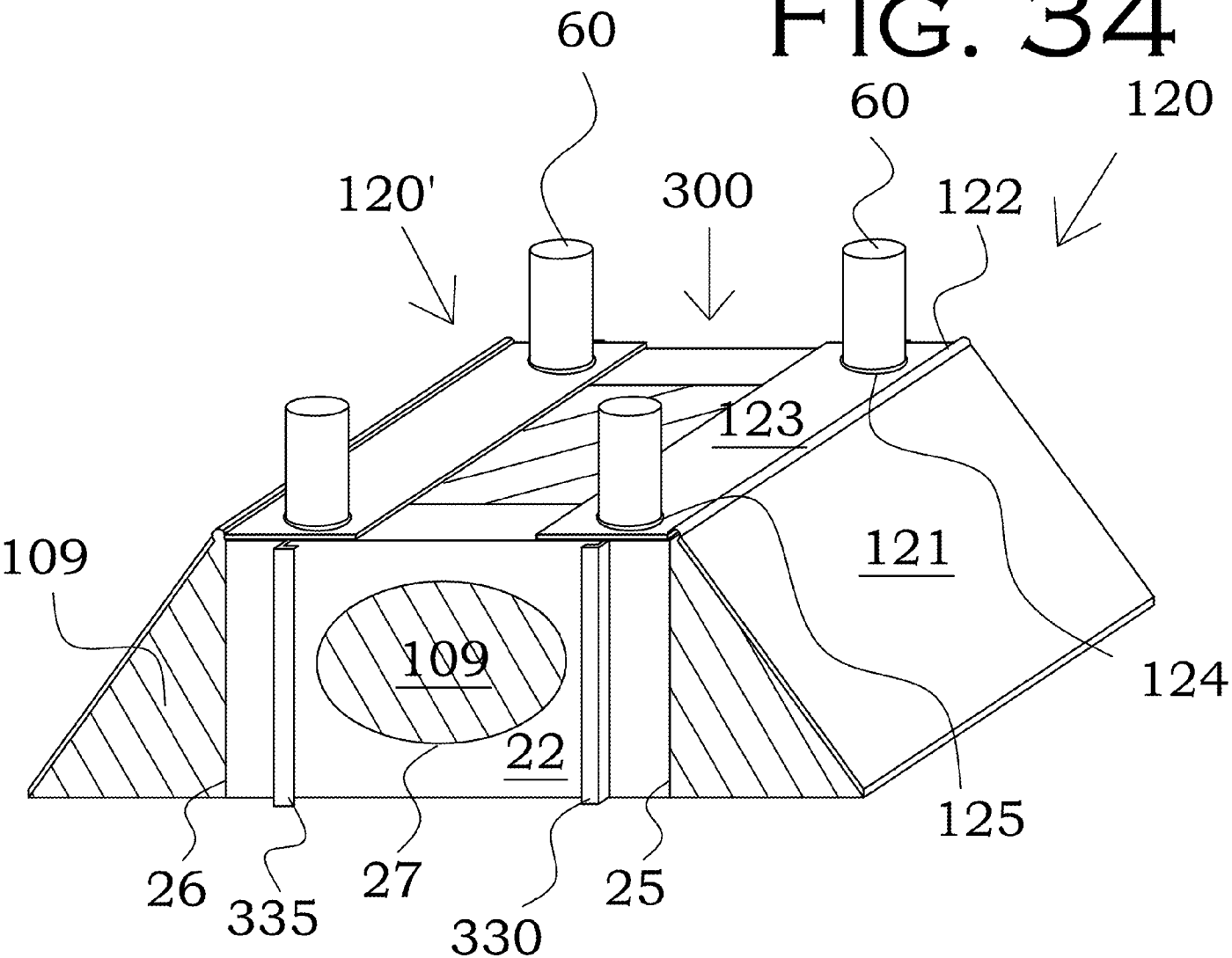
FIG. 34 is a perspective view showing an optional levee wash protection armor feature of the current invention that can be applied to any of the embodiments of the current invention.
Figure 35:
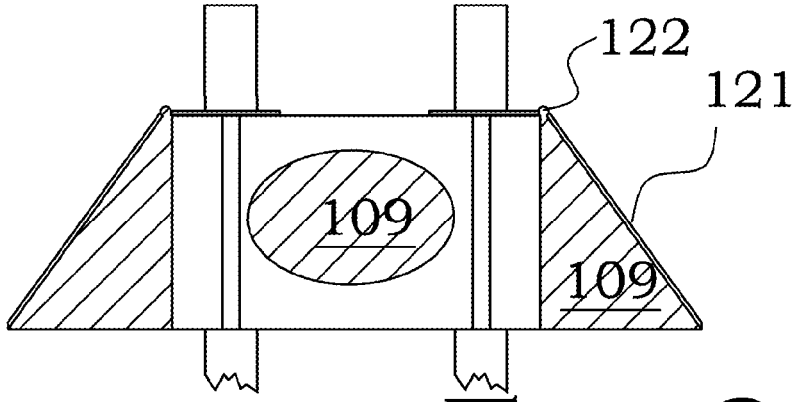
FIG. 35 is a front view showing the optional levee wash protection armor feature of the current invention that can be applied to any of the embodiments of the current invention.
Figure 36:
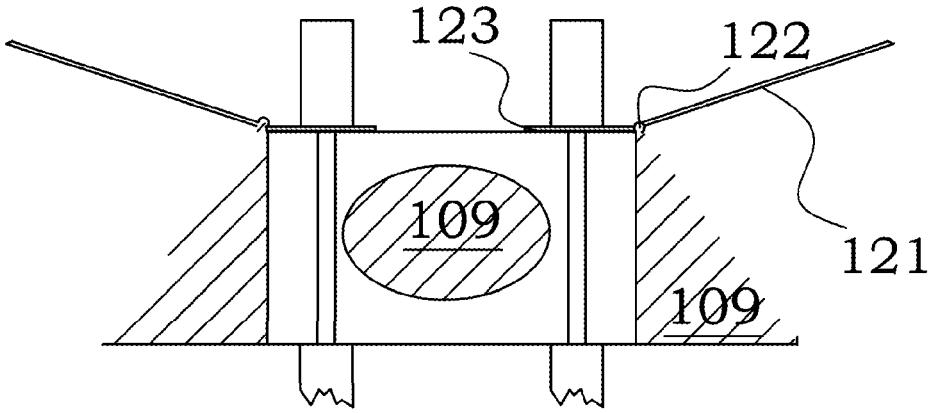
FIG. 36 is a front view showing the optional levee wash protection armor feature of the current invention that can be applied to any of the embodiments of the current invention.
Figure 37:
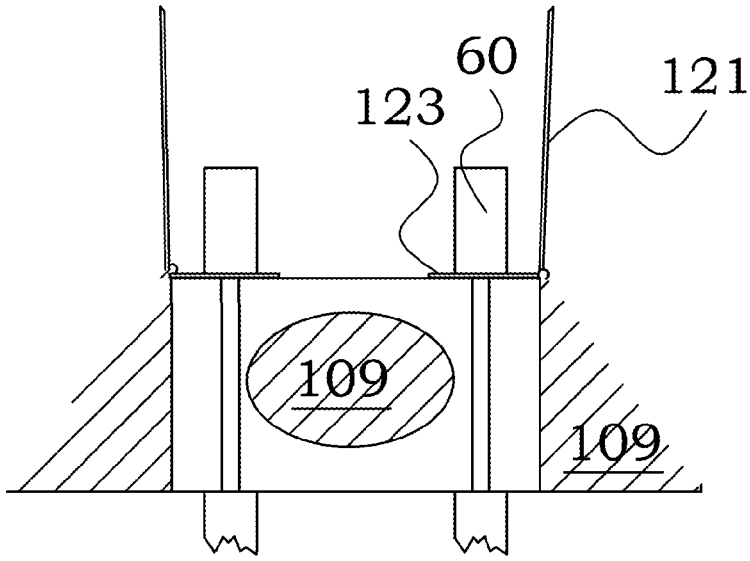
FIG. 37 is a front view showing the optional levee wash protection armor feature of the current invention that can be applied to any of the embodiments of the current invention.
Figure 38:
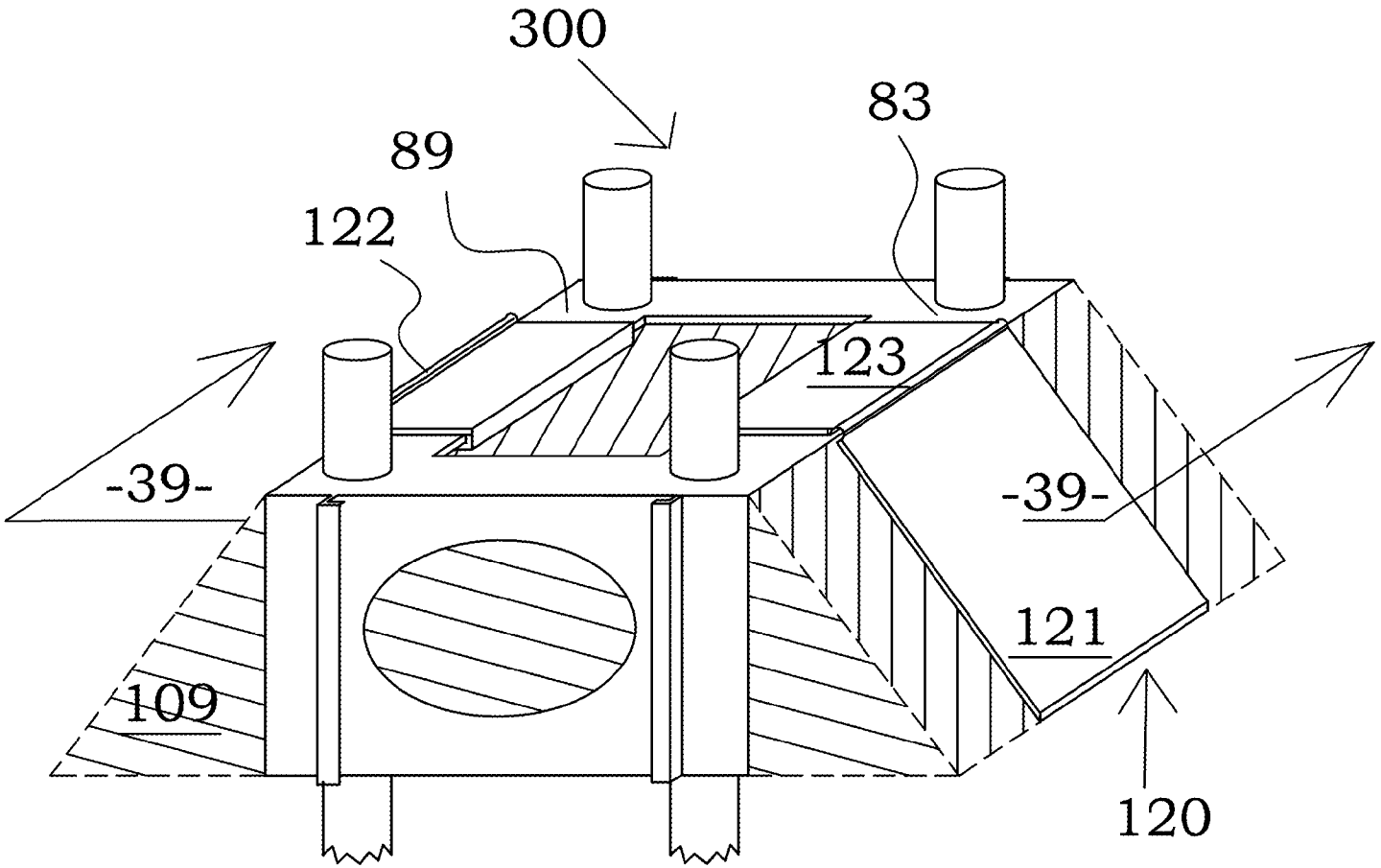
FIG. 38 is a perspective view showing an optional levee wash protection armor feature of the current invention that can be applied to any of the embodiments of the current invention.
Figure 40:
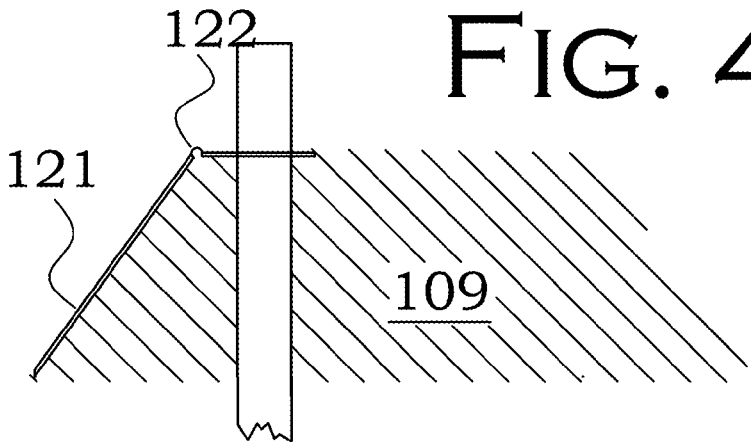
FIG. 40 is a front view showing the levee wash protection armor feature of the current invention.
Figure 41:
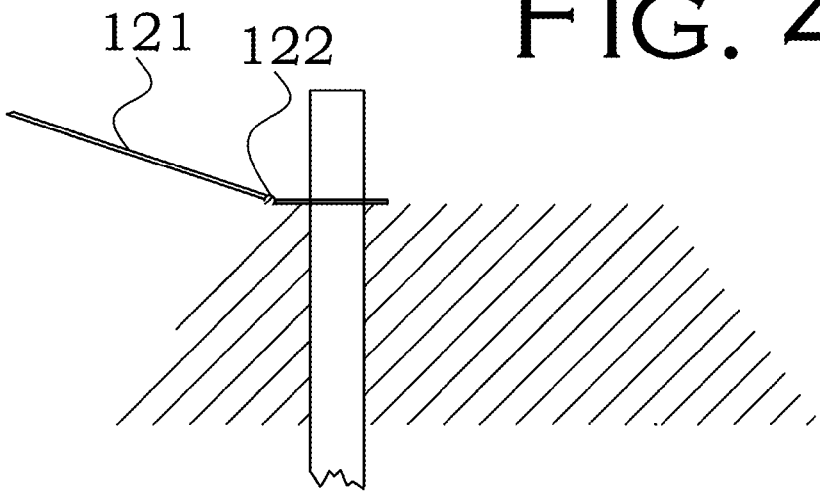
FIG. 41 is a front view showing the levee wash protection armor feature of the current invention.
Figure 42:
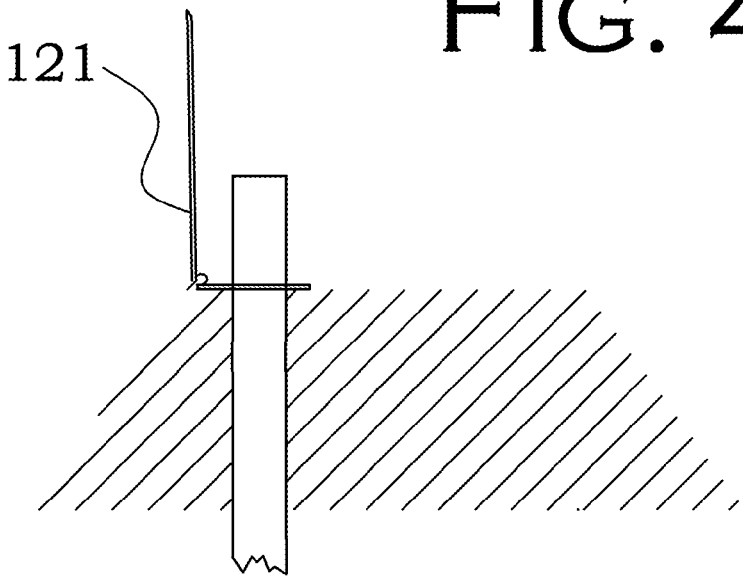
FIG. 42 is a front view showing the levee wash protection armor feature of the current invention.

The levee wash protection armor 120 serves to protect the filler material 109 (usually located in a generally triangular-shaped wedge on the outside of module side walls 25, 26) from the washing effects of water movement, such as flood water or storm surge or wave action. The levee wash protection armor 120 also provides access to the filler material 109 wedge for maintenance and for replenishment, if needed, by lifting planar wedge cover 121. Preferably the levee wash protection armor is configured with a hinge 122, which allows planar wedge cover 121 to be easily lifted as demonstrated in FIG. 35 to FIG. 37. Less preferably, the levee wash protection armor 120 may be constructed in one piece, which would then require lifting the entire levee wash protection armor 120 to access the filler material 109 wedge beneath (FIG. 34). The levee wash protection armor 120 can be installed on one side of the levee, or on both sides. Alternatively, as illustrated in FIG. 40 to FIG. 42 the levee wash protection armor 120 can be installed attached to a piling 60 on a levee formed of filler material, without utilizing a module n00.

FIG. 43 to FIG. 49 illustrate an additional application of one or multiple levee and barrier module(s) that provides pipeline 350 protection and/or pipeline 350 integration into new or existing levees. Throughout this disclosure, unless otherwise indicated by context, the term "pipeline" (and grammatical equivalents) refers to a single pipe or conduit or a system of pipes or conduits, either enclosed or open-topped, through which material is conveyed. Such conveyed materials may be liquid, gas, or solids, such as, for example, water, natural gas, petroleum products, suspended particulates, or slurries.

The pipeline application can be practiced using a single module alone or using a unit of multiple modules. It can be used in new construction of a levee or as a substitute or replacement segment of any type of levee. The pipeline application can be further used without connection or relationship to a levee. For example, a pipeline-protection module might be utilized for protecting a pipeline carrying treated water from a municipal plant or the like.

The pipeline application can be implemented using any of the types of modules n00 of any of the embodiments of the current invention, but is shown as utilized with the third embodiment, module 300 of FIG. 10 and FIG. 11. The pipeline application can be used with (or without, such as when a single module is used) any module-to-module connection system, but is shown with the connecting system of the third embodiment including complementary end flanges (substantially L-shaped complementary outward-facing end flanges 340, 345 and inward-facing end flanges 330, 335) to connect adjacent modules. Pad eyes 63 (or other similar devices) are disposed on the modules in positions suitable for moving, lifting, and placing the modules. (The pad eyes 63 and flanges 330, 340, 335, 345 are not shown in some illustrations for clarity.)

The pipeline application is shown with modules 300 having an outer shell formed by opposing side walls 25, 26 (FIG. 8) and opposing end walls 21, 22 with a partial top wall (formed by inwardly extending top guide plates 40, 81, 83, and/or 89) and a partial bottom wall (formed by bottom guide plates 41, 92, 77, and/or 55, FIG. 8). The partial top wall (guide plates 40, 81) and partial bottom wall (guide plates 41, 92) have aligned conduits (90, 91, 93, 94) through which pilings 60 are installed, such as by drilling, hammering, or driving.

Optionally, as shown in FIG. 7, top end guide plates 40, 81 and bottom end guide plates 41, 92 can each be configured with a single pair of vertically aligned top and bottom conduits—90 aligned with 91 and 93 aligned with 94. Optionally side guide plates 83, 89, 77, 55 may be omitted with the top end guide plates 40, 81 and bottom end guide plates 41, 92 each configured with a pair of vertically aligned top and bottom conduits (90, 91, 93, 94), as shown in FIG. 8. The outer shell is configured with a top aperture 95 and a bottom aperture 96. Though the modules 300 are shown with end apertures 27 in the end walls 21 (to allow, when modules are abutted together and placed end to end, the contiguous end apertures 27 of adjacent modules to form an elongated tunnel that is continuous through adjacent modules, thereby permitting a longitudinal flow of the filler material 109), the end apertures 27 may or may not be included, depending on the specifics of the application. For example, no end apertures 27 may be desirable when a single module 300 is installed to provide protection and/or shielding to a pipeline as it emerges onto the surface of the ground.

Either of two orders of installation of the modules can be used; the module 300 is placed in position and pilings 60 are installed through the aligned conduits 90, 91, 93, 94 (FIG. 8) or pilings 60 are installed first with module 300 lowered onto the pilings 60. Disposed between the upper and lower aligned conduits is inner pipe sleeve 33 (as described and shown in FIG. 18).

The levee module 300 is installed above one or more pipelines 350. The levee module 300 is installed on two or more pilings 60 (shown and described with four pilings 60). A piling cap 375 is placed over the top of piling 60 and securely attached via a cap-to-module attachment 380 to the top of module 300 at approximately the top edge of the guide conduit through the top end guide plate (40, 81). The weight of the module 300 is supported by caps 375 (attached to the top of module 300 via cap-to-module attachment 380) and pilings 60, without the pipeline(s) 350 receiving weight from module 300. Thus the pipeline is unencumbered and runs freely along its predetermined path, yet is protected. For example, if a road needs to cross the pipeline 350, the module 300 (including piling cap 375 and the cap-to-module attachment 380) is engineered and installed with enough strength and piling support to support both the weight of the module 300 and the weight of the road built upon the module 300.

Advantageously, the pipeline protective application allows the installed module 300 to be removed from above the pipeline(s) 350 in situations in which the pipeline(s) 350 may need repair, maintenance, or servicing.

Figure 43:
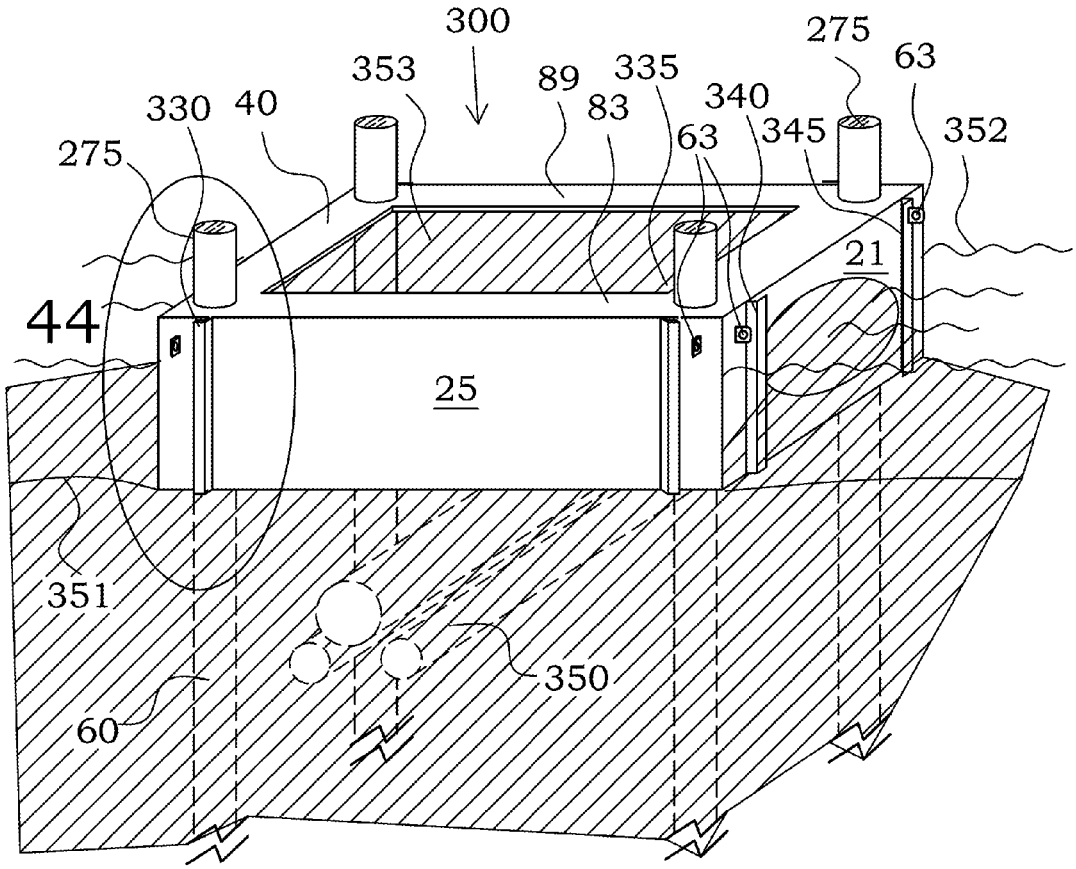
FIG. 43 is a perspective view showing an application of the levee module for use in pipeline protection.

In FIG. 43, the module 300 is installed at ground 351 level in a depth of water 352; however the pipeline application of the module 300 is usable at or above ground level or where there is no solid ground, such as in swamps. Fill material 353 (such as soil, sand, gravel, debris, or the like, represented by hash lines), will optionally, but preferably, fill the module 300 and will abut and merge with the ground 351.

FIG. 44 illustrates a closer, expanded view of the piling cap 375, cap-to-module attachment 380, guide plate 40 (perforated by conduit 90), and inner pipe sleeve 33. The piling cap 375 is preferably a section of metal pipe with a closed top sized to fit over the end of a piling, but other shapes that can fit over the top of piling 60 and support the weight of the module 300 are within the scope of the invention. After the module 300 is installed with piling 60 placed to the correct depth (and optionally, after piling 60 is shortened to the correct level), the piling cap 375 is attached near the top of conduit 90 via the cap-to-module attachment 380 (the cap-to-module attachment 380 in this embodiment preferably comprises welding).

FIG. 45 illustrates a view of the addition of a second module 300*a* by use of an extension comprising extension cap 365 and extension pipe 360. The second module 300*a* has an expanded upper conduit 390, expanded lower conduit 391, and expanded inner pipe sleeve 333, all of which are sized to accommodate the extension cap 365. The extension cap 365 is sized to fit over the piling cap 375 which is extending from the top of module 300. Attached securely to (or formed integrally with) the extension cap 365 is an extension pipe 360. The extension pipe 360 is sized to extend upward from extension cap 365 sufficiently to extend past the plane of the top of module 300*a*, when installed. Generally the extension pipe 360 has a smaller diameter than the extension cap 365, to facilitate placement of additional upper modules n00, if additional modules are needed for the specific application.

To install the second module 300*a* above the first module 300 (after installation of the first module, with piling cap 375 extending from the top of the first module), the second module 300*a* is lowered onto the first module 300, with the expanded lower conduit 391 positioned to receive piling cap 375. The extension is lowered into expanded inner pipe sleeve 333, with the extension cap 365 fitted over the piling cap 375 and with the extension pipe 360 extending upward above the top of module 300*a*. (Alternatively, the extension may be first placed over the piling cap 375 with extension cap 365 lowered over piling cap 375, and the second module 300*a* lowered over the extension.) A second piling cap 375 is then securely attached via the cap-to-module attachment 380 (welding is preferably used in this embodiment).

Figure 46:
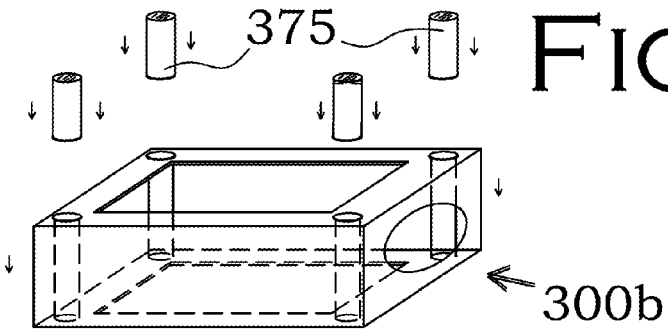
FIG. 46 is an exploded perspective view of installation of multiple vertical pipeline protective modules.

FIG. 46 illustrates both a modification of the outer shell to accommodate an inset pipeline and the addition of a third module 300*b* to the top of the second module 300*a*. Four second extensions (comprising extension caps 365 and extension pipes 360) are used to install the third module 300*b*.

The first module 300 is placed over pilings 60, with first piling cap 375 placed over the top of piling 60 and attached to the first module 300 by cap-to-module attachment 380 (FIG. 44, FIG. 45). The extension is positioned over the piling cap 375 with extension cap 365 lowered over piling cap 375. The second module 300*a* is placed over, and aligned with, first module 300, with the extension pipe 360 extending above the module 300*a*. A second piling cap 375 is placed over the top of the extension pipe 360 and attached to the second module 300*a* by cap-to-module attachment 380.

Similarly, to install the third module 300*b*, an extension is positioned over the piling cap 375 with extension cap 365 lowered over piling cap 375. The third module 300*b* is placed over, and aligned with, second module 300*a*, with the extension pipe 360 extending above the module 300*b*. A third piling cap 375 is placed over the top of the extension pipe 360 and attached to the third module 300*b* by cap-to-module attachment 380.

FIG. 46 also shows the optional modification of the outer shell to accommodate an inset pipeline. In some situations and/or locations a closer association between the pipeline 350 and the module 300 may be desirable. The side walls 25, 26 (FIG. 43, FIG. 8) may be formed with a shaped channel 380, 385 allowing at least a portion of the pipeline 350 to extend upward above the plane of the bottom of module 300. The shaped channel may be of any of a variety of shapes, such as, for example, a partial circular cutout, arch, rectangular opening, or other passageway. As a further option, the shaped channel 380 may be lined with a cushion 381. The cushion 381 provides protection, buffering, shielding, or cushioning to the pipeline 350. The cushion 381 may be any of a variety of solid substances having a degree of elasticity and/or compressibility, such as, for example, man-made or natural rubber, dense foam, or elastic-plastic compressible material.

Figure 47:
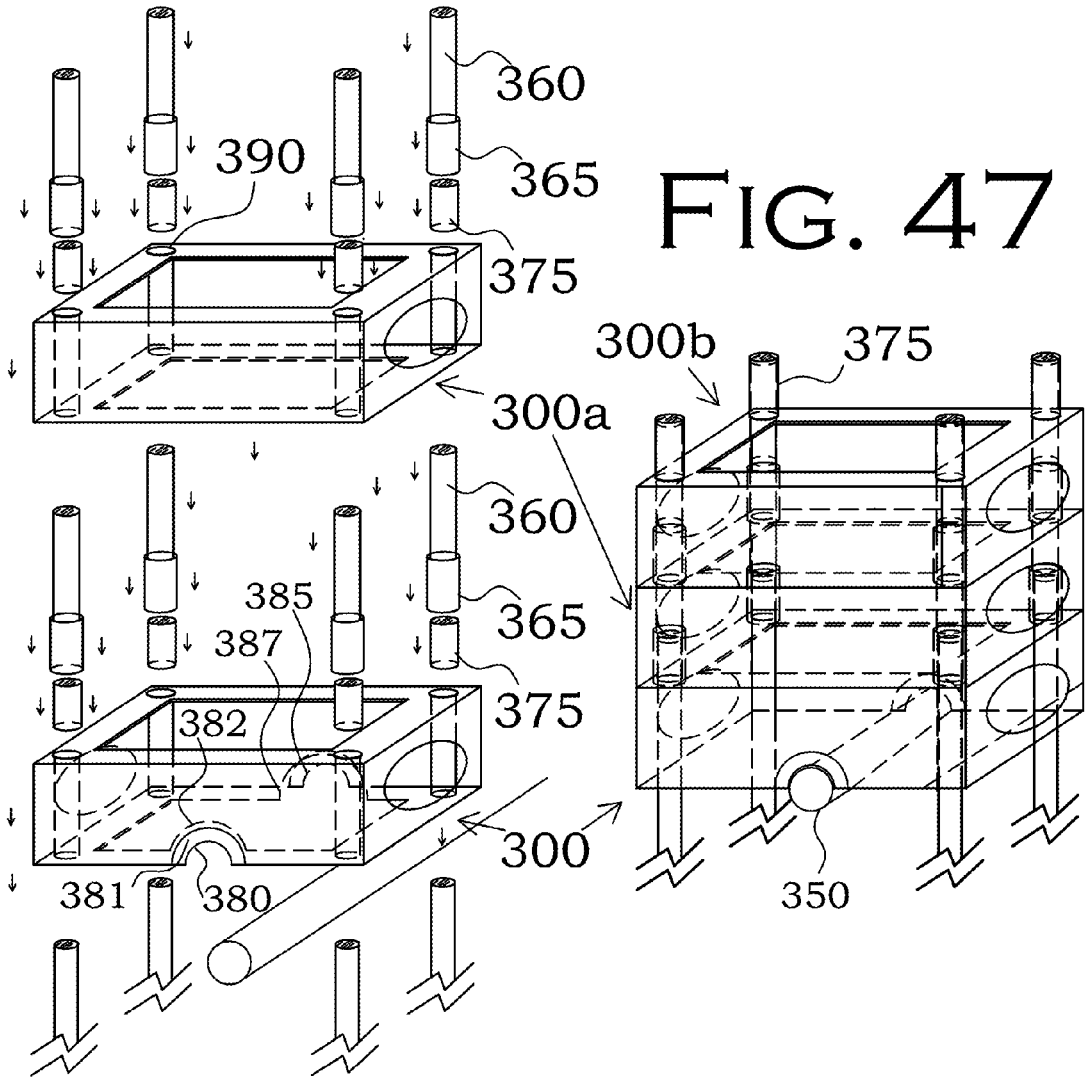
FIG. 47 is a perspective view of multiple vertical pipeline protective modules in use.

FIG. 47 illustrates the assembled unit of three vertical modules, 300, 300*a*, and 300*b*. Similarly, other numbers of vertical modules can be utilized. Additionally, other modules can be added horizontally to one or more vertical modules via use of the complementary end flanges (not shown in FIG. 47, but shown in FIG. 43 and FIG. 49) or, optionally, other module-to-module connection systems, as described above.

Figure 48:
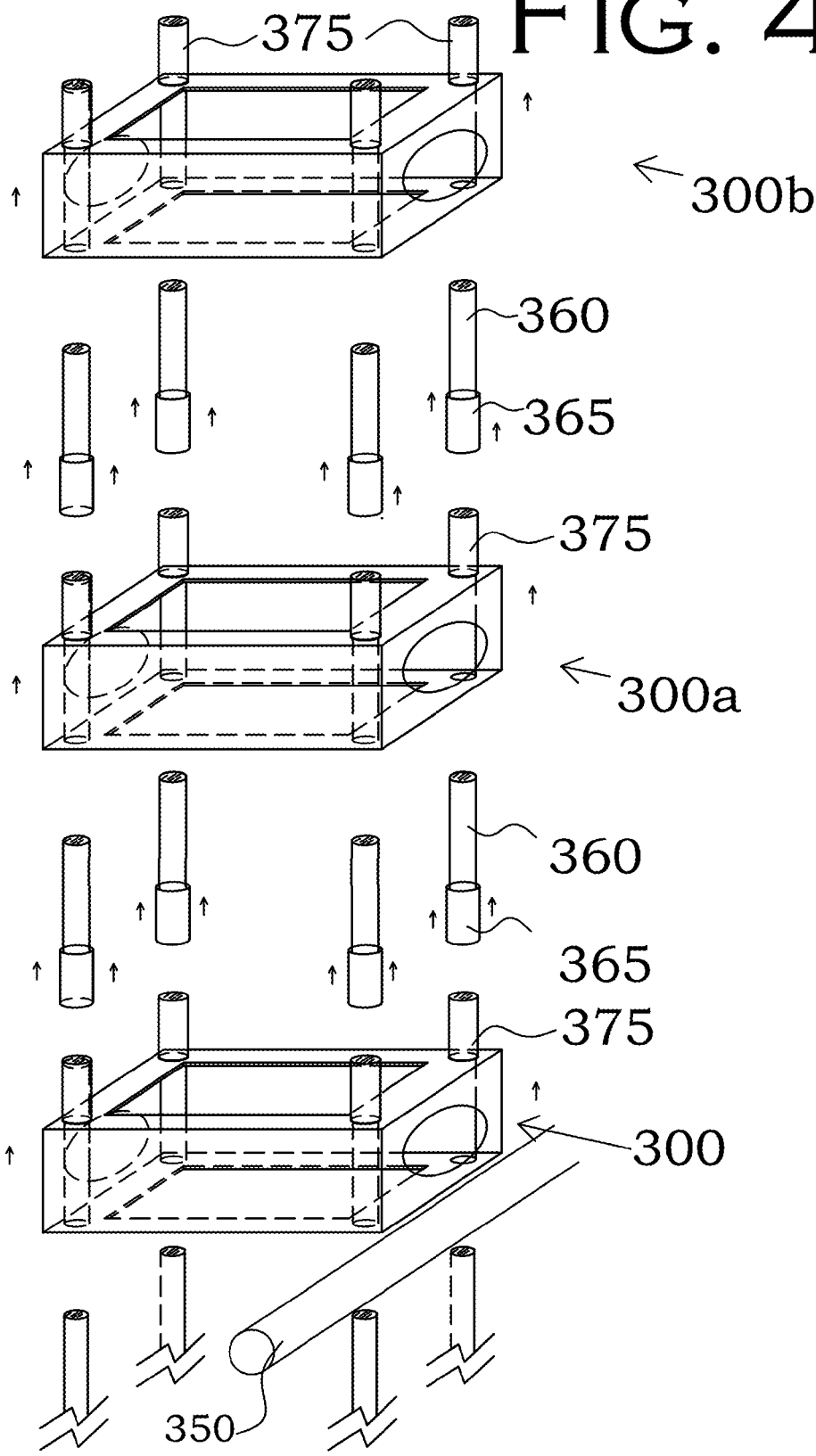
FIG. 48 is an exploded perspective view of de-installation of multiple vertical pipeline protective modules.

FIG. 48 illustrates the disassembly of the unit of three vertical modules, such as is advantageous for servicing or repair of the pipeline. As shown, each piling cap 375 remains permanently attached to the top of the module 300, 300*a*, 300*b*. The components are removed in the following order: (1) the top module 300*b* is lifted off with the four attached piling caps 375; (2) the second extension 360, 365 is removed from the top of the middle module 300*a*; (3) the middle module 300*a* is lifted off with the four attached piling caps 375; (4) the first extension 360, 365 is removed from the top of the bottom module 300; and (5) the lower module 300 is removed from pilings 60, allowing complete access to the pipeline 350 below.

Figure 49:
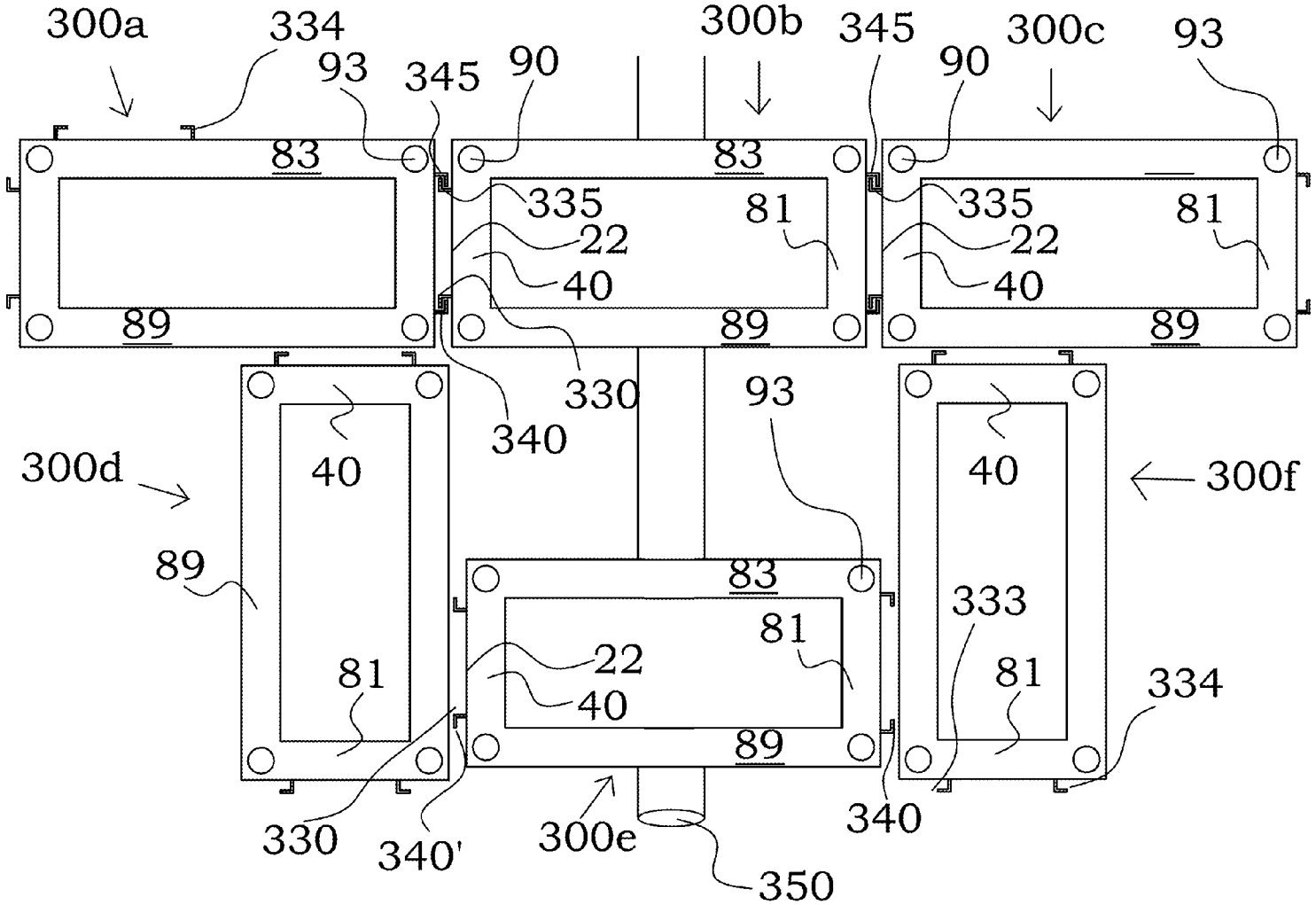
FIG. 49 is a top view of multiple horizontally attached pipeline protective modules with an additional repair application illustrated.

FIG. 49 is a top view illustrating a segment of a levee (modules 300*a*, 300*b*, 300*c*) installed over a pipeline 350 and filled with filler material to form a watertight levee.

The versatility of the modular units allows the building of a cofferdam in waterlogged soil or under water for repair or servicing of the pipeline 350. Modules 300*d*, 300*e*, 300*f* are placed in front of the horizontally extending levee segment (shown as modules 300*a*, 300*b*, 300*c*). Then filler material is used to fill the forward modules 300*d*, 300*e*, 300*f* to form a watertight enclosure, which can be pumped dry to allow convenient access to the area of interest of the pipeline 350. If needed for the repair, module 300*b* can also be removed to allow access to a larger area of the pipeline 350.

At the completion of the repair, module 300*b* (if previously removed) can be reinstalled. The forward modules 300*d*, 300*e*, and 300*f* can be removed to return the levee to the original width. However, if desirable and the area allows, forward modules 300*d*, 300*e*, and 300*f* can be left in place, with the center area also filled with filler material. This results in a wider levee segment by incorporating the original levee modules 300*a*, 300*b*, 300*c*, the center area, and the forward modules 300*d*, 300*e*, and 300*f*.

A wide variety of sizes, dimensions, and materials can be provided for the modules of the present invention, including modules integrally formed in one piece, modules of joined panels that are shipped pre-fabricated, and modules shipped as panels and assembled on site. For example, to maximize the dimensions of the module while expediting the shipping of modules by truck, the side walls 25, 26 can be pre-fabricated of approximately 10 foot by 20 foot steel panels with end walls 21, 22 of approximately 10 by 10 foot steel panels. Larger panels may be shipped and the larger modules assembled on site. If shipped by truck to a shoreline, marsh, or other levee area, the pre-fabricated module can be lifted off with a small crane into position, slid off the truck directly into position, or placed on a vessel for shipping to a position that is offshore. The modules can be placed into position by many means, including, for example, ship, barge, helicopter, marsh buggies, trucks, or other vehicles.

The invention has been shown to allow for ease in pre-fabrication, installation, inspection, maintenance, and repair. This modular system can be used in any application, large or small, where fluid containment or control is needed, using materials and dimensions to suit the application. The system can be constructed at any time or place to any height, width, or depth desired, by adding modules n00 to the side, front, back or top of the previously installed modules n00. The system can be either pre-fabricated and moved to the levee site, or fabricated at the levee site.

The levee and barrier module n00 and system can be used for a wide variety of water control and containment applications in both shallow or in deep water. Examples of water control and containment include the following: in rivers, canals, bayous, lakes, Intercostal waterways, oceans, seas, drainage ditches, and along coasts; to regain lost land eroded by water, such as land eroded along canals, rivers, bayous, and lakes; to elevate highways that are low or subject to flooding; as a barrier to hold water such as for man-made lakes, sewage ponds, lagoons, and motes. Use of this system can lower business and homeowner insurance and flood insurance rates, thereby recouping expenditures for its installation.

Although the levee and barrier module and system is especially focused on the use of modules n00 for water control and containment, it can also be used to protect structures, buildings, or people. Examples of such protective uses include the following: as a firewall; as a barrier to contain oil or chemical spills such as around refineries; as a barrier around businesses such as hotels, hospitals, schools, institutions, airports, and malls; as a barrier around homes, subdivisions, towns, cities, etc.; as a barrier along the Gulf Coast to protect homes and businesses; as a barrier around dumps or land fills; as a barrier around nuclear power installations or nuclear waste installations, such as to protect against terrorism; as a barrier to protect oil and gas structures both in and out of water; as a fire barrier; as a barrier around government agencies to protect against terrorism; as a barrier around military bases, prisons, sports facilities, gyms, and other public places; as a barrier between two political areas, such as two adjoining countries.

This system can be installed on a new site, over an existing levee site, inside an existing levee, or outside of an existing levee. Many current levees are little more than piles of dirt that are suffering from erosion damage, are destabilized by burrowing rodents, and are weakest at the top allowing for ease in breeching. This levee and barrier system would provide far more structural integrity, not only at the bottom but also equally at the top of the levee, providing far more protection.

The elements shown are for illustrative purposes only and it will be appreciated by those skilled in the art that a wide variety of other levee and barrier modular configurations may also be utilized without departing from the present invention. The specific configuration used will depend upon a variety of location and situation specific factors.

Since many modifications, variations, and changes in detail can be made to the described preferred embodiments of the invention, it is intended that all matters in the foregoing description and shown in the accompanying drawings be interpreted as illustrative and not in a limiting sense.

I claim:

1. A levee module system for use with at least two pilings, comprising:

a first module comprising two opposing end walls, two opposing side walls, opposing first and second top end guide plates each extending from a top edge of one of said opposing end walls, opposing first and second bottom end guide plates each extending from a bottom edge of one of said opposing end walls, wherein said first module is configured with a top aperture configured to receive filler material and a bottom aperture configured to allow exit of at least a portion of said filler material, wherein said first opposing bottom end guide plate and said first opposing top end guide plate are configured with vertically aligned conduits sized and configured to receive one of said at least two pilings, and wherein said second opposing bottom end guide plate and said second opposing top end guide plate are configured with vertically aligned conduits sized and configured to receive one of said at least two pilings;

a first piling cap configured to fit over a first one of said at least two pilings and configured to be attached to said first top end guide plate; and a second piling cap configured to fit over a second one of said at least two pilings and configured to be attached to said second top end guide plate, whereby the weight of said first module is supportable by said at least two pilings so as to allow a pipeline to run below said first module without bearing the weight of said first module.

2. The levee module system for use with at least two pilings, as recited in claim 1, wherein said two opposing end walls are each configured with an end aperture.

3. The levee module system for use with at least two pilings, as recited in claim 1, further comprising a module-to-module connection system configured to connect horizontally adjacent modules.

4. The levee module system for use with at least two pilings, as recited in claim 3, wherein said module-to-module connection system comprises complementary outward-facing end flanges and inward-facing end flanges.

5. The levee module system for use with at least two pilings, as recited in claim 1, wherein:

said first top end guide plate is configured with two conduits;

said second top end guide plate is configured with two conduits;

said first bottom end guide plate is configured with two conduits; and said second bottom end guide plate is configured with two conduits.

6. The levee module system for use with at least two pilings, as recited in claim 5, further comprising:

a third piling cap configured to fit over a third one of said at least two pilings and configured to be attached to said first top end guide plate; and a fourth piling cap configured to fit over a fourth one of said at least two pilings and configured to be attached to said second top end guide plate.

7. The levee module system for use with at least two pilings, as recited in claim 6, further comprising:

a second module comprising two opposing end walls, two opposing side walls, opposing third and fourth top end guide plates each extending from a top edge of one of said opposing end walls, opposing third and fourth bottom end guide plates each extending from a bottom edge of one of said opposing end walls; wherein said second module is configured with a top aperture configured to receive filler material and a bottom aperture configured to allow exit of at least a portion of said filler material; wherein said third opposing bottom end guide plate and said third opposing top end guide plate are configured with vertically aligned conduits sized and configured to receive one of said at least two pilings; wherein said fourth opposing bottom end guide plate and said fourth opposing top end guide plate are configured with vertically aligned conduits sized and configured to receive one of said at least two pilings; and wherein the length and width of said second module is substantially equal to the length and width of said first module;

a first extension having a height greater than the height of said second module, said first extension comprising a first extension pipe and a first extension cap configured to fit over said first piling cap;

a second extension having a height greater than the height of said second module, said second extension comprising a second extension pipe and a second extension cap configured to fit over said second piling cap;

a third extension having a height greater than the height of said second module, said third extension comprising a third extension pipe and a third extension cap configured to fit over said third piling cap; and a fourth extension having a height greater than the height of said second module, said fourth extension comprising a fourth extension pipe and a fourth extension cap configured to fit over said fourth piling cap.

8. The levee module system for use with at least two pilings, as recited in claim 7, further comprising:

a fifth piling cap configured to fit over said first extension pipe and configured to be attached to said third top end guide plate;

a sixth piling cap configured to fit over said second extension pipe and configured to be attached to said third top end guide plate;

a seventh piling cap configured to fit over said third extension pipe and configured to be attached to said third top end guide plate; and an eighth piling cap configured to fit over said fourth extension pipe and configured to be attached to said third top end guide plate.

9. A method to install a module system for protecting a pipeline, comprising:

driving four pilings into the ground a sufficient distance to provide support for said module system, wherein the first two of said four pilings are placed to a first side of said pipeline, and wherein the second two of said four pilings are placed to a second side of said pipeline;

placing a first module comprising a first outer shell configured with four upper guide conduits aligned with four lower guide conduits onto said four pilings with each of said four aligned upper and lower guide conduits receiving one of said four pilings;

placing a first piling cap over the top of a first of said four pilings;

welding said first piling cap to the top of said first outer shell;

placing a second piling cap over the top of a second of said four pilings;

welding said second piling cap to the top of said first outer shell;

placing a third piling cap over the top of a third of said four pilings;

welding said third piling cap to the top of said first outer shell;

placing a fourth piling cap over the top of a fourth of said four pilings; and welding said fourth piling cap to the top of said first outer shell.

10. The method to install a module system for protecting a pipeline, as recited in claim 9, further comprising:

placing a first extension onto said first piling cap;

placing a second extension onto said second piling cap;

placing a third extension onto said third piling cap;

placing a fourth extension onto said fourth piling cap;

placing a second module comprising a second outer shell configured with four upper extended conduits aligned with four lower extended conduits onto said first module with each of said four aligned upper and lower guide conduits receiving one of said first extension, said second extension, said third extension, or said fourth extension.

11. The method to install a module system for protecting a pipeline, as recited in claim 10, further comprising:

placing a fifth piling cap on the top of said first extension;

welding said fifth piling cap to the top of said second outer shell;

placing a sixth piling cap on the top of said second extension;

welding said sixth piling cap to the top of said second outer shell;

placing a seventh piling cap on the top of said third extension;

welding said seventh piling cap to the top of said second outer shell;

placing a eighth piling cap on the top of said fourth extension; and welding said eighth piling cap to the top of said second outer shell.

* * * * *